US006454010B1

(12) United States Patent
Thomas et al.

(10) Patent No.: US 6,454,010 B1
(45) Date of Patent: Sep. 24, 2002

(54) WELL PRODUCTION APPARATUS AND METHOD

(75) Inventors: Wayne Thomas; Gary Morcom, both of Calgary (CA)

(73) Assignee: Pan Canadian Petroleum Limited, Calgary (CA)

( * ) Notice: Subject to any disclaimer, the term of this patent is extended or adjusted under 35 U.S.C. 154(b) by 0 days.

(21) Appl. No.: 09/584,368

(22) Filed: Jun. 1, 2000

(51) Int. Cl.[7] ..... E21B 43/14

(52) U.S. Cl. ..... 166/369; 166/105; 417/423.6

(58) Field of Search ..... 166/369, 105, 166/65.1, 106, 313; 417/372, 423.3, 423.6, 424.2

(56) References Cited

U.S. PATENT DOCUMENTS

| | | | |
|---|---|---|---|
| 3,114,566 | A | 12/1963 | Coberly et al. |
| 3,881,849 | A | 5/1975 | Commarmot et al. |
| 4,135,861 | A | 1/1979 | Brown et al. |
| 4,421,166 | A | 12/1983 | Cain |
| 4,424,859 | A | 1/1984 | Sims et al. |
| 4,614,232 | A | 9/1986 | Jürgens et al. |
| 4,617,991 | A | 10/1986 | Luetzelschwab |
| 4,828,036 | A | 5/1989 | Simmons |
| 4,836,305 | A | 6/1989 | Curlett |
| 5,246,070 | A | 9/1993 | Greve et al. |
| 5,417,281 | A | 5/1995 | Wood et al. |
| 5,472,329 | A | 12/1995 | Maynard et al. |
| 5,607,018 | A | 3/1997 | Schuh |
| 5,611,397 | A | 3/1997 | Wood |
| 5,618,171 | A | 4/1997 | von Behr et al. |
| 5,711,408 | A | 1/1998 | Dick |
| 5,733,111 | A | 3/1998 | Yu et al. |
| 5,775,816 | A | 7/1998 | Baranek et al. |
| 5,881,814 | A | 3/1999 | Mills |
| 5,950,106 | A | 9/1999 | May et al. |
| 5,951,171 | A | 9/1999 | Blume et al. |
| 5,992,517 | A | 11/1999 | McAnally |
| 6,017,198 | A | 1/2000 | Traylor et al. |
| 6,017,202 | A | 1/2000 | Durnack et al. |
| 6,033,195 | A | 3/2000 | Uppal |

FOREIGN PATENT DOCUMENTS

| | | |
|---|---|---|
| DE | 40 22 148 A1 | 1/1992 |
| DE | 199 19 240 A 1 | 11/1999 |
| EP | 0 402 959 A2 | 12/1990 |
| EP | 0 802 327 A1 | 10/1997 |
| EP | 0 828 077 A1 | 11/1998 |
| FR | 2 526 853 | 3/1983 |
| WO | 94/21889 | 9/1994 |

*Primary Examiner*—Frank Tsay
(74) *Attorney, Agent, or Firm*—Blake, Cassels & Graydon LLP

(57) ABSTRACT

A well production apparatus includes a down-hole gear pump and a transport assembly to which the gear pump is attached. The transport assembly is formed from a string of modular pipe assemblies having one or more passages for carrying production fluid from the bottom of the well to the surface. The passages can be arranged in a side-by-side configuration, and include pressure and return lines for driving the gear pump. The gear pump includes a hydraulically driven motor that is ganged with a positive displacement gear set. Both the motor and the pumping section have ceramic wear surfaces, the ceramic being chosen to have coefficients of thermal expansion corresponding to the coefficients of thermal expansion of the gear sets. The pumps and rotors have ceramic bushings rather than ball or journal bearings, and are operable under abrasive conditions.

29 Claims, 30 Drawing Sheets

UPWARD
DOWNWARD
DOWN-WARD

WELL PRODUCTION APPARATUS AND METHOD

FIELD OF INVENTION

This invention relates generally to the field of well production apparatus such as used, for example, in down-hole pumping systems in wells. It also relates to pumping apparatus and methods for use of that apparatus.

BACKGROUND OF THE INVENTION

Specific challenges arise in oil production when it is desired to extract heavy, sandy, gaseous or corrosive high temperature oil and water slurries from underground wells. These slurries to be pumped range over the breadth of fluid rheology from highly viscous, heavy, cold crude to hot thermal fluids. Recent technological advances have permitted wells to be sunk vertically, and then to continue horizontally into an oil producing zone. Thus wells can be drilled vertically, on a slant, or horizontally. To date, although equipment is available to drill these wells, at present there is a need for a relatively efficient, and reasonably economical means to extract slurries from wells of these types.

In particular, it would be desirable to have a type of pump that would permit relatively efficient extraction of oil slurries from underground well bores that include horizontal and steam assisted gravity drainage (SAGD) or non-thermal conventional wells. In one SAGD, process twin horizontal wells are drilled in parallel, one somewhat above the other. Steam is injected into the upper bore. This encourages oil from the adjacent region of the oil bearing formation to drain toward the lower bore. The production fluids drawn from the lower bore can then be pumped from the lower bore to the surface.

It is advantageous to match the pumping draw down of the lower bore to the rate of steam injection used in the upper bore. This will depend on the nature of the oil bearing formation, the viscosity of the oil and so on. If the rates can be matched to achieve a relative balance, the amount of steam pressure required can be reduced, thus reducing the power of the steam injection system required, and resulting in a more economical process.

Pumping the production oil or slurry from the lower horizontal bore presents a number of challenges. An artificial lift, or pumping, system must be able to operate even when the "liquid" to be pumped is rather abrasive. For example, some design criteria are based on slurries that may contain typically 3% by weight, and for short periods as much as 30% by weight, of abrasives, such as sand The pumping technology must be capable of handling a high volume of formation solids in the presence of high gas oil ratios (GOR). The system may well be called upon to handle slugs of hydrocarbon gas and steam created by flashing of water into vapour. On occasion the system may run dry for periods of time. As such, it is desirable that the system be capable of processing gases, and of running "dry". It is also desirable that a pump, and associated tubing, be able to operate to a depth of 1000 M below well-head, or more, with an allowance of 100 psi as the minimum flow-line input pressure. It is also desirable that the equipment be able to operate in chemically aggressive conditions where pH is +/−10.

Further still, it would be advantageous to be able to cope with a large range of viscosities—from thick, viscous fluids to water, and at relatively high temperatures. The chosen equipment should be operable in both vertical and horizontal well bores.

Another requirement is the ability to pump all of the available fluid from the well bore. To that end it is advantageous to be able to operate the pump as far as possible in depth into a horizontal section. The system needs to be able to operate at high volume capacities, i.e., high volumetric flow rates, and to operate reasonably well under saturated steam conditions while processing hydrocarbon gases. As far as the inventors are aware, there is at present no artificial lifting equipment that addresses these problems in a fully satisfactory manner. It would be desirable to have a relatively efficient high temperature, high volume pumping system that can accommodate a large range of production requirements, with the capability of being installed into, and operating from, the horizontal section of a well bore.

Other artificial lift systems have been tried. For example, one known type of pump is referred to as a "Pump Jack". It employs sucker rod pumping with a down-hole plunger pump. This is a reciprocating beam pumping system that includes a surface unit (a gearbox, Pittman arms, a walking beam, a horsehead and a bridle) that causes a rod string to reciprocate, thereby driving a down-hole plunger pump.

Pump jack systems have a number of disadvantages. First, it is difficult to operate a down-hole reciprocating rod pump in a horizontal section because of the reliance on gravity to exert a downward force on the pump plunger. Further, a horizontal application may tend to cause increased pump wear due to curvature in the pump barrel (to get to the horizontal section) and increased sucker rod and tubing wear. Second, down-hole pumps are susceptible to damage from sand, high temperature operation, and other contaminants. Third, plunger pumps are prone to gas lock. Fourth, the downward stroke of the pump rod, being governed by gravity, is subject to "rod float". That is, as the length of the rod increases, the rod itself has sufficient resiliency, and play, that the motion transmitted from the surface is not accurately copied at the plunger—it may be out of phase, damped, or otherwise degraded so that much pumping effort is wasted. Fifth, pump jacks tend to require relatively extensive surface site preparation. Horizontal units tend to require larger than normal pump units because of the need to activate (i.e., operate) the rod string around the bend of the "build section" as well as to lift the weight of the rod string.

Another type of pump is the progressive cavity pump, or screw pump. In this type of pump a single helical rotor, usually a hard chrome screw, rotates within a double helical synthetic stator that is bonded within a steel tube. Progressive cavity pumps also have disadvantages: First, they tend not to operate well, if at all, at high temperatures. It appears that the maximum temperature for continuous operation in a well bore is about 180 F. (80 C.). It is desirable that the pump be able to operate over a range of −30 to 350 C. (−20 to 650 F.), and that the pump be able to remain in place during steam injection. Second, progressive cavity pumps tend not to operate well "dry". It is desirable to be able to purge hydrocarbon gases, or steam created by flashing water into vapour. As far as the present inventors are aware, progressive cavity pumps have not been capable of operation in high GOR conditions. Further, the synthetic stator material of some known pumps appears not to be suitable for operation with aromatic oils. Due to the design of the screws, and their friction fit, progressive cavity pumps tend to have little, if any, ability to generate high pressures, thereby restricting their use to relatively shallow wells. In addition, progressive cavity pumps tend to be prone to wear between the rotor and the stator, and tend to have relatively short service run lives between overhauls. Progressive cavity pumps do not appear to provide high operational efficiency.

Electric submersible pumps (ESP) include a down-hole electric motor that rotates an impeller (or impellers) in the pump, thereby generating pressure to urge the fluid up the tubing to the surface. Electric submersible pumps tend to operate at high rotational speeds, and tend to be adversely affected by inflow viscosity limitations. They tend not to be suitable for use in heavy oil applications. Electric submersible pumps tend to be susceptible to contaminants. Electric submersible pumps are not, as far as the inventors are aware, positive displacement pumps, and consequently are subject to slippage and a corresponding decrease in efficiency. The use of electric submersible pumps is limited by horsepower and temperature restrictions.

Jet pumps typically employ a high pressure surface pump to transmit pumping fluid down-hole. A down-hole jet pump is driven by this high pressure fluid. The power fluid and the produced fluid flow together to the surface after passing through the downhole unit. Jet pumps tend to have rather lower efficiency than a positive displacement pump. Jet pumps tend to require higher intake pressures than conventional pumps to avoid cavitation. Jet pumps tend to be sensitive to changes in intake and discharge pressure. Changes in fluid density and viscosity during operation affect the pressures, thereby tending to make control of the pump difficult. Finally, jet pump nozzles tend to be susceptible to wear in abrasive applications.

Gas lift systems are artificial lift processes in which pressurised or compressed gas is injected through gas lift mandrels and valves into the production string. This injected gas lowers the hydrostatic pressure in the production string, thus establishing the required pressure differential between the reservoir and the well-bore, thereby permitting formation fluids to flow to the surface. Gas lift systems tend to have lower efficiencies than positive displacement pumps. They tend be uncontrollable, or poorly controllable, under varying well conditions, and tend not to operate effectively in relatively shallow wells. Gas lift systems only have effect on the hydrostatic head in the vertical bore, and may tend not to establish the required drawdown in the horizontal bore to be beneficial in SAGD application. Further, gas lift systems tend to be susceptible to gas hydrate problems. The surface installation of a gas lift system may tend to require a significant investment in infrastructure—a source of high pressure gas, separation and dehydration facilities, and gas distribution and control systems. Finally, gas lift systems tend not to be capable of achieving low bottom-hole producing pressures.

Operation of a pump at a remote location in a bore hole also imposes a number of technical challenges. First, the pump itself can not be larger in diameter than the well bore. In oil and gas well drilling, for example, it can only be as large as permitted by the well-head blow-out preventer. A typical casing may have a diameter of 140 to 178 mm (5½ to 7 inches). A typical production tube has a diameter in the range of 73 to 89 mm (2¾ to 3½ inches). Providing power to a down-hole pump is also a challenge. An electric motor may burn out easily, and it may be difficult to supply with electrical power at, for example, ten thousand feet (3000 m) distance along a bore given significant line losses. A pneumatic or hydraulic pump can be used, provided an appropriate flow of working fluid is available under pressure. Whatever type of pump is used, it may tend to need to be matched in a combination with the available power delivery system.

In a number of applications, such as oil or other wells, it is desirable to conduct one or more types of fluid down a long tube, or string of tubing, while conducting another flow, or flows, in the opposite direction. Similarly, it may be advantageous to use a passageway, or a pair of passageways to conduct one kind of fluid, and another passageway for electrical cabling whether for monitoring devices or for some other purpose, or another pair of passageways for either pneumatic or hydraulic power transmission. In oil field operations it may be desirable to have a pair of passageways as pressure and return lines for hydraulic power, another line, or lines, for conveying production fluids to the surface, perhaps another line for supplying steam, and perhaps another line for carrying monitoring or communications cabling.

One method of achieving this end is to use concentrically nested pipes, the central pipe having a flow in one direction, the annulus between the central pipe and the next pipe carrying another flow, typically in the opposite direction. It may be possible to have additional annulli carrying yet other flows, and so on. Although singular continuous coiled tubing has been used, the ability to run an inner string within an outer concentric string is relatively new, and may tend to be relatively expensive. This has a number of disadvantages, particularly in well drilling. Typically, in well drilling the outside diameter of the pipe is limited by the size of the well bore to be drilled. This pipe size is all the more limited if the drilling is to penetrate into pockets of liquid or gas that are under pressure. In such instances a blow-out preventer (BOP) is used, limiting the outside diameter of the pipe. Typically, a drill string is assembled by adding modules, or sections of pipe, together to form a string. Each section is termed a "joint". A joint has a connection means at each end. For example, one end (typically the down-hole end) may have a male coupling, such as an external thread, while the opposite, well-head, end has a matching female coupling, such as a union nut. It is advantageous in this instance to have a positive make-up, that is, to be able to join the "joints" without having to spin the entire body of the joint, but rather to have the coupling rotate independently of the pipe.

A limit on the outside diameter of the external pipe casing imposes inherent limitations on the cross-sectional area available for use as passageways for fluids. In some instances three or four passages are required. For example, this is the case when a motive fluid, whether hydraulic oil or water, is used to drive a motor or pump, requiring pressure and return lines, while the production fluid being pumped out requires one or more passages. The annulus width for four passages nested in a 3.5 inch tube is relatively small. The inventors are unaware of any triple or quadruple concentric tube string that has been used successfully in field operations.

As the depth of the well increases, the downhole pressure drop in the passages also increases. In some cases the well depth is measured in thousands of metres. The pressure required to force a slurry, for example, up an annular tube several kilometres long, may tend to be significant. One way to reduce the pressure drop is to improve the shape of the passages. For example, in the limit as an annulus becomes thin relative to its diameter, the hydraulic diameter of the resultant passage approaches twice the width, or thickness, of the annulus. For a given volumetric flow rate, at high Reynolds numbers pipe losses due to fluid friction vary roughly as the fourth power of diameter. Hence it is advantageous to increase the hydraulic diameter of the various passageways. One way to increase the hydraulic diameter of the passage is to bundle a number of tubes, or pipes, in a side-by-side configuration within an external retainer or casing in place of nested annulli. The overall cross-sectional area can also be improved by dividing the circular area into non-circular sectors, such as passages that have the cross-section shape of a portion of a pie.

Another important design consideration in constructing a pipe for deep well drilling, or well drilling under pressure, is that the conduit used be suitable for operation in a blow out preventer. This means that the pipe must be provided in sections, or joints, that can be assembled progressively in the blow out preventer to create, eventually, a complete string thousands, or tens of thousands, of feet long. It is important that the sections fit together in a unique manner, so that the various passages align themselves—it would not do for an hydraulic oil power supply conduit of one section to be lined up with the production fluid upward flow line of an adjacent section. Further, given the pressures involved, not only must the passage walls in each section be adequate for the operational pressure to which they are exposed, but the sections of pipe must have a positive seal to each other as they are assembled. Further still, given the relatively remote locations at which these assemblies may be used, and possibly harsh environmental conditions, the sections must go together relatively easily. It is advantageous to have a "user friendly" assembly for ease of pick-up, handling, and installation, that can be used in a conventional oil rig, for example.

Some of the tube passages must be formed in a manner to contain significant pressure. For an actual operating differential pressure in the range of 0–2000 p.s.i., it may be desirable to use pipe that can accommodate pressures up to, for example, 8,000 p.s.i. Seamless steel pipe can be obtained that is satisfactory for this purpose. Electrical resistance welded pipe (ERW) that is suitable for this purpose can also be obtained. The steel pipe can then be roll formed to the desired cross-sectional shape.

SUMMARY OF THE INVENTION

In an aspect of the invention there is a fluid displacement assembly having a first gear, a second gear, and a housing having a chamber defined therein to accommodate the gears. The first and second gears are mounted within the housing in meshing relationship. The housing has an inlet by which fluid can flow to the gears and an outlet by which fluid can flow away from the gears. The gears are operable to urge fluid from the inlet to the outlet, and at least a portion of the housing is made from a ceramic material.

In an additional feature of that aspect of the invention, the assembly is operable at temperatures in excess of 180° F. In another additional feature, the assembly is operable at temperatures at least as high as 350° F. In another additional feature, the ceramic material is part of a ceramic member, and is mounted within a casing. In still another feature, the ceramic material has a compressive pre-load.

In yet another feature the first and second gears are spur gears. In an alternative feature, the first gear is a spur gear and the second gear is a ring gear mounted eccentrically about the first gear. In a further feature, a ceramic partition member is mounted within the ring gear between the first gear and the second gear. In a further alternative feature, the first and second gears are a pair of gerotor gears.

In a further additional feature of the invention, the gears are sandwiched between a pair of first and second yokes mounted to either axial sides thereof Each of the yokes has a pair of first and second bores formed therein to accommodate first and second shafts. Each of the yokes has a gear engagement face located next to the gears. Each of the gear engagement faces has a peripheral margin conforming to the arcuate portions of the internal wall of the housing, and each of the yokes is biased to lie against the gears.

In another aspect of the invention there is a gear pump having a first gear, a second gear, and a housing having a chamber defined therein to accommodate the gears. The first gear is mounted on a shaft having an axis of rotation. The first and second gears are mounted in the housing in meshing engagement. The housing has an inlet by which fluid can flow to the gears and an outlet by which fluid can flow away from the gears, and the shaft is mounted in ceramic bushings within the housing. In another feature of that aspect of the invention, the ceramic bushings include ceramic inserts mounted in a metal body.

In a further aspect of the invention there is a gear pump having a first gear, a second gear, and a housing having a cavity defined therein to accommodate the first and second gears. The first and second gears are mounted in meshing relationship within the housing. The housing has an inlet by which fluid can flow to the gears and an outlet by which fluid can flow away from the gears. The gears are operable to displace fluid from the inlet to the outlet. The first gear is mounted on a first shift having a first axis of rotation. The first and second gears each have a first end face lying in a first plane perpendicular to the axis of rotation. A moveable wall is mounted within the housing to engage the first end faces of the gears. The moveable wall has a ceramic surface oriented to bear against the first end faces of the first and second gears.

In an additional feature of that aspect of the invention, the moveable wall is a head of a piston and, in operation, the piston is biased toward the first end faces of the first and second gears. In another feature, the piston is hydraulically biased toward the gears. In another feature, each of the first and second gears has a second end face lying in a second plane spaced from the first plane, and a second moveable wall is mounted within the housing to bear against the second end faces of the first and second gears. In another feature, both of the moveable walls are biased toward the gears. In another additional feature, the end walls are heads of respective first and second pistons, the pistons being moveable parallel to the axis of rotation. In a further additional feature, the ceramic surface is a plasma carried on a metal substrate.

In another additional feature, the second gear is mounted on a second shaft extending parallel to the first shaft. The ceramic surface is formed on a body having a first bore defined therein to accommodate the first shaft and a second bore defined therein to accommodate the second shaft, the body being displaceable along the shafts. In a further feature, at least one of the bores has a wall presenting a ceramic bushing surface to one of the shafts. In another feature the body has a passageway formed therein to facilitate flow of fluid. In a further feature, the body has passageways formed therein to facilitate flow of fluid to and from the inlet and the outlet.

In still another aspect of the invention, there is a gear pump assembly having a pair of first and second mating gears, mounted on respective first and second parallel shafts in meshed relationship; and a housing for the gears, the housing having an inlet by which fluid can flow to the gears and an outlet by which fluid can flow away from the gears. The gears are operable to urge fluid from the inlet to the outlet. The housing includes a gear surround having two overlapping bores defined therein conforming to the gears in meshed relationship, and the surround presents a ceramic internal surface to the gears.

In an additional feature the surround is formed of a transformation toughened zirconia. In a further feature, the surround is made of a ceramic monolith. In another feature, the surround has a compressive pre-load. In a still further feature, the surround is mounted within a shrink fit casing member. In yet another feature, the ceramic monolith has a co-efficient of thermal expansion corresponding to the co-efficient of thermal expansion of the gears. In another additional feature, the gear pump assembly has a movable endwall mounted to ride in the overlapping bores.

In another additional feature, the shafts each have an axis of rotation and the gears each have first and second end faces lying in first and second spaced apart parallel planes, the parallel planes extending perpendicular to said axis. A movable piston is mounted to ride within the overlapping bores, and the piston has a face oriented to engage the first end faces of the gears.

In another aspect of the invention, there is a gear pump assembly having a first gear mounted on a first shaft, the first shaft having a first axis of rotation; and a second gear mounted on a second shaft, the second shaft having a second axis of rotation, the axes lying in a common plane. The first and second gears are mounted to mesh together in a first region between the axes. A gear surround has an internal wall defining a cavity shaped to accommodate the gears. The internal wall has a first portion formed on an arc conforming to the first gear and a second portion, formed on another arc, to conform to the second gear. The first and second portions lie away from the first region. The internal wall has a third portion between the first and second portions. The third portion lies abreast of the first region and has a first passageway formed therein to carry fluid to the cavity adjacent to the gears to one side of the plane. The internal wall has a fourth portion lying between the first and second portions. The fourth portion lies abreast of the first region to the other side of the plane from the third portion. The fourth portion has a second passageway formed therein to carry fluid from the cavity. The gears are operable to transfer fluid from the first passageway to the second passageway.

In an aspect of the invention, there is a modular well pipe assembly. There is a pipe wall structure having at least first and second passages defined side-by-side therein. The pipe wall structure has a first end and a second end. The first and second ends have respective first and second end couplings matable with other end couplings of modular pipe assemblies of the same type. The end fittings have alignment fittings for aligning the first and second passages with corresponding first and second passages in other modular pipe assemblies of the same type.

In an additional feature of that aspect of the invention, the pipe wall structure includes a hollow outer casing and at least first and second conduits for carrying fluids mounted side-by-side within the casing. In another additional feature of that aspect of the invention, one of the end couplings has a seal mounted thereto. The seal has porting defined therein corresponding to the passages. The seal is placed to maintain segregation between the passages when the modular pipe assembly is joined to another modular pipe assembly of the same type. In yet another additional feature, the end coupling is engageable with a mating modular pipe assembly to compress the seal.

In still another additional feature, the pipe wall structure includes a first conduit member and a second conduit member mounted within the first conduit member. The first conduit member has a continuous wall. The continuous wall has an inner surface defining a periphery of an internal space. The second conduit member occupies a first portion of the internal space of the first conduit member and leaves a remainder of the internal space of the first conduit member. The second conduit member has a continuous wall. The continuous wall of the second conduit member has the second side by side passage defined therewithin.

The continuous wall of the second conduit has an external surface. A portion of the external surface of the second conduit member is formed to conform to a first portion of the inner surface of the first conduit member, and is located there adjacent. The first passage is defined within the remainder of the internal space of the first conduit member. In still yet another additional feature, the inner surface of the first conduit member has a second portion bounding a portion of the first passage.

In another additional feature of that aspect of the invention, the inner surface of the first conduit member has a second portion. The external surface of the second conduit member has a second portion. The second portion of the inner surface of the first conduit member and the second portion of the external surface of the second conduit member co-operate to bound at least a portion of the first passageway. In yet another additional feature of that aspect of the invention, the first conduit member has a round cylindrical cross-section. The second conduit member continuous wall has a portion lying along a first chord of the cylindrical cross-section. In still another additional feature, the chord is a diametrical chord. In another additional feature, the second conduit member has another portion lying along a second chord of the cylindrical cross-section. In a further additional feature of that aspect of the invention, the second conduit member occupies a sector of the cylindrical cross-section between the first and second chords.

In yet a further additional feature, the pipe wall structure includes a third conduit member. The third conduit member has a continuous wall having a third side-by-side passage defined therewithin. The third conduit member has an external surface. A portion of the external surface is shaped to conform to, and is located adjacent to a second portion of the inner surface of the first conduit member.

In still a further additional feature, the pipe wall structure includes a third conduit member. The third conduit member has a continuous wall having a third side-by-side passage defined therewithin. The second conduit member has an internal wall surface. The third conduit member continuous wall has an external surface. A portion of the external surface of the third conduit member is shaped to conform to, and is mounted against, a portion of the internal wall surface of the second conduit member.

In another additional feature of that aspect of the invention, the pipe wall structure includes a first conduit member, a second conduit member, and a third conduit member. The second and third conduit members are mounted side-by-side within the first conduit member. In yet another additional feature, the second conduit member has a circular cross-section. In still another additional feature, the second and third conduit members have circular cross-sections. In a further additional feature, a fourth conduit member is mounted within the first conduit member. In still a further additional feature, the first conduit member has a circular internal wall surface. The second, third and fourth conduit members have circular cross sections and are mounted in tangential engagement with the circular internal wall surface of the first conduit member. In another additional feature of that aspect of the invention, each of the second, third and fourth conduit members is tangent to at least one of the others. In still another additional feature, at least one of the second and third conduit members is hexagonal in cross-section.

In yet another additional feature, at least one of the second and third conduit members is pie shaped in cross-section. In a further feature of that aspect of the invention, the pie shape is chosen from the set of pie shapes consisting of (a) a half of a pie; (b) a third of a pie; (c) a quarter of a pie; and (d) a sixth of a pie.

In another feature of that aspect of the invention, the pipe wall structure includes a first conduit member and a second conduit member mounted within the first conduit member. The second conduit member has a continuous wall bounding the second passage. The second passage has a periphery and a cross-sectional area. The second conduit member continuous wall has an internal surface defining the periphery of the second passage. The second passage has a hydraulic diameter that is less than the dividend obtained by dividing the perimeter by $\pi$. In another additional feature, the second conduit member is free of convex portions.

In another additional feature of that aspect of the invention, the pipe wall structure includes a first conduit member and a second conduit member mounted within the first conduit member. The second passage has a perimeter 'P', a cross-sectional area A and a hydraulic diameter $D_H$. The second conduit member has a continuous wall having an inside surface defining the perimeter 'P' of the second passage and $A<(P^2/4\pi)$. In still another additional feature, the second conduit member is free of convex portions.

In yet another additional feature, the pipe wall structure includes a first, outer, conduit member having an inner wall surface and a second, inner, conduit member mounted within the first conduit member. The inner conduit member has an outer wall surface. The inner wall surface of the outer conduit member and the outer wall surface of the inner conduit member bound a region intermediate the outer conduit member and the inner conduit member. A third conduit member defines a third passage therewithin in side-by-side relationship to the second passage. The third conduit member is located in the region intermediate the inner wall surface of the outer conduit member and the outer wall surface of the inner conduit member.

In another additional feature of that aspect of the invention, the third conduit member has an outer wall surface. The outer wall surface of the third conduit member has a first portion engaging the inner wall surface of the outer conduit member and a second portion engaging the outer wall surface of the inner conduit member. In still another additional feature, the first portion of the third conduit member is shaped to conform to a portion of the inner wall surface of the outer conduit member. The second portion of the third conduit member is shaped to conform to a portion of the outer wall surface of the inner conduit member. In yet another additional feature, the region between the outer and inner conduits is annular. In another additional feature, the inner conduit member is concentric to the outer conduit member. In yet another additional feature, an annulus is defined between the inner and outer conduit members and the third conduit member occupies a sector of the annulus. In another additional feature of that aspect of the invention, a plurality of conduit members each occupy sectors of the annulus.

In a further aspect of the invention, there is a fluid displacement apparatus having (a) a motor unit having a first gearset having an output shaft, the output shaft having an axis of rotation defining an axial direction; an inlet by which fluid can flow to the first gearset, and an outlet by which fluid can flow away from the first gearset; (b) a gear pump unit mounted axially with respect to the motor unit, the pump unit having a second gearset connected to be driven by the output shaft of the first gearset; an inlet by which production fluid can be flow to the second gearset; and an outlet by which the production fluid can flow away from the second gearset; and (c) a transport apparatus having a first end and a second end, the second end being connected axially relative to the motor unit and the pump unit. The transport apparatus has a first passageway defined therein in fluid communication with the inlet of the motor unit by which fluid under pressure can be directed to the first gearset to turn the output shaft; and at least a second passageway defined therein in fluid communication with the outlet of the pump unit by which the production fluid from the second gearset can be conveyed to the first end of the transport apparatus.

In an additional feature of that aspect of the invention, the apparatus includes a plurality of the motor units connected axially together to drive the output shaft. In another additional feature, the apparatus includes a plurality of the gear pump units connected axially together.

In another additional feature, the transport apparatus has at least a third passageway defined therein. The third passageway is in fluid communication with the outlet of the first gearset to permit return fluid from the first gearset to be carried to the first end of the transport apparatus. In still another feature, the transport apparatus has another passageway defined therein by which electrical cabling can extend between the first and second ends.

In still another feature, the first and second passageways extend in side-by-side relationship. In a further feature, the transport apparatus includes a bundle of conduits defining the passageways, the bundle being mounted within a retainer. In yet another feature, the transport apparatus includes a plurality of modular pipe joints connected together in a pipe string. In another feature, the gear pump unit is free of ball and roller bearings.

In still another feature, the motor unit is mounted in a cylindrical housing, the housing having a production fluid passageway defined therein, the production fluid passageway being in fluid communication with the outlet of the second gearset and with the second passageway of the transport apparatus to permit production fluid from the gear pump to flow in the axial direction past the motor unit. In a further feature, the gear pump unit is mounted in a cylindrical housing, the cylindrical housing having porting defined therein to permit production fluid to flow to the inlet of the gear pump unit.

In a further feature of that aspect of the invention, the fluid displacement apparatus includes a plurality of the motor units mounted axially together and a plurality of the gear pump units mounted axially together. Each of the motor units has an axially extending pressure passage defined therein communicating with the inlet thereof, and an axially extending return passage defined therein communicating with the outlet thereof. The pressure passages of the motor units are in fluid communication to form a common high pressure passageway. The return passages of the motor units are in fluid communication to form a common low pressure passageway; and a plate is mounted between the motor units and the gear pump units to close off the high pressure and low pressure passages from the pump units.

In still another aspect of the invention, there is a well production apparatus for transporting a production fluid from a downhole portion of a well to a wellhead. The apparatus includes a transport assembly having a first end located in the downhole portion of the well and a second end located at the wellhead. A gear pump is connected to the first end of the transport assembly. The transport assembly has at least one passageway defined therein for conducting production fluid from the first end to the second end. The transport assembly has a power transmission member that extends between the first and second ends thereof The transmission member is connected to permit the gear pump to be driven from the wellhead. The gear pump is operable to urge production fluid from the first end of the transport assembly to the wellhead.

In another aspect of the invention, there is. a method of moving production fluid from a well to a wellhead. The method includes the steps of (a) mounting a gear pump to a first end of a transport apparatus; (b) introducing the first end of the transport apparatus into the well and locating the gear pump in the well; and (c) driving the gear pump from outside the well to urge production fluid from the production region to the wellhead.

In an additional feature of that aspect of the invention, the method includes the steps of providing a passageway in the transport apparatus for carrying production fluid from the production region to the wellhead; and providing a power transmission member to carry power for the wellhead to the gear pump. In still another feature of the invention, the method includes the steps of: (a) mounting an hydraulic motor to the gear pump; (b) providing a first passageway in the transport apparatus for carrying production fluid from the production region to the wellhead; (c) providing a second passageway in the transport apparatus for carrying hydraulic fluid to the hydraulic motor; and (d) supplying hydraulic fluid under pressure through the second passageway to operate the hydraulic motor and the gear pump. In a further additional feature, the method includes the step of providing a third passageway in the transport apparatus and directing a return flow of hydraulic fluid from the hydraulic motor through the third passageway to the wellhead.

In another additional feature, the method includes the steps of preparing a well bore having a horizontal production region, and introducing the gear pump into the horizontal production region. In another feature, the method includes the steps of: (a) preparing a horizontal production region of the well; (b) preparing a well bore above the horizontal production region; (c) introducing steam into the well bore, and (d) the step of driving the gear pump follows the step of introducing the steam into the well bore. In still another additional feature, the transport apparatus is a modular pipe joint apparatus and the method includes the step of incrementally introducing one pipe joint after another into the well. In another additional feature, the step of introducing includes passing the gear pump and the pipe joints through a well head blow out preventer.

These and other aspects and features of the invention are described herein with reference to the accompanying illustrations.

DETAILED DESCRIPTION OF THE INVENTION

Figure 1A:
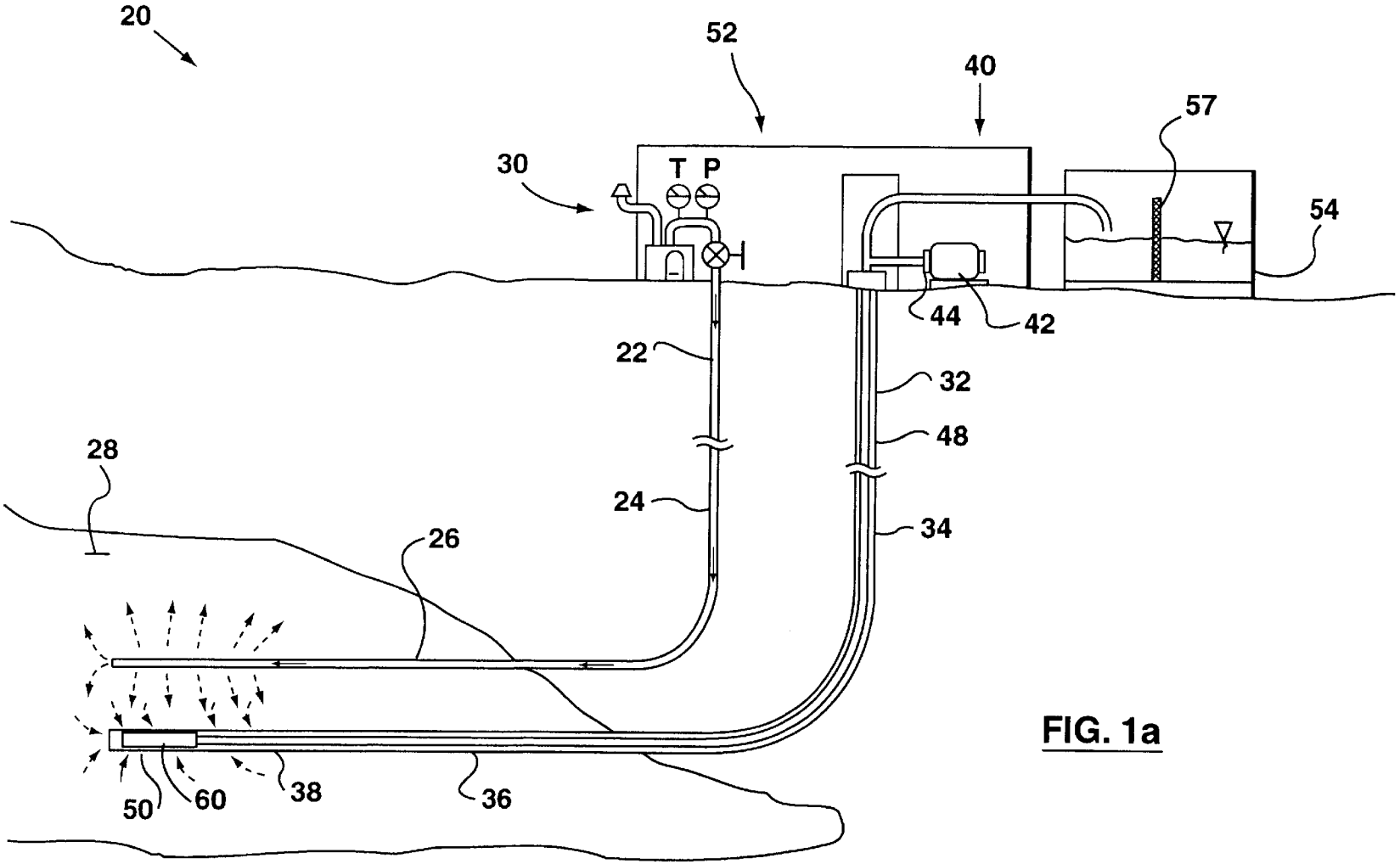
FIG. 1*a* shows a general schematic illustration of a steam assisted gravity drainage oil production system having a down-hole production unit.

The description which follows, and the embodiments described therein, are provided by way of illustration of an example, or examples of particular embodiments of the principles of the present invention. These examples are provided for the purposes of explanation, and not of limitation, of those principles and of the invention. In the description which follows, like parts are marked throughout the specification and the drawings with the same respective reference numerals. The drawings are not necessarily to scale and in some instances proportions may have been exaggerated in order more clearly to depict certain features of the invention.

By way of a general overview, an oil extraction process apparatus is indicated generally in FIG. 1*a* as 20. It includes a first bore 22 having a vertical portion 24 and a horizontal portion 26. Horizontal portion 26 extends into an oil bearing formation 28 at some distance below the surface. For the purposes of illustration, the vertical scale of FIG. 1*a* is distorted. The actual depth to horizontal portion 26 may be several kilometres. A steam generating system 30 is located at the well head and is used to inject steam at temperature T and pressure R down bore 22. Horizontal portion 26 is perforated to permit the steam to penetrate the adjacent regions of formation 28.

A second well bore is indicated as 32. It has a vertical portion 34 and a horizontal portion 36, corresponding generally to vertical portion 24 and horizontal portion 26 of bore 22. Horizontal portion 36 runs generally parallel to, and somewhat below, horizontal portion 26. A section (or sections) 38 of horizontal portion 36 runs through oil bearing formation 28, and is perforated to permit production fluid to drain from formation 28 into section 38. The injection of steam into formation 28 through portion 26 is undertaken to encourage drainage of oil from formation 28. It will be appreciated that alternative types of wells can also have analogous vertical or inclined perforated sections.

Figure 1B:
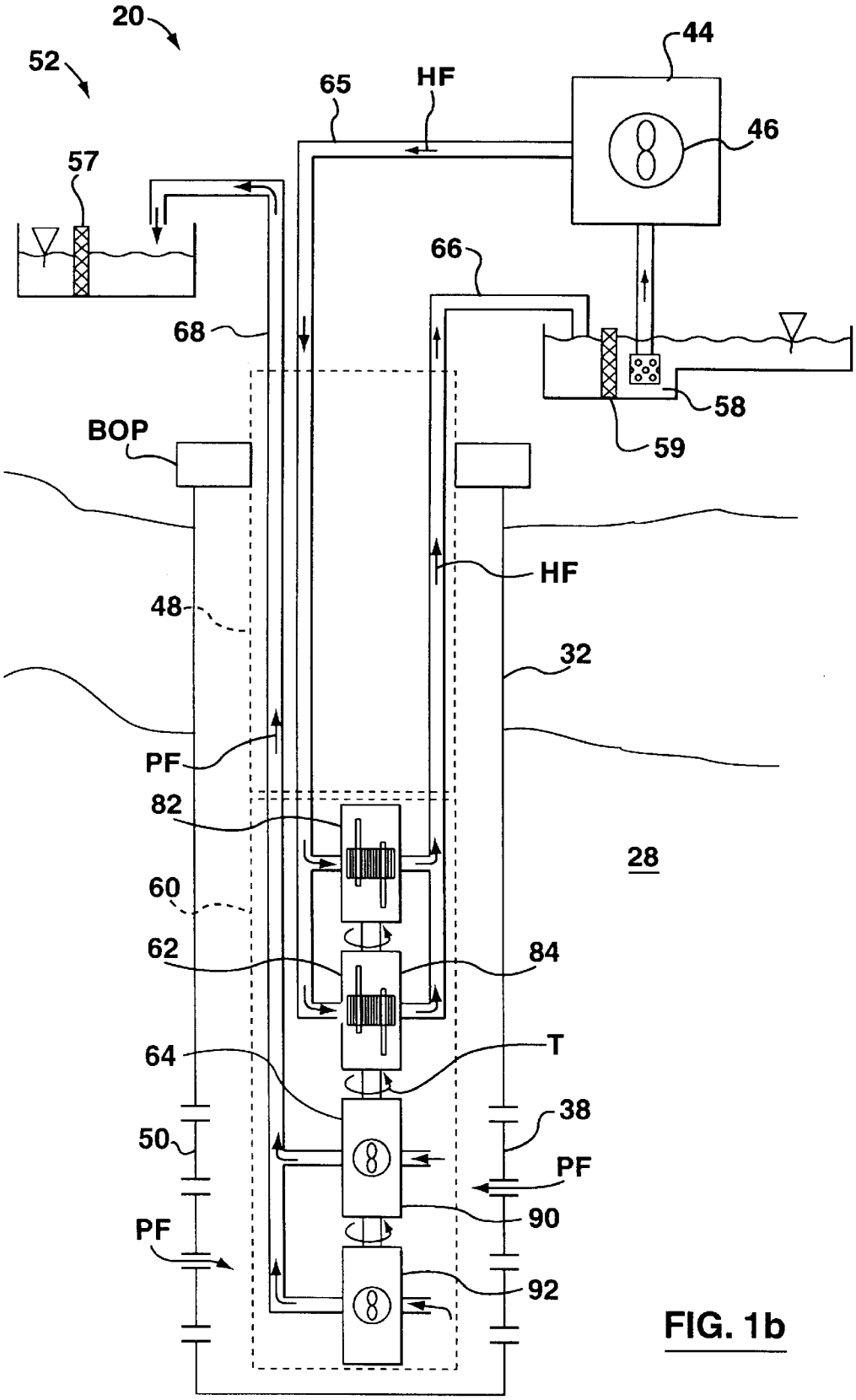
FIG. 1*b* shows a schematic illustration of the down-hole production unit of FIG. 1*a;*

A production fluid lift system in the nature of a pumping system is designated generally as 40. It is shown schematically in FIG. 1*b*. It includes a power generation system 42 at the well head, in the nature of a motor 44 that drives a hydraulic pump 46. A transport system 48 carries power transmitted from system 42 to the downhole end 50 of bore 32, and carries production fluid from downhole end 50 to the well head 52. A collection and separation system, such as a holding tank 54 is located at the well head to receive the production fluid as it exits transport system 48. A hydraulic reservoir 56 receives returned hydraulic fluid HF, and has a sump whence hydraulic fluid is again drawn into hydraulic pump 46. Respective filters are indicated as 57 and 59.

Transport system 48 terminates at a downhole production unit 60, described in greater detail below. Production unit 60 includes a power conversion unit, namely a hydraulic motor section 62, that is driven by the pressurized hydraulic fluid (such as water) carried in pressure line 65 and return line 66 by transport system 48 from and to hydraulic pump 46 to convert the transported power to a mechanical output, namely torque T in a rotating output shaft. Production unit 60 also includes a pump section 64 that is driven by hydraulic motor 62, pump section 64 being operable to urge production fluids PF to the surface by way of production fluid lift line 68 through transport system 48. A blow out preventer indicated as BOP, engages transport system 48 at well head 52 since the well pressure, and temperature, may be well above atmospheric.

Downhole production unit 60 is shown in greater detail in the illustrations of FIGS. 2*a* to 8*c*. As a note of preliminary explanation, the frame of reference for production unit 60, when deployed in production, is a well bore that can be vertical, inclined or horizontal. In the explanation that follows, whether the well is horizontal, or vertical, or inclined, references to up, or upward, mean along the bore toward the wellhead. Similarly, references to down, or downward, mean away from the well head. In a consistent manner, when the unit is being assembled into a long string at the well head, the orientation of up and down corresponds to how personnel at the well head would see the unit, or its components as they are being assembled and introduced into the well. For the purposes of operation, the local portion of the well bore occupied at any one time by production unit 60 approximates a round cylinder having a central longitudinal axis CL, defining an axial direction either up or down, with corresponding radial and circumferential directions being defined in any plane perpendicular to the axial direction.

Figures 2A, 2B, 2C, 3A, 3B:
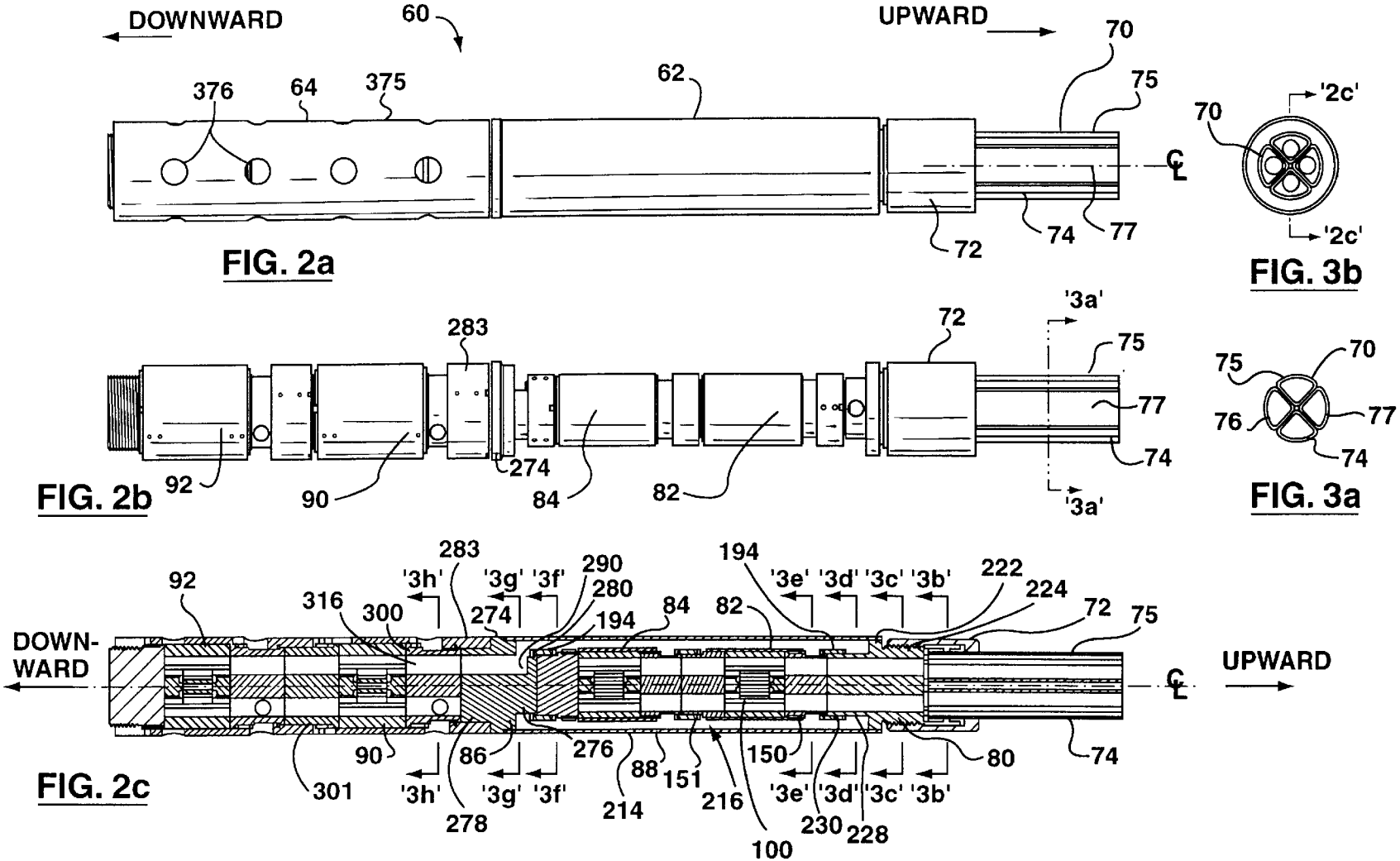
FIG. 2*a* shows a side view of the down-hole production unit of FIG. 1*a;*
FIG. 2*b* shows a side view of the down-hole production unit of FIG. 2*a* with its external casings removed.
FIG. 2*c* shows a longitudinal cross-section of the down-hole production unit of FIG. 2*a* taken on section '2*c*—2*c*' as shown on FIG. 3*b;*
FIG. 3*a* shows a cross-section taken on section '3*a*—3*a*' of FIG. 2*b;*
FIG. 3*b* shows an end view of FIG. 2*a;*

Downhole production unit 60 is shown, as assembled, in FIGS. 2*a*, 2*b* and 2*c*. Starting at the upward end, the endmost portion of transmission system 48 is shown with casing removed as 70. Portion 70 has four conduit members in a bundle that terminates at a female coupling 72. The four conduit members, identified in FIG. 3*a* as 74, 75, 76 and 77 and carry, respectively, in conduit member 74, downflowing hydraulic motor fluid (the pressure supply line 65); in conduit member 75, upflowing hydraulic motor fluid (the return line 66); and in conduits 76 and 77, pumped production fluid flowing upward, (i.e., the production fluid lift line 68 to the well head).

Female coupling 72 connects with the male end coupling of motor section 62. Motor section 62 has a first, or upward transition coupling in the nature of a motor section inlet plate 80; a first motor unit namely upper motor assembly 82; a second motor unit namely lower motor assembly 84; a second, or lower transition coupling in the nature of a motor section outlet plate 86; and an external casing 88. Pump section 64 is connected to the lower end of motor section 62. Pump section 64 has a first, or upper, pump unit namely upper pump assembly 90, and a second, or lower, pump unit namely lower pump assembly 92. The direction of the various fluid flows through these units is described more fully below.

The basic unit of construction of each of first and second motor units 84 and 86 is a positive displacement gear assembly 100, shown in detail in FIGS. 5*a* to 8*a*. Gear assembly 100 is shown in exploded view in FIG. 8*a*. First and second pump assemblies 90 and 92 employ positive displacement gear assemblies 101 which are almost identical to assembly 100 in construction but are, in the illustrated configuration, somewhat larger in diameter as shown in FIG.

20, and assemblies 101 have thicker shrink fit casings 127. For the purposes of the present description, a description of the elements of assembly 100 will serve also to describe the components of pump assemblies 101.

Figure 8A:
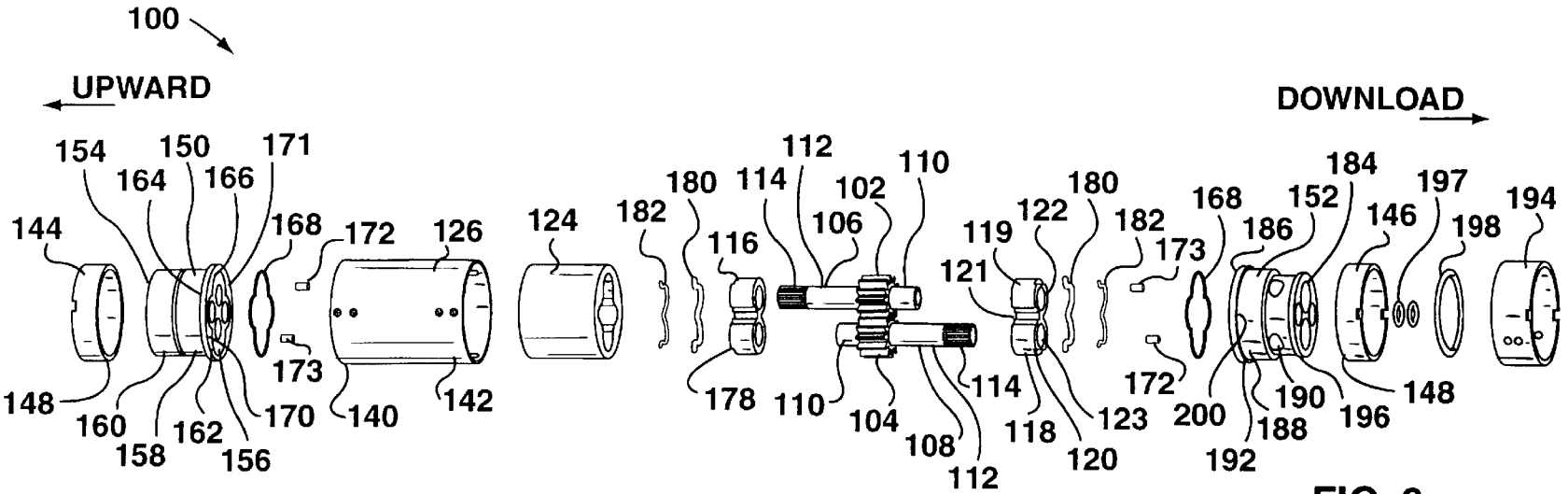
FIG. 8*a* shows an exploded view of a positive displacement gear pump assembly of the down-hole production unit of FIG. 2*a;*
Figure 8B:
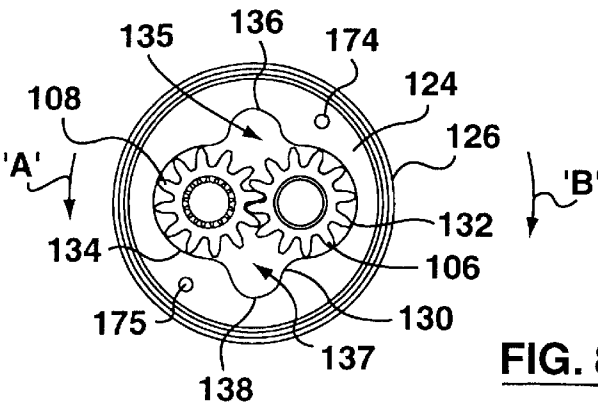
FIG. 8*b* shows an end view of the gears of the gear assembly of FIG. 8*a;*
Figure 8C:
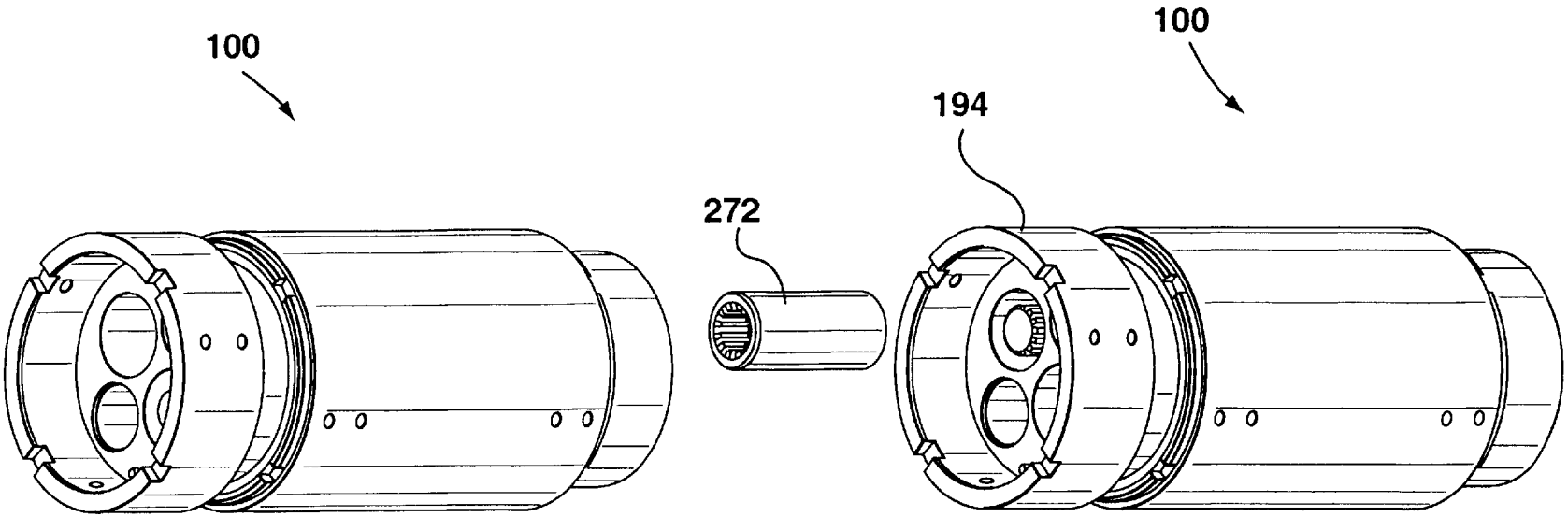
FIG. 8*c* shows an. assembled perspective view of the positive displacement gear pump of FIG. 8*a;*

As shown in FIG. 8*a*, gear assembly 100 includes a pair of matched first and second gears 102 and 104 mounted to respective stub shafts 106 and 108. Stub shafts 106 and 108 are parallel such that their axes lie in a common plane. When gears 102 and 104 engage, there is continuous line contact between mating lobes in a meshing region located between the axes of rotation of shafts 106 and 108 such that there is no clear passage between the engaging teeth. Stub shafts 106 and 108 are arranged such that gears 102 and 104 are mounted toward one end of their respective stub shafts, such that a short end 110 protrudes to one side of each gear, and a long end 112 protrudes to the other. Each long end 112 has a set of torque transmission members, in the nature of a set of splines 114 to permit torque to be received or transmitted as may be appropriate. Gears 102 and 104 are engaged such that the respective long ends of stub shafts 106 and 108 protrude to opposite sides of the matched gears, that is, one extending to in the upward axial direction, and one extending in the downward axial direction.

First and second pistons are indicated as 116 and 118. Each has a body having an eyeglass shape of first and second intersecting cylindrical lobes 119, 120 with a narrowed waist 121 inbetween. Each of the lobes has a circular cylindrical outer portion formed on a radius that closely approximates the tip radius of gears 102 and 104. Each body has a pair of parallel, first and second round cylindrical bores 122 and 123, formed in the respective first and second lobes, of a size for accommodating one or another end of stub shafts 106 and 108. The centers of the bores correspond to an appropriate centreline separation for gears 106 and 108. In the preferred embodiment of FIG. 8*a*, pistons 116 and 118 are made of steel with ceramic face plates for engaging the end faces of gears 102 and 104, and ceramic inserts that act as bushings for the respective ends of stub shafts 106 and 108.

Figure 8D:
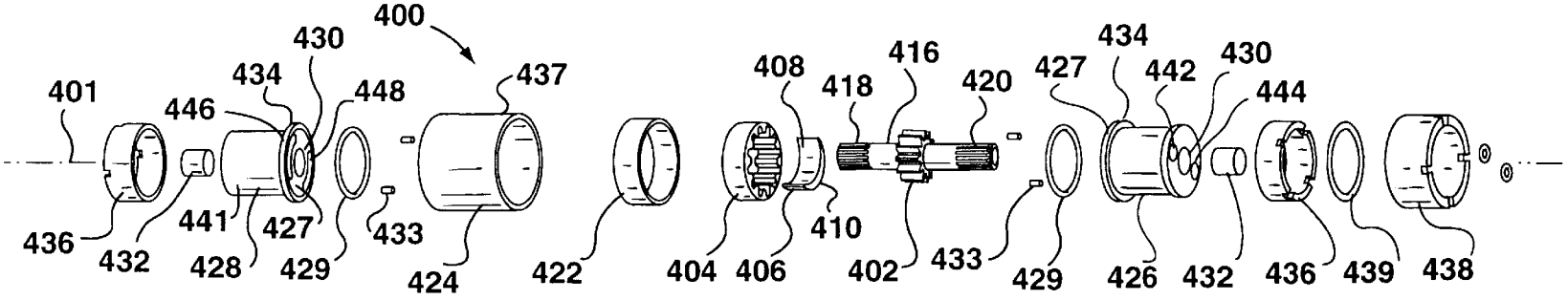
FIG. 8*d* shows an exploded view of an alternate positive displacement gear assembly to that of FIG. 8*a;*
Figure 8E:
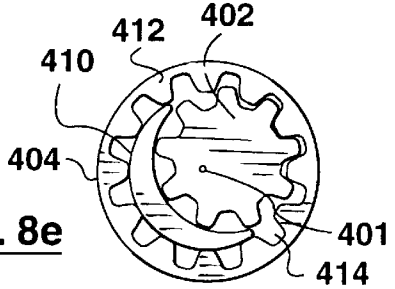
FIG. 8*e* shows an end view of the gears of the gear assembly of FIG. 8*d;*
Figure 8G:
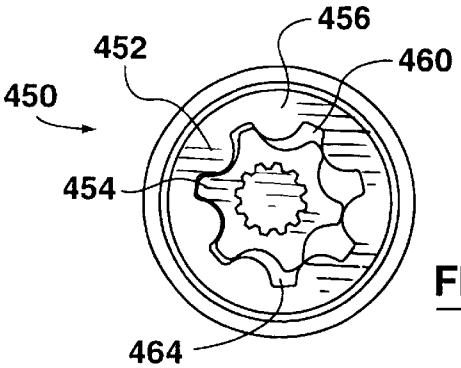
FIG. 8*g* shows an end view of the gear assembly of FIG. 8*f;*
Figure 8F:
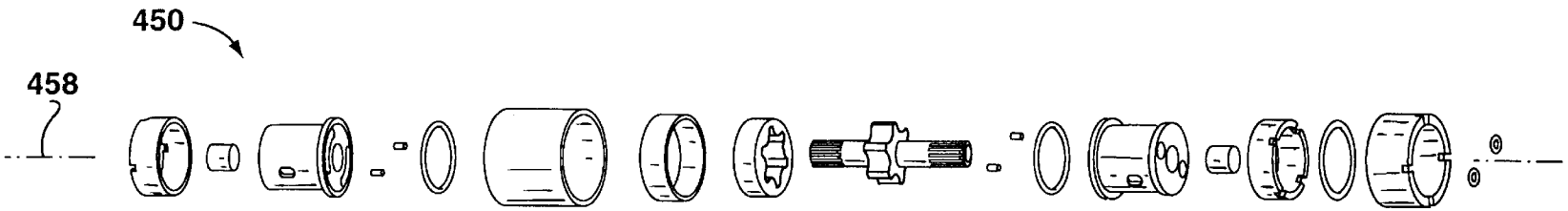
FIG. 8*f* shows an exploded view of a further alternate positive displacement gear assembly to that of FIG. 8*a;*
Figure 8H:
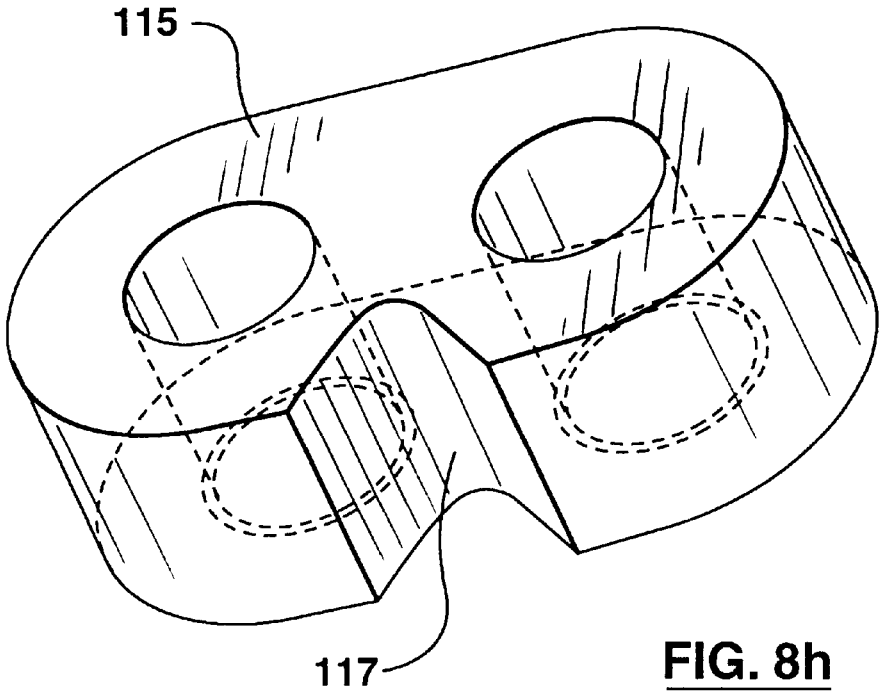
FIG. 8*h* shows a perspective view of an alternate piston for the assembly of FIG. 8*a;*
Figure 8I:
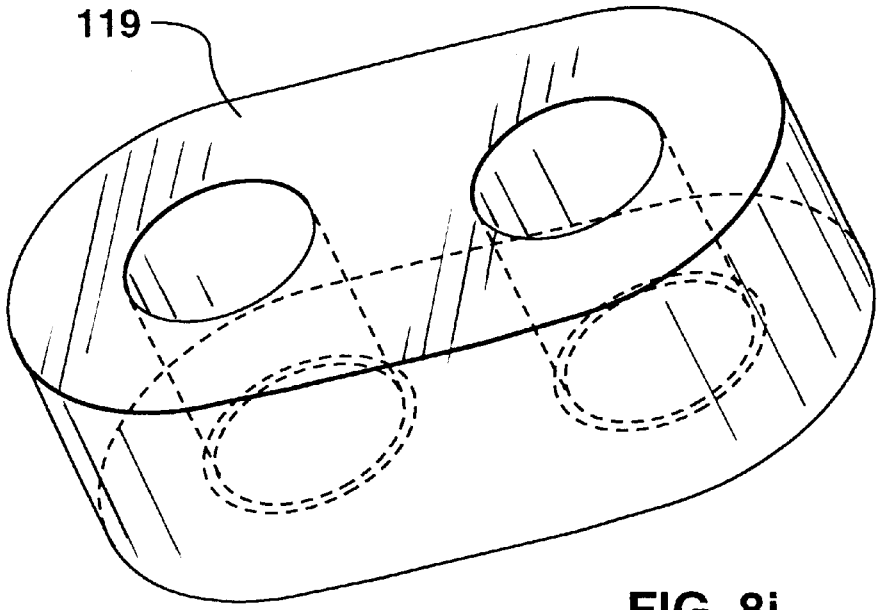
FIG. 8*i* shows a perspective view of another alternate piston for the assembly of FIG. 8*a;*

Alternative embodiments of pistons can be used, as shown in FIGS. 8*h* and 8*i*, for example. In FIG. 8*h*, an alternative piston 115 is shown having a generally ovate form with a single relief 117 to accommodate adjacent fluid flow in the axial direction. In FIG. 8*i*, a further alternative piston 119 has an ovate form lacking a relief, such that the adjacent surround member carries has the flow passage formed entirely therewithin. Although pistons 116 and 118 are made of steel, as noted above, they could also be made from a metal matrix composite material (MMC) having approximately 20–30% Silicon Carbide by volume, with Aluminum, Nickel and 5% (+/−) Graphite, with ceramic surfaces for engaging gears 102 and 104.

Gears 102 and 104, shafts 106 and 108, and pistons 116 and 118, when assembled, are carried within a surrounding member in the nature of a ceramic surround insert 124. Insert 124 has a round cylindrical outer wall and is contained within a mating external casing 126. External casing 126 is a steel shrink tube that is shrunk onto insert 124 such that casing 126 has a tensile pre-load and ceramic insert 124 has a corresponding compressive preload, such as may tend to discourage cracking of insert 124 in operation, and may tend to enhance service life. Insert 124 has an internal, axially extending cylindrical peripheral wall 130 of a lobate cross-section defining gear set cavity therewithin.

It is preferred that insert 124 be formed of a transformation toughened zirconia (TTZ) stabilized with magnesium. However, other materials can be used depending on the intended use. Other ceramics that can be used includ, but are not limited to, alumina or silicon carbide, or alternatively, a plasma coated steel. The ceramic chosen has a similar co-efficient of thermal expansion to gears 106 and 108, pistons 116 and 118 and surround shrink tube, casing 126, to be able to function at elevated temperatures. The ceramic material also tend to be relatively resistant to abrasives. The combination of high hardness, and thermal expansion similar to steel is desirable in permitting operation with abrasive production fluids at high temperatures.

Pistons 116 and 118 can be made from silicon carbide, as noted above, or reaction bonded silicon nitride, tungsten carbide or other suitable hard wearing ceramic with or without graphite for lubricity. These materials can be shrunk fit or braised to a metal surround of substrate for high temperature applications, or to a metal matrix material for low temperature applications.

Gears 102 and 104 are made from a tough material suited to high temperature and abrasive use, such as steel alloy EN30B, cast A10Q or Superimpacto (t.m.). The material can be carburized and subjected to a vanadium process for additional hardening.

Wall 130 has first and second diametrically opposed lobes 132 and 134 each having an arcuate surface formed on a constant radius (i.e., forming part of an arc of a circle), the centers of curvature in each case being the axis of rotation of stub shafts 106 and 108 respectively, and the radius corresponding to the tip radius of gears 102 and 104. As such, lobes 132 and 134 describe arcuate surface walls of a pair of overlapping bores centered on the axes of shafts 106 and 108 respectively. Pistons 116 and 118 fit closely within, and are longitudinally slidable relative to, lobes 132 and 134. Wall 130 also has a pair of first and second diametrically opposed transverse outwardly extending bulges, indicated as axial fluid flow accommodating intake and exhaust lobes 136 and 138 which define respective axially extending intake and exhaust (or inlet and outlet) passages. As shown in the cross-sectional view of FIG. 8*b*, when assembled, if the gears turn in the counter-rotating directions indicated by arrow 'A' for gear 104 and arrow 'B' for gear 102, fluid carried at the intake passage 135 defined between lobe 136 and the waist 121 of pistons 116 and 118 can occupy the cavity defined between successive teeth of gears 102 and 104, to be swept past arcuate wall lobes 132 and 134 respectively. However, as the gears mesh, the volume of the cavities between the teeth is reduced, forcing the fluid out from between the teeth and into the exhaust passage 137 defined between lobe 138 and the waist of piston 118.

Casing 126 has a longitudinal extent that is greater than insert 124, such that when insert 124 is installed roughly centrally longitudinally within casing 126, first and second end skirts 140 and 142 of casing overhang each end of insert 124 (i.e., the skirts extend proud of the end faces of insert 124). Each of skirts 140 and 142 is internally threaded to permit engagement by a retaining sleeve 144, 146. Retaining sleeves 144 and 146 are correspondingly externally threaded, having notches to facilitate tightening, and an annular shoulder 148 that bears against whichever type of end plate adapter may be used. In the example of FIG. 8*a*, a first end flow adapter fitting, or end plate, is indicated as end plate 150, and a second end flow adapter fitting, or second end plate, is indicated as 152. The internal features of plates 150 and 152 are described more fully below.

End plate 150 has a first end face 154, facing away from gears 102 and 104 and a second end face 156 facing toward gears 102 and 104. Externally, end plate 150 has a round cylindrical body having a smooth medial portion 158, a first end portion 160 next to end face 154, and a second end portion in the nature of a flange 162 next to second end face 156. Portion 160 is of somewhat smaller diameter than portion 158, and is externally threaded to permit mating engagement with, in general, a union nut of a next adjacent pump or motor section. Flange 162 has a circumferential shoulder 164 lying in a radial plane, such that when retaining ring 144 is tightened within casing 124, shoulder 148 of retaining ring 144 bears against shoulder 164, thus drawing end plate 150 toward gears 102 and 104.

Second end face 156 of plate 150 has a seal groove 166 into which a static seal 168 seats. Seal 168 is of a size and shape to circumscribe the entire lobate periphery of internal peripheral wall 130 of insert 124. Face 156 also has a pair of indexing recesses 170, 171 into which dowels pins 172 and 173 seat. Insert 124 has corresponding dowel pin recesses 174, 175, such that when assembled, dowel pins 172, 173 act as an alignment means in the nature of indexing pins, or alignment governors, to ensure alignment of plate 150 with insert 124 in a specific orientation. As described below, end plate 150. has a number of internal passages, and the correct alignment of those passages with stub. shafts 106 and 108 and with passages 135 and 137 of insert 124 is required for satisfactory operation of unit 100. The outward face of piston 116, that is, face 178 which faces toward plate 150 (or 152) and away from gears 106 and 108, has a rebate against which an omega seal 180 can bear, with a seal backup 182 located behind seal 180. When retaining ring 144 is tightened, seals 180, 182 and 168 are all compressed in position. If the direction of rotation of gears 102 and 104 is reversed, the role of intake and exhaust is also reversed. The ability to reverse the direction of rotation of the gearset, or to operate the gearset as a motor, depends on the seals employed. Omega seals 180 of the preferred embodiment are mono-directional seals which tend to resist leakage past face 178 from passage 137 back to passage 135. They do not work equally well in the other direction.

End plate 152 has a first end face 184, facing away from gears 102 and 104, and a second end face 186 facing toward gears 102 and 104. Externally, end plate 152 has a round cylindrical body having a smooth medial portion 188, a first end portion 190 next to end face 184, and a second end portion in the nature of a flange 192 next to second end face 186. Portion 190 is of somewhat smaller diameter than portion 188, and is externally smooth to permit longitudinal travel of a mating female union nut 194. Portion 190 terminates in an end flange 196 having a shoulder that engages a spiral retaining ring 198 of nut 194 when nut 194 is tightened on an adjacent fitting of the next adjacent motor or pump section. Flange 192 has a circumferential shoulder 200 lying in a radial plane, such that when retaining ring 146 is tightened within casing 126, shoulder 148 of retaining ring 146 bears against shoulder 200, thus drawing end plate 152 toward gears 102 and 104. First end face 184 is also provided with O-ring seals 197 for sealing the connection between its own fluid passages (described below) and the passages of an adjoining fitting when assembled.

Second end face 186 of plate 152 has a seal groove 166 into which another static seal 168 seats. As above, seal 168 is of a size and shape to circumscribe the entire periphery of internal peripheral wall 130 of insert 124. Face 186 also has another pair of indexing recesses 170, 171 into which further dowels pins 172 and 173 seat. Insert 124 has corresponding dowel pin recesses 174, 175, such that when assembled, dowel pins 172, 173 act as an alignment means in the nature of indexing pins, or alignment governors, to ensure alignment of plate 152 with insert 124 in a specific orientation. As described below, end plate 152 has a number of internal passages, and the correct alignment of those passages with stub shafts 106 and 108 and with passages 135 and 137 of insert 124 is required for satisfactory operation of unit 100. The outward face of piston 118, that is, face 178 which faces toward plate 152 and away from gears 102 and 104,. has a rebate against which an omega seal 180 can bear, with a seal backup 182 located behind seal 180. When retaining ring 146 is tightened, seals 180, 182 and 168 are all compressed in position, in the same manner as noted above.

When unit 100 is fully assembled, and in operation, pistons 116 and 118 are urged against the end faces of gears 102 and 104 by hydrodynamic pressure, such that hydraulic fluid will tend not to seep easily from the high pressure port to the low pressure port. Inasmuch as there are neither ball nor journal bearings, and inasmuch as the body of the assembly is predominantly hard, abrasion resistant ceramic, with tough, hardened steel fittings, the unit is able to operate at relatively high temperatures, that is, temperatures in excess of 180 F. The unit may tend also to be operable at temperatures up to 350 F. or higher.

As noted above, each of motor units 82 and 84 and each of pump units 90 and 92 employs a gear assembly unit 100. The difference between motor units 82 and 84 is in the respective transition plates used between the units. These plates act as fluid manifolds by which the various fluids are directed to the correct destinations.

Starting at the top, or upper, end of the string, transport system 48 ends at a first manifold, namely motor section inlet plate 80. Motor section 62 includes a pair of modular gear assemblies 100, ganged together, and motor section outlet plate 86. A round cylindrical casing 214 is welded to inlet plate 80 and outlet plate 86, leaving a generally annular passageway 216 defined between an outer peripheral wall, namely the inner face of casing 214, and the exterior surface of the ganged gear assemblies, which are designated as upper motor assembly 82 and a lower motor assembly 84.

As shown in FIGS. 2*c*, 2*d*, 3*a*, 3*b*, 3*c*, 3*d*, and 3*i*, motor section inlet plate 80 has a cylindrical body having a medial flange 222 that extends radially outward to present a circumferential face about which one end of casing 214 is welded. To the upward side of flange 222, there is an externally threaded end portion 224 that mates with a female coupling 72 of transport system 48. To the other, downward side of flange 222 there is an intermediate portion 228 that has a smooth cylindrical surface, and, downwardmost, there is an externally threaded end portion 230 that mates with union nut 194 of upper motor assembly 82. Taken on the cross-sections of FIG. 3*c*, 3*d* and 3*i*, it can be seen that inlet plate 80 has first and second parallel, axially extending through bores 232 and 234 defining hydraulic fluid supply and return passages 233 and 235 which communicate with transport system supply tubes 75 and 74. Inlet plate 80 also has a pair of parallel, axially extending blind bores 236 and 238 let in from upward face 240, and which terminate at dead ends 241 and 242. Porting for bores 236 and 238 is provided by perpendicular blind cross bores 244 and 246 extend radially inward through the wall of intermediate portion 228. When assembled, bores 236 and 238, and cross-bores 244 and 246 define passageways 237 and 239 which provide a fluid communication pathway between annular passageway 216 and, ultimately, tubes 76 and 77 of transport system 48.

Figure 4C:
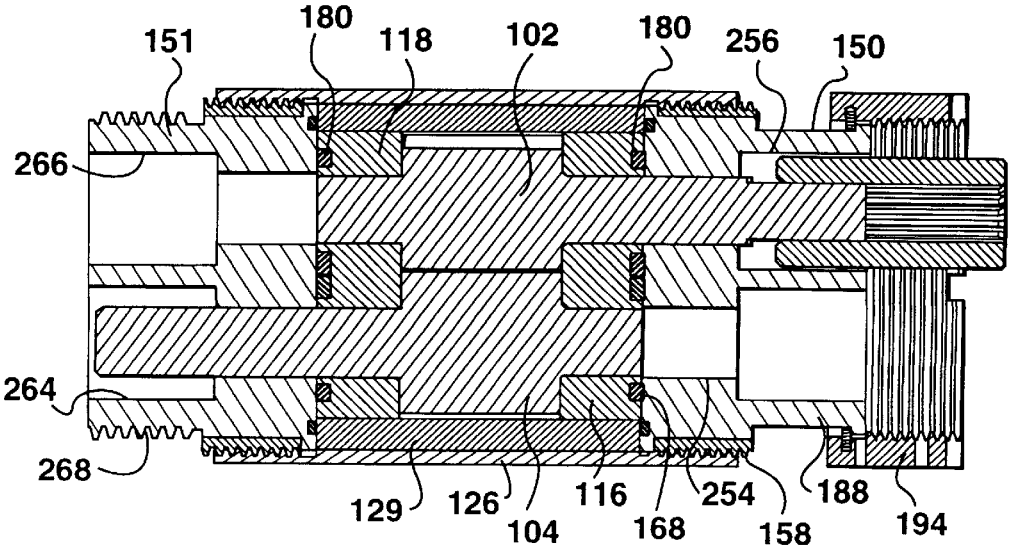
FIG. 4*c* shows a cross-section on section '4*c*—4*c*' of FIG. 4*a;*
Figure 4A:
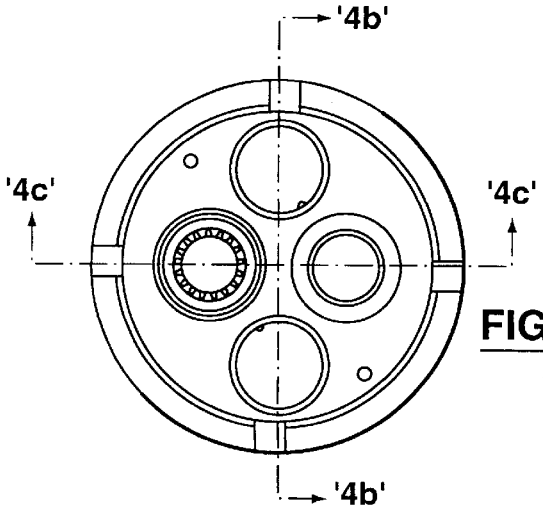
FIG. 4*a* shows an end view of a top or intermediate stage motor unit of the down-hole production unit of FIG. 2*b;*
Figure 4B:
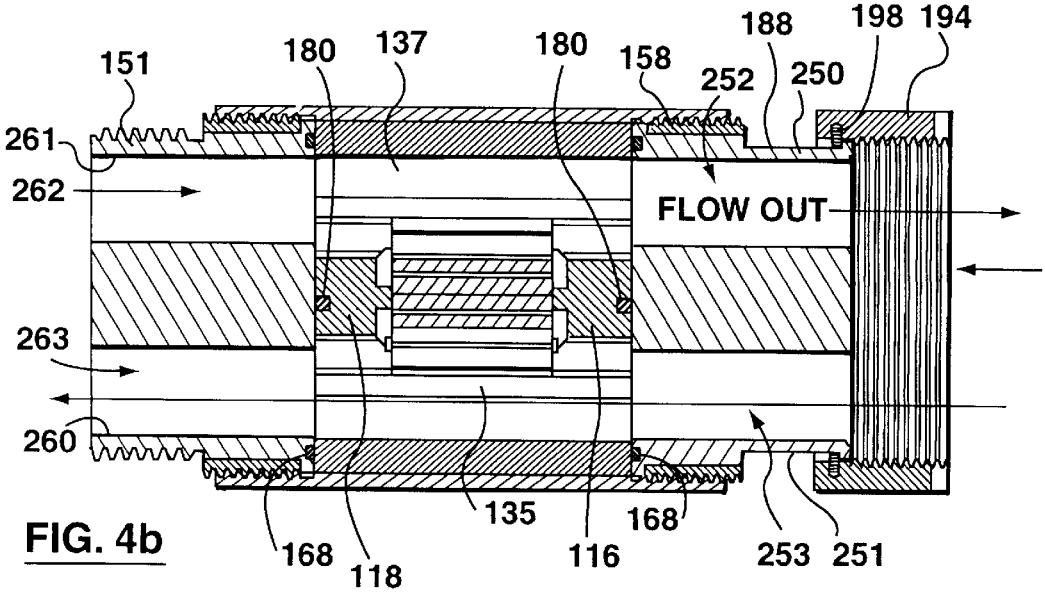
FIG. 4*b* shows a cross-section on section '4*b*—4*b*' of FIG. 4*a;*
Figure 4F:
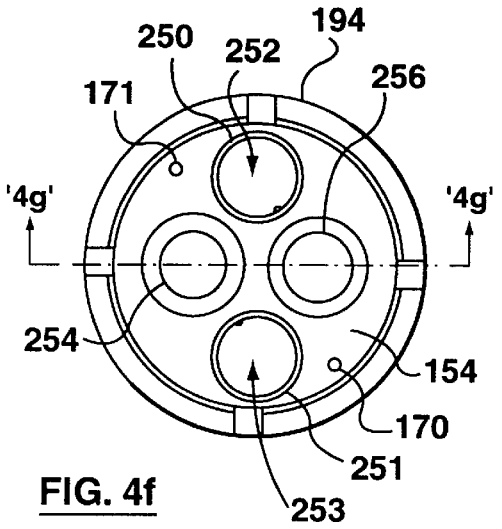
FIG. 4*f* shows an end view of the fitting of FIG. 4*d;*
Figure 4E:
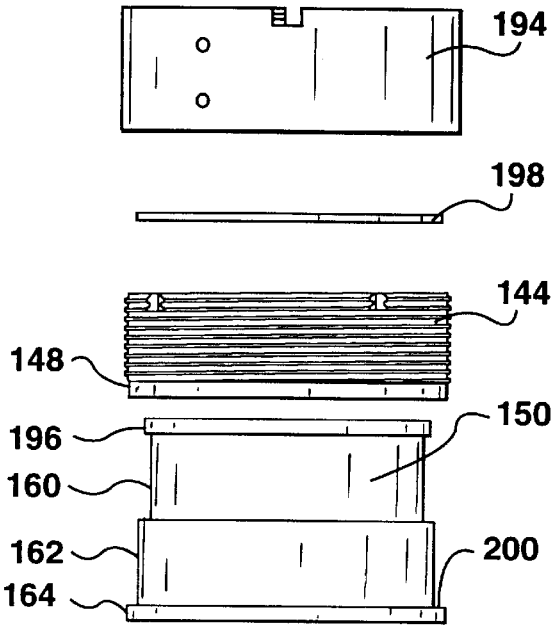
FIG. 4*e* shows an exploded view of the fitting of FIG. 4*d;*
Figure 4D:
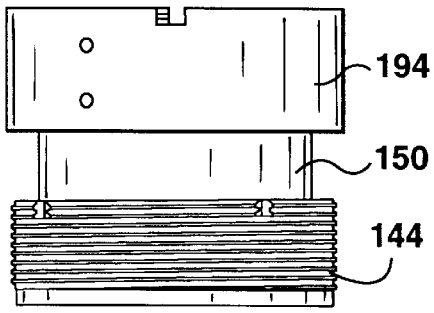
FIG. 4*d* shows a side view of a fitting of FIG. 4*a;*
Figure 4G:
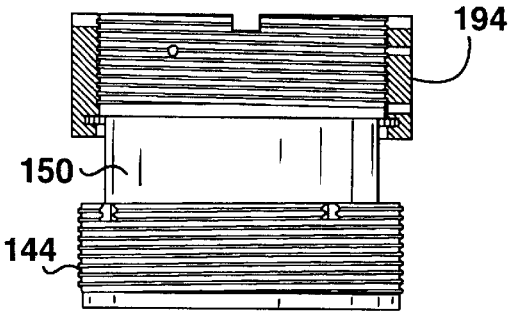
FIG. 4*g* shows a cross-sectional view taken on section '4*g*—4*g*' of FIG. 4*f;*

Upper motor assembly 82 has a union nut 194 as described above, which engages threaded end portion 230 of motor section inlet plate 80. As shown in FIGS. 2*c* and 4*b*, plate 150 has a pair of parallel longitudinally extending through bores 250 and 251 defining hydraulic fluid intake and exhaust passages 252 and 253 that communicate with the respective intake and exhaust passages 135 and 137 of the positive displacement gear assembly 100 containing gears 102 and 104 of unit 82. Taken on the perpendicular longitudinal cross-section of FIG. 4*c*, plate 150 has a pair of parallel countersunk bores 254 and 256. Bores 254 and 256 dead end at the blocked interface with motor section inlet plate 80 in line with dead ends 241 and 242. Bore 256 is occupied by splined end 114 of stub shaft 106 of gear 102, such that shaft 106 is an idler. Bore 254 is unoccupied. As shown in FIG. 4*c*, an internally splined coupler is indicated as 258. Coupler 258 is employed when assembly 82 is an intermediate motor assembly (i.e., neither the top nor the bottom unit in a string of several motor assemblies). Coupler 258 is removed when used in a top unit such as assembly 82 since there is no shaft above it in the string with which to connect, and coupler 258 would otherwise foul the blind end face of plate 80.

As shown in FIG. 4*b*, plate 151 of upper motor assembly 82 has a pair of parallel longitudinally extending through bores 260 and 261 defining hydraulic fluid intake and exhaust passages 262 and 263 that communicate with the respective intake and exhaust passages 135 and 137 of the positive displacement gear section containing gears 102 and 104 of unit 218. Taken on the perpendicular longitudinal cross-section of FIG. 4*c*, plate 151 has a pair of parallel countersunk bores 264 and 266. Bores 264 and 266 are open clear through to corresponding countersunk bores of the next adjacent motor unit, namely lower motor unit 84. Bore 264 is occupied by splined end 108 of stub shaft 104 of gear 104. Bore 266 is unoccupied.

Upper plate 270 of lower motor assembly 84 is identical to plate 150 of upper motor unit 82. Union nut 194 of plate 270 of lower motor assembly 84 engages the external thread 268 of plate 151 of upper motor assembly 82. In this case an internally splined transmission coupling shaft 272 engages the downwardly extending splines of stub shaft 108 of upper motor assembly 82, and the upwardly extending splines of stub shaft 106 of lower motor assembly 84 such that when the upper shaft is driven, torque is transmitted by coupling shaft 272 to the lower shaft. The broadened countersunk portions of bores 254 and 256 accommodate coupling shaft 272.

Figure 5B:
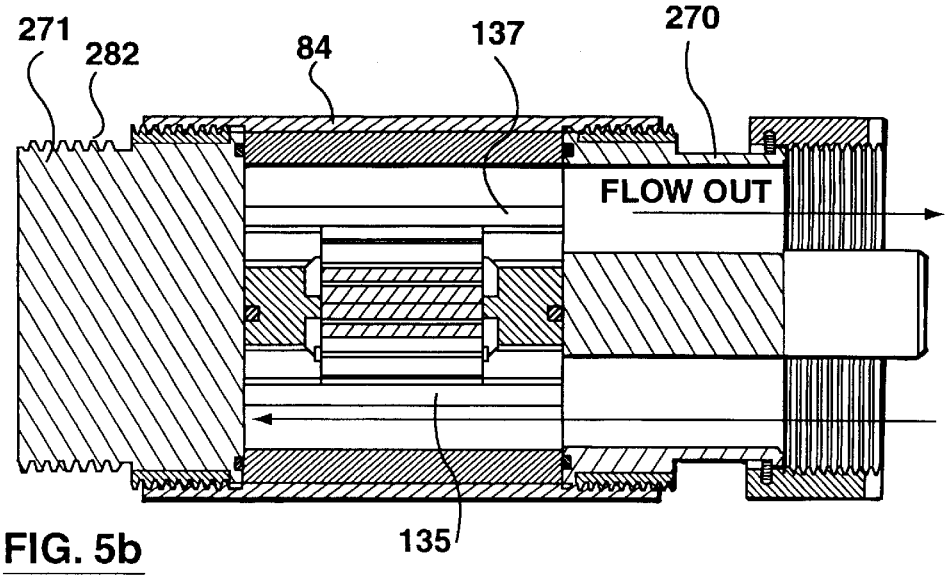
FIG. 5*b* shows a cross-section on section '5*b*—5*b*' of FIG. 5*a;*
Figure 5A:
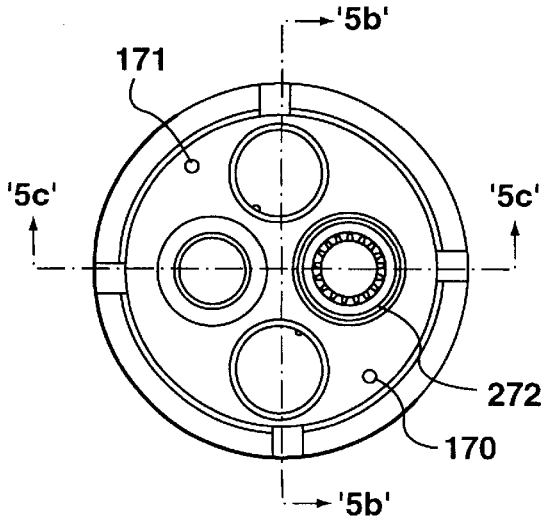
FIG. 5*a* shows an end view of a bottom stage motor unit of the down-hole production unit of FIG. 2*b;*
Figure 5C:
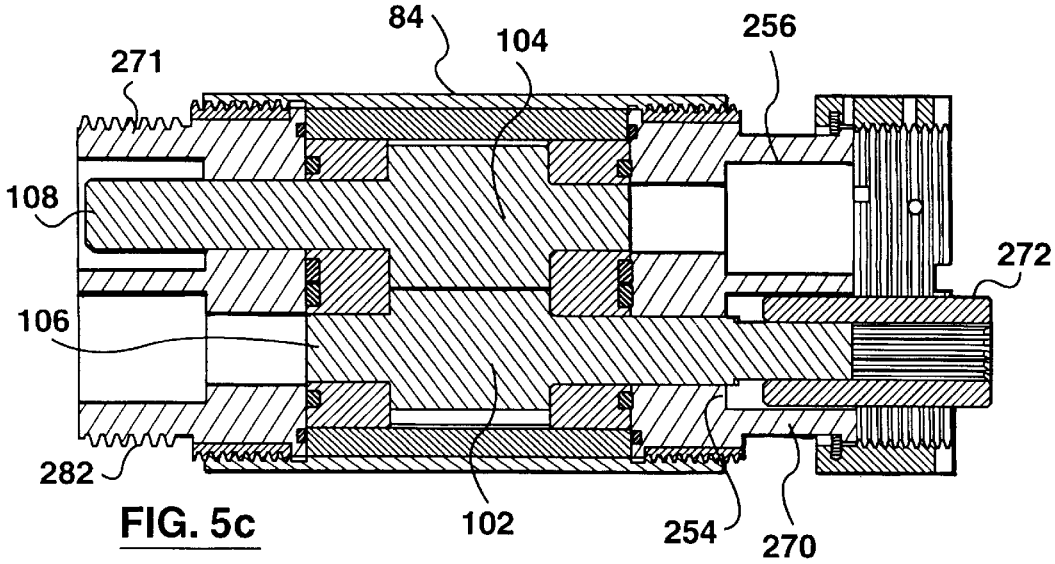
FIG. 5*c* shows a cross-section on section '5*c*—5*c*' of FIG. 5*a;*

Plate 271 of lower motor assembly 84 is shown in FIGS. 2*c*, 5*b* and 5*c*. It is identical to plate 151 of upper motor assembly 82 except insofar as it does not have hydraulic fluid transfer passages corresponding to passages 262 and 263, but rather is dead ended opposite the ends of passages 135 and 137 of unit 100 of assembly 84, thus closing the end of the hydraulic pump fluid circuit. As a result, the only ways for hydraulic fluid to pass from the pressure, or supply side is through the positive displacement gear sets of either upper motor assembly 82 or lower motor assembly 84. Given the positive engagement of coupling shaft 272, these gearsets are locked together to turn at the same rate, and any output torque is available on driven stub shaft 108 of lower motor assembly 84.

Motor section outlet plate 86 has a medial, radially outwardly extending flange 274, an upwardly extending first body end portion 276, and a second, downwardly extending second body end portion 278. End portion 276 has an external flange 280 and a union nut 194 by which it is mounted to the external threads 282 of lower plate 271 of lower motor assembly 84. Flange 274 has a circumferential step into which the bottom margin of casing 214 seats, and is welded. Second body end portion 278 is externally threaded to accept a union nut 283 attached to pump section 64. As shown in FIGS. 2*c* and 3*g*, motor outlet plate 212 has a longitudinal bore 281 that extends inwardly (i.e., upwardly), from downward face 284 past the longitudinal position of the upward facing shoulder 286 of flange 280. A lateral notch, or aperture 288 is formed in second end portion 278 to permit fluid communication between passage 216 and the passage 290 defined by bore 281 and aperture 288. Motor section outlet plate 86 has a second longitudinal bore 292 aligned with shaft 108 of lower motor assembly 84, and a tail shaft, or transfer shaft, in the nature of driven shaft 294 extends from a splined coupling 272 mounted to shaft 108 of lower motor assembly 84 to connect with upper pump assembly 90.

Upper pump assembly 90 is shown in FIGS. 2*c*, 3*h*, 6*a*, 6*b* and 6*c*. Upper pump assembly 90 has a first, or upper plate 300 and a lower plate 301 mounted to upper and lower sides of a gear assembly 101. As noted above, gear assembly 101 is identical in construction to gear assembly 100, but is somewhat larger in diameter as shown in FIG. 2*c*, and has a thicker shrink fit casing 127. Upper plate 300 has a cylindrical body having a first, upward face 302, a second, downward face 304, a first, upward portion 306 next to face 302 having a flange and a union nut 194 as described above, and a smooth cylindrical exterior surface 308. In the same manner as plate 150, upper plate 300 also has a second, or lower outwardly stepped cylindrical portion 310 having a smooth surface and an end flange 312 to be captured by a retaining ring, or sleeve 144 as described above, and fixed in position relative to external pump casing 127. Plate 300 has a first pair of parallel longitudinally extending, round cylindrical, through-bores 312 and 314. Bore 312 defines within its walls is an outflow, or exhaust passage 316. Bore 314 defines within it an inlet passage 318, or an inlet manifold leading to gear assembly 100 of upper pump assembly 90. An cross-bore 320 intersects bore 314 and provides inlet ports by which production fluid can enter passage 314. Whereas exhaust passage 316 is open to passage 290 of motor outlet section plate 86, inlet passage 318 is dead ended at plate 86.

Figure 6C:
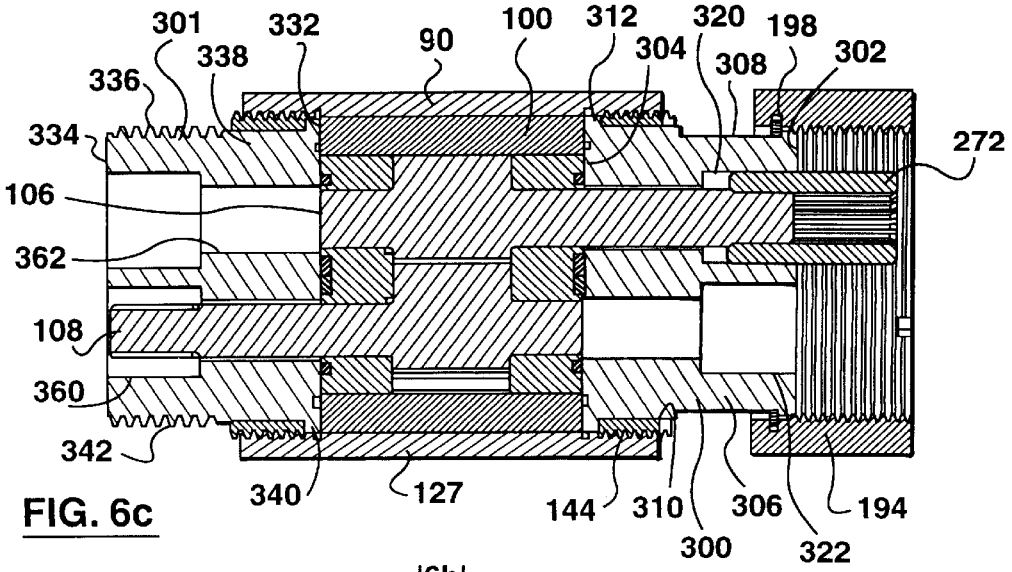
FIG. 6*c* shows a cross-section on section '6*c*—6*c*' of FIG. 6*a;*
Figure 6A:
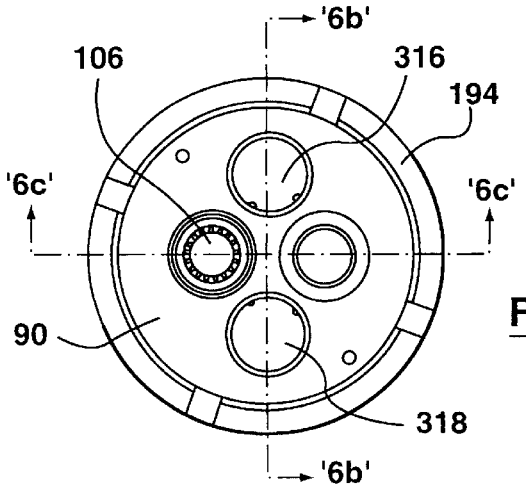
FIG. 6*a* shows an end view of a top or intermediate stage pump unit of the down-hole production unit of FIG. 2*b;*
Figure 6B:
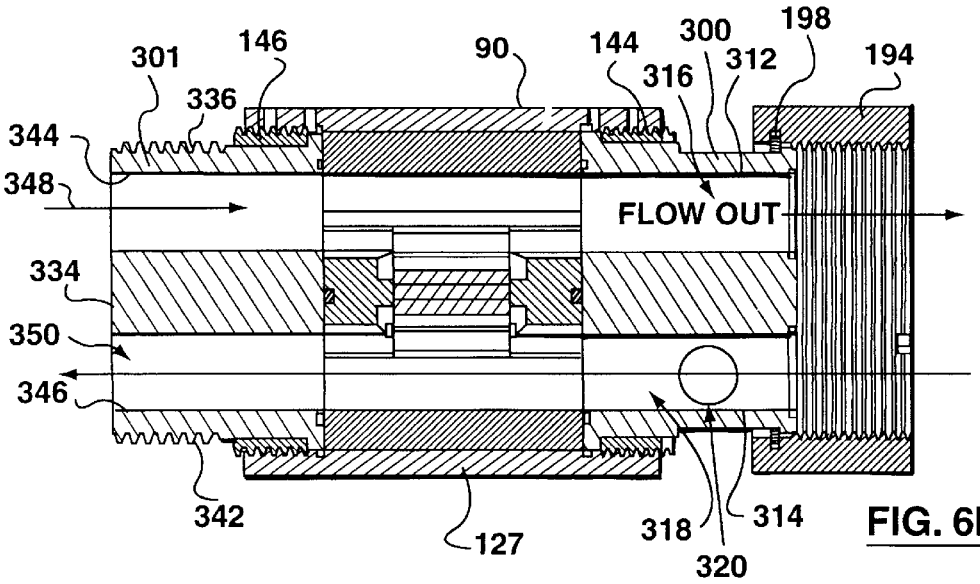
FIG. 6*b* shows a cross-section on section '6*b*—6*b*' of FIG. 6*a;*
Figure 7C:
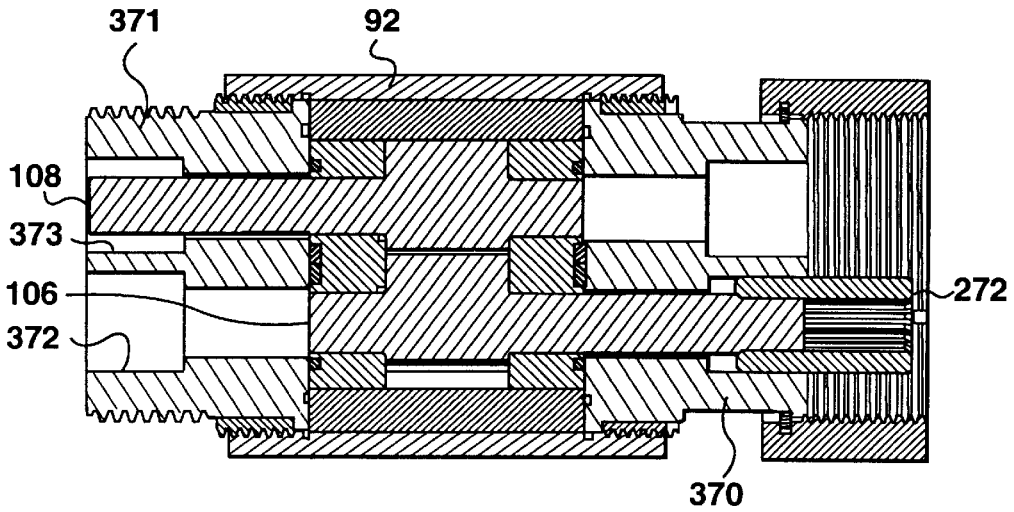
FIG. 7*c* shows a cross-section on section '7*c*—7*c*' of FIG. 7*a;*
Figure 7A:
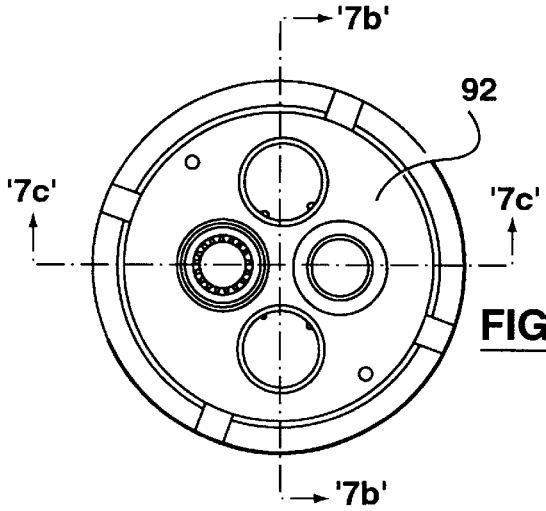
FIG. 7*a* shows an end view of a bottom stage pump unit of the down-hole production unit of FIG. 2*b;*
Figure 7B:
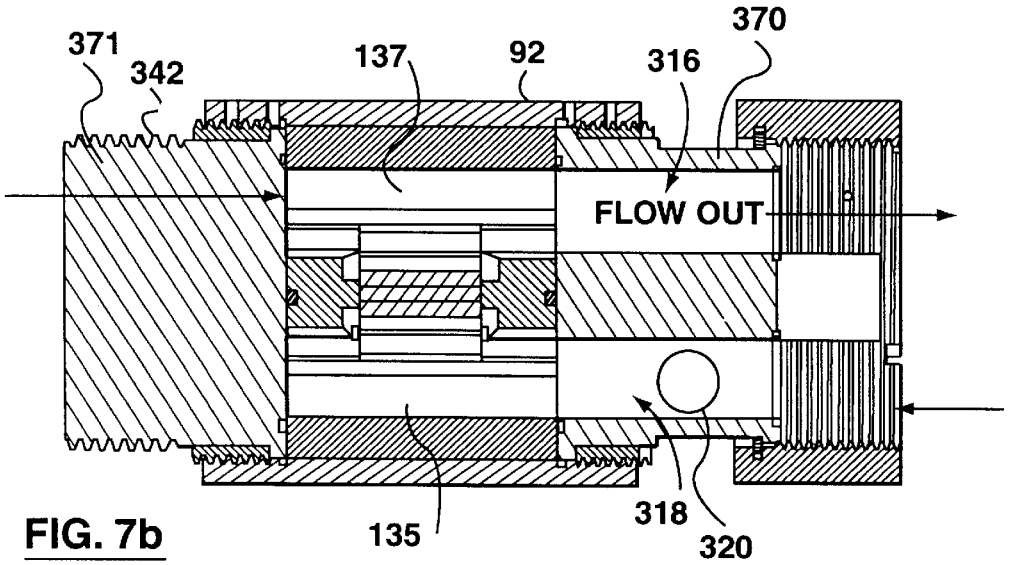
FIG. 7*b* shows a cross-section on section '7*b*—7*b*' of FIG. 7*a;*

In the perpendicular cross section, shown in FIG. 6*c*, plate 300 has a pair of first and second parallel longitudinal countersunk bores 320 and 322, bore 320 being occupied by stub shaft 106 of upper pump assembly 90, and bore 322 being unoccupied. An inwardly splined coupling mates with driven shaft 294 of plate 86 described above such that driving rotation of shaft 294 will tend to turn the gearset of upper pump assembly 90, thus driving production fluid from passage 318 to passage 316.

Lower plate 301 has a cylindrical body having a first, upward face 332, a second, downward face 334, a first, upward portion 336 next to face 332. In the same manner as member 151, lower plate 301 also has a first, or upper outwardly stepped cylindrical portion 338 having a smooth surface and an end flange 340 to be captured by a retaining sleeve 146 as described above, and fixed in position relative to external pump casing 127. Lower plate 301 also has a second, lower portion having a threaded cylindrical exterior surface 342. Plate 301 has a first pair of parallel longitudinally extending round cylindrical, through-bores 344 and 346. Bore 344 defines within its walls an outflow, or exhaust passage 348 that is in fluid communication with passage 316 and with the exhaust side of the positive displacement gearset of lower pump assembly 92. Bore 346 defines within it an inlet passage 350, or an inlet manifold leading to gear assembly 100 of lower pump assembly 92. Inlet passage 350 is open to inlet passage 318, making a common inlet manifold passage.

In the perpendicular cross section, shown in FIG. 6C, plate 301 has a pair of first and second parallel longitudinal countersunk bores 360 and 362, bore 360 being occupied by stub shaft 108 of upper pump assembly 90, and bore 362 being unoccupied.

Lower pump assembly 92 also has an upper plate 370 and a lower plate 371. Upper plate 370 is identical to upper plate 300. Lower plate 371 is similar to lower plate 301, but while having drive shaft bores, 372 and 373, is dead ended opposite the intake and exhaust passages 135 and 137 of the positive displacement gearset of lower pump assembly 92.

A perforated external casing 375 is carried outside upper and lower pump assemblies 90 and 92, and has ports, or apertures 376 by which production fluid can enter and find its way to intake passages 318.

When all of the above units are assembled in their aligned positions, it can be seen that when hydraulic fluid is supplied under pressure to motor section 62, the various gearshafts are forced to turn, thus driving the upper and lower pump sections to urge production fluid from the inlet side, represented by passages 318, to the outlet or exhaust side, represented by passages 316. The production fluid is then forced upwardly through the series of inter-connected production fluid passages, namely item numbers 290, 216, 237 and 239 to passages 74 and 75 of transport system 48, and thence to the well head.

Although a preferred embodiment of production unit has now been described, various alternative embodiments can be used. For example, with appropriate substitution of top and bottom plates and with appropriate lengths of casing tubes, a motor-and-pump production unit can be assembled with only a single motor unit, or a single pump unit. Since the upper motor and pump units respectively have lower end fittings that correspond to their own top end fittings, it is possible to string together a large number of such motor assemblies, or such pump assemblies, in intermediate positions as may be required at a given site depending on the desired flowrate and the physical properties of the production fluid, such as viscosity. The number of motor assemblies need not equal the number of pump assemblies, and may be greater or lesser as may be appropriate given the circumstances of the particular well from which production fluid is to be extracted.

Other types of positive displacement gear pumps can also be employed. FIGS. 8*d* and 8*e* show views of a positive displacement gear assembly 400 having a first, or internal gear 402, an external ring gear 404 mounted eccentrically relative to internal gear 402, and a spacer in the nature of a floating crescent 406 mounted in the gap between gears 402 and 404. External gear 404 is mounted concentrically about the longitudinal axis 401 of gear assembly 400, generally, the axis of rotation of gear 402 being eccentric relative to axis 401. The internal concave arcuate face 408 of crescent 406 is formed on a circular arc having a radius of curvature corresponding to the outer tip radius of internal gear 402. The external, convex arcuate face 410 of crescent 406 is formed on a circular arc having a radius of curvature corresponding to the tip radius of the inwardly extending teeth of ring gear 404. As gears 402 and 404 turn, the interstitial spaces between the teeth define fluid conveying cavities, and when the teeth mesh the cavity volumes are diminished so that the fluid is forced out. Consequently, as the gears turn, fluid is transferred between intake and exhaust port regions 412 and 414. Alternatively, when a pressure differential is established between port regions 412 and 414, gear assembly 400 acts as a motor providing output torque to shaft 416 upon which inner gear 402 is mounted. In either case, the direction of rotation will determine which is the intake port, and which is the exhaust. Shaft 416 is splined at both ends 418 and 420, permitting power transfer transmission to, and from, adjacent pump or motor units.

The gear set formed by gears 402 and 404, crescent 406 and shaft 416 is mounted within a round cylindrical annulus, or housing, namely ceramic insert 422, which is itself contained with a shrink-fit external steel tube casing 424. As above, casing 424 has a tensile pre-load, and imposes a compressive radial pre-load on insert 422.

First and second end plates are indicated as 426 and 428. Each has a counter sunk eccentric bore 430 for close fitting accommodation of a ceramic bushing 432 which seats about shaft 416 and has an end face that abuts one face of inner gear 402. Bore 430 is sufficiently large at its outer end to permit engagement of an internally splined coupling by which torque can be transferred to an adjacent shaft, in a manner analogous to that described above. Each of end plates 426 and 428 has a first end face 427 that locates adjacent a face of ring gear 404, and has an outer peripheral seal groove and a static seal 429 seated therein to bear against a shoulder of insert 422. Locating means, in the nature of indexing sockets and mating dowel pins 433 determine the orientation of end plates 426 and 428 relative to the respective axes of rotation of gears 402 and 404, and to each other.

End plate 426 is nominally the upward end plate of the assembly, and has a flange 434 to be engaged by a retaining ring 436. Retaining ring 436 is externally threaded and engages the internally threaded overhanging upward end skirt 437 of casing 424 in the manner of retainer 144 and skirt 140 described above. A union nut 438 and retaining ring 439 engage an end face flange 440 in the manner of union nut 194 described above. End plate 428 is the same as end plate 426 externally, with the exception that the distal portion 441 is externally threaded to mate with a union nut of an adjacent pump or motor assembly, or other fitting.

Internally, end plates 426 and 428 each have a pair of parallel, round cylindrical longitudinally extending bores 442 and 444 let inward from the end face most distant from gears 402 and 404, and extending toward gears 402 and 404, defining respective internal passageways. Each has an enlarged port 446, 448 in the nature of an arcuate, circumferentially extending rebate at the respective end face 427 of plate 426 or 428 that is located adjacent to gears 402 and 404. These rebates act as intake and exhaust galleries for gears 402 and 404, the function depending on the direction of rotation of the gears.

Given the symmetrical nature of assembly 400, it can be seen that it can be operated either as a motor or as a pump, and, with appropriate interconnection transition plates analogous to plates 80, and 86, several units can be ganged together as parallel (or, serial) pump stages or motor stages, with the shafting and splined couplings permitting transmission of mechanical torque between the various stages.

A further alternative gear assembly is shown in FIGS. 8*f* and 8*g* as 450. All of the components of assembly 450 are the same as those of assembly 400 of FIGS. 4*c* and 4*d* described above, except that in place of the positive displacement gear assembly of gear 402, gear 404 and crescent 406, assembly 450 employs a positive displacement gear assembly in the nature of a gerotor assembly 452. Gerotor assembly 452 has an inner gerotor element 454 and a mating outer gerotor element 456. Outer gerotor element 456 is concentric with the longitudinal centerline 458 of assembly 450 generally, and inner gerotor element 454 is mounted on an eccentric parallel axis. In the manner of gerotors generally, as the gerotor elements turn, variable geometry cavities defined between respective adjacent lobes of the inner and outer elements expand and contract, drawing in fluid at an intake side 460, and expelling it at an exhaust region 464 (as before, intake and exhaust depend on the direction of rotation of the elements). As above, appropriate porting permits assembly 450 to be used as a motor or a pump, and several units can be linked together to form a multi-stage pump or multistage motor. Shafting and splined couplings can be used to transfer mechanical torque from stage to stage.

Operation of the foregoing preferred and alternative embodiments of production units and their associated motor or pump units requires a supply of hydraulic fluid, and transport of the production fluid to the surface. To that end, transport system 48 employs a multi-passage conduit that is now described in greater detail. By way of a general overview, and referring to FIGS. 9*a*, 9*b*, and 9*c*, a pipe string "joint" in the nature of a modular pipe assembly is shown as 520. It has a casing 522 and an interconnection in the nature of a male fitting 524 at one end, and a female fitting in the nature of a female coupling 526 at the other, such that a string of modular pipe assemblies 520 can be joined together. A pipe bundle 528 is contained within casing 522, and a seal 530 of matching profile to bundle 528 is clamped between adjacent assemblies 520 when a string is put together. Notably, the pipes of bundle 528 lie side by side, rather than being nested concentrically one within the other. For the purposes of illustration, the length of the assembly or assemblies shown is shorter in the illustrations than in actual fact. In use a typical assembly length would be 10 or 12 m (32.8 to 39.5 ft), and the pipe bundle diameter would be about 15 cm (6 in.). Other lengths and diameters can be used. The longitudinal, or axial direction is indicated in the figures by center line axis CL of casing 522.

During deployment or installation, pipe assembly 520 is mounted to another pipe assembly, then introduced into a well bore a few feet, another similar section of pipe is added, the string is advanced, another string is added and so on. Although assembly 520 can be used in a horizontal well bore application, the assembly at the well head is generally in the vertical orientation. Thus FIGS. 9*a*, 9*b*, and 9*c* each have arrows indicating "Up" and "Down" such as well rig workers would see at the well head.

Figure 9A:
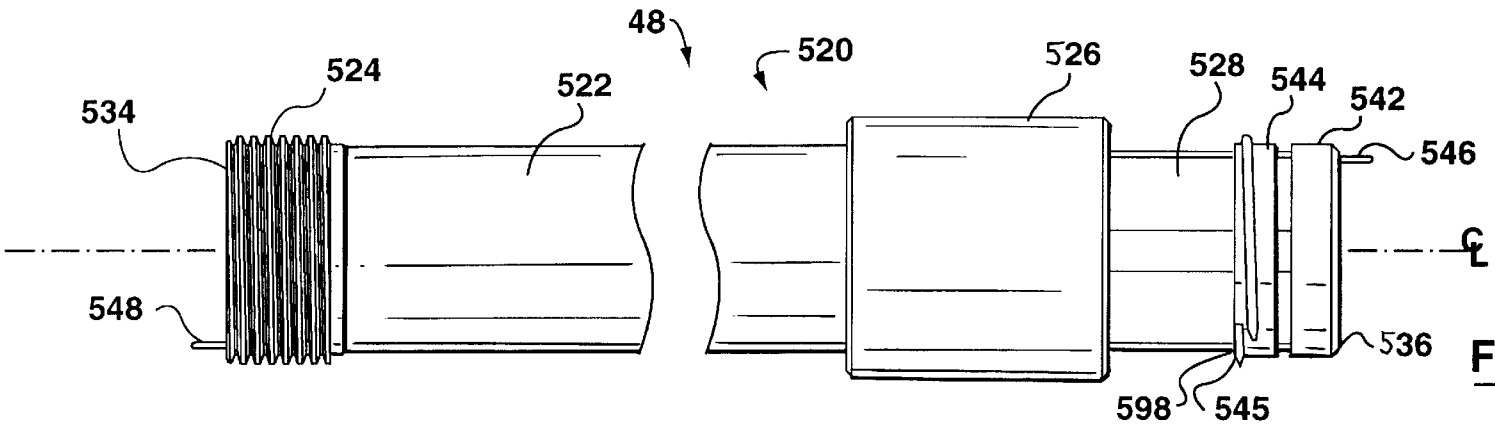
FIG. 9*a* shows a side view of an assembled multi-passage pipe assembly according to an aspect of the present invention.

Examining the Figures in greater detail, casing 522 is round and cylindrical and serves as an external bundle retainer. It is preferred that casing 522 be shrink fit about bundle 528. In the preferred embodiment of FIG. 9*d*, casing 522 is made from mild steel pipe. The type of material used for the casing may tend to depend on the application. For example, a stainless steel or other alloy may be preferred for use in more aggressive environments, such as high sulfur wells. Casing 522 has a pair of first and second ends, 534 and 536. Male fitting 524 is mounted at first end 534. Female coupling 526 is mounted about casing 522, and is longitudinally slidable and rotatable with respect to second end 536. A retaining ring 542 is mounted flush with second end 536, and a start flange, 544, is mounted inboard of ring 542. Start flange 544 is a cylindrical collar having one turn of a single external thread 545. As shown in FIG. 9*a*, first and second indexing dogs 546 and 548, protrude longitudinally, or axially, from first and second ends 534 and 536 respectively. At corresponding positions indicated by arrows 550 and 552, assembly 520 has sockets into which dogs of other mating pipe assemblies can locate. During assembly of a string of pipes at the well head, dogs 546 and 548 engage matching sockets in the next adjacent assemblies, thus ensuring their relative alignment as the string is assembled.

Figure 10B:
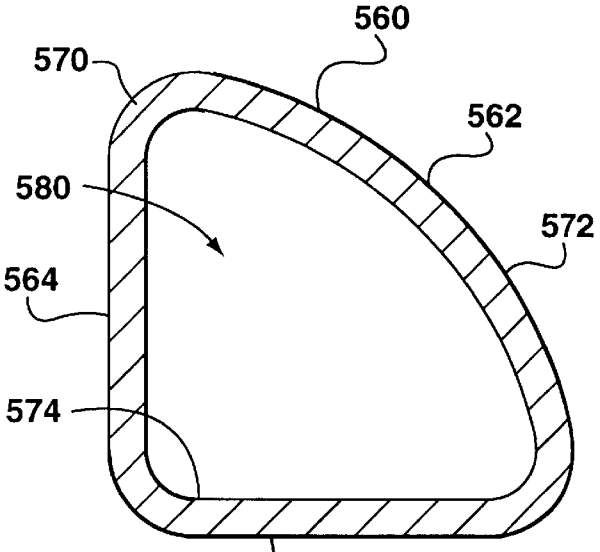
FIG. 10*b* is a cross-sectional view of the tube member of FIG. 10*a;*
Figure 10A:
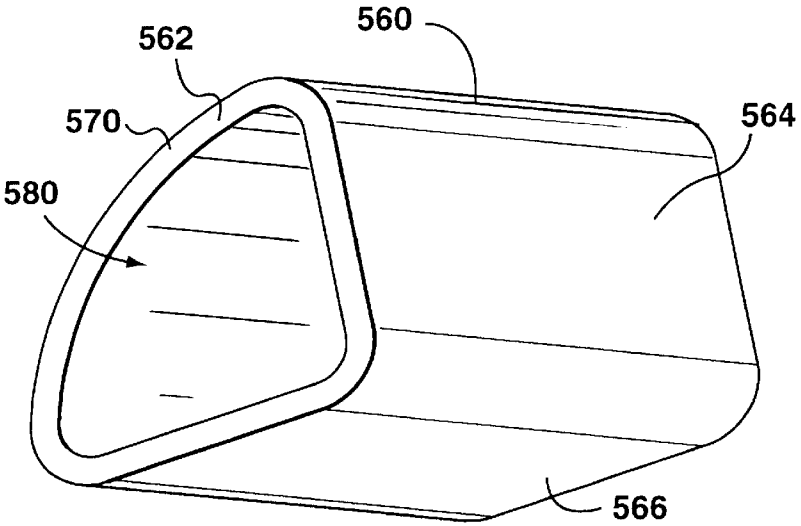
FIG. 10*a* is an isometric view of a tube member of the multi-passage pipe assembly of FIG. 9*a;*
Figure 9C:
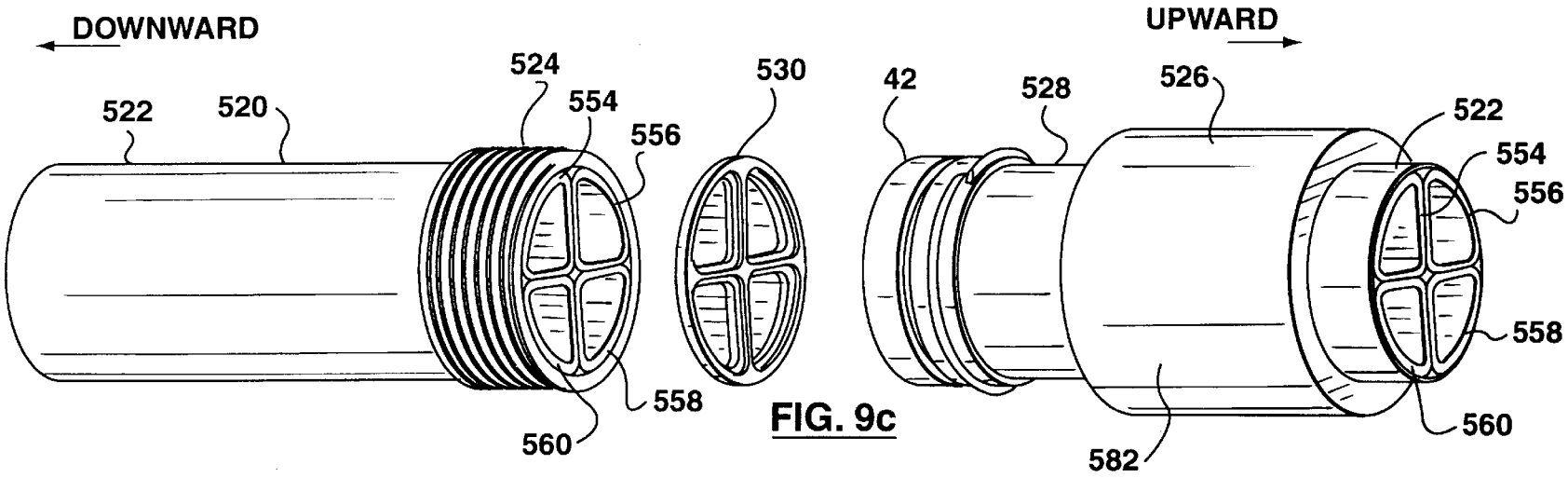
FIG. 9*c* shows an exploded isometric view of the pair of multi-passage pipe assemblies of FIG. 9*b* in a separated condition.
Figure 9B:
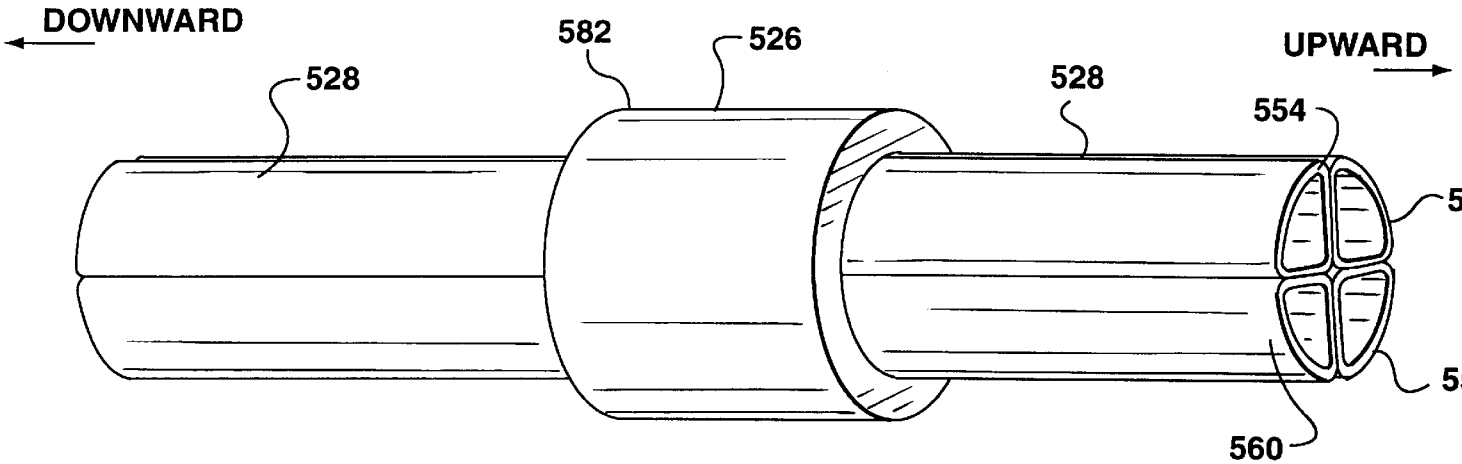
FIG. 9*b* shows an isometric view of a pair of the multi-passage pipe assemblies of FIG. 9*a* joined together.

As shown in FIGS. 9*b* and 9*c*, each of pipe assemblies 520 has four parallel conduit members, or pipe sections, in the nature tubes, 554, 556, 558 and 560 arranged in a bundle within casing 522. In the FIGS. 9*b* and 9*c* all of tubes 554, 556, 558 and 560 have the same cross-section, being that shown in FIGS. 10*a* and 15*a*. That section has the shape of a right angle sector of a circle, that is, a pie-shaped piece approximating a quarter of a pie, with smoothly radiused corners. In the preferred embodiment of FIGS. 10*a* and 15*a*, tube 560 has an outer arcuate portion 562, having an outside radius of curvature of 2.75 inches to suit a pipe having an inside, shrink fit diameter of 5.5 inches. Tube 560 also has a first side 564, and a second side 566 at right angles to first side 564. Arcuate portion 562 and sides 564 and 566 are joined at their respective common vertices to define a closed wall section, 570. Section 570 has an external wall surface 572, and an internal wall surface 574, each having respective first and second straight portions and an arcuate portion, with radiused corners.

Section 570 is made by roll forming a round pipe of known pressure rating into irregular pie shape shown. This can be done in progressive roll forming stages. Section 570 is a seamless pipe. Other types of pipe can also be used, such as a seamed ERW pipe, or an extruded pipe capable of holding the pressures imposed during operation.

Internal wall surface 574 defines a passageway, indicated generally as 580, along which a fluid can be conveyed in the axial, or longitudinal direction, whether upward or downward. When casing 522 is shrunk fit in place, tubes 554, 556, 558 and 560 have a combined outer surface approximating a circle and are held in place against each other's respective first and second external side portions by friction.

Figure 9D:
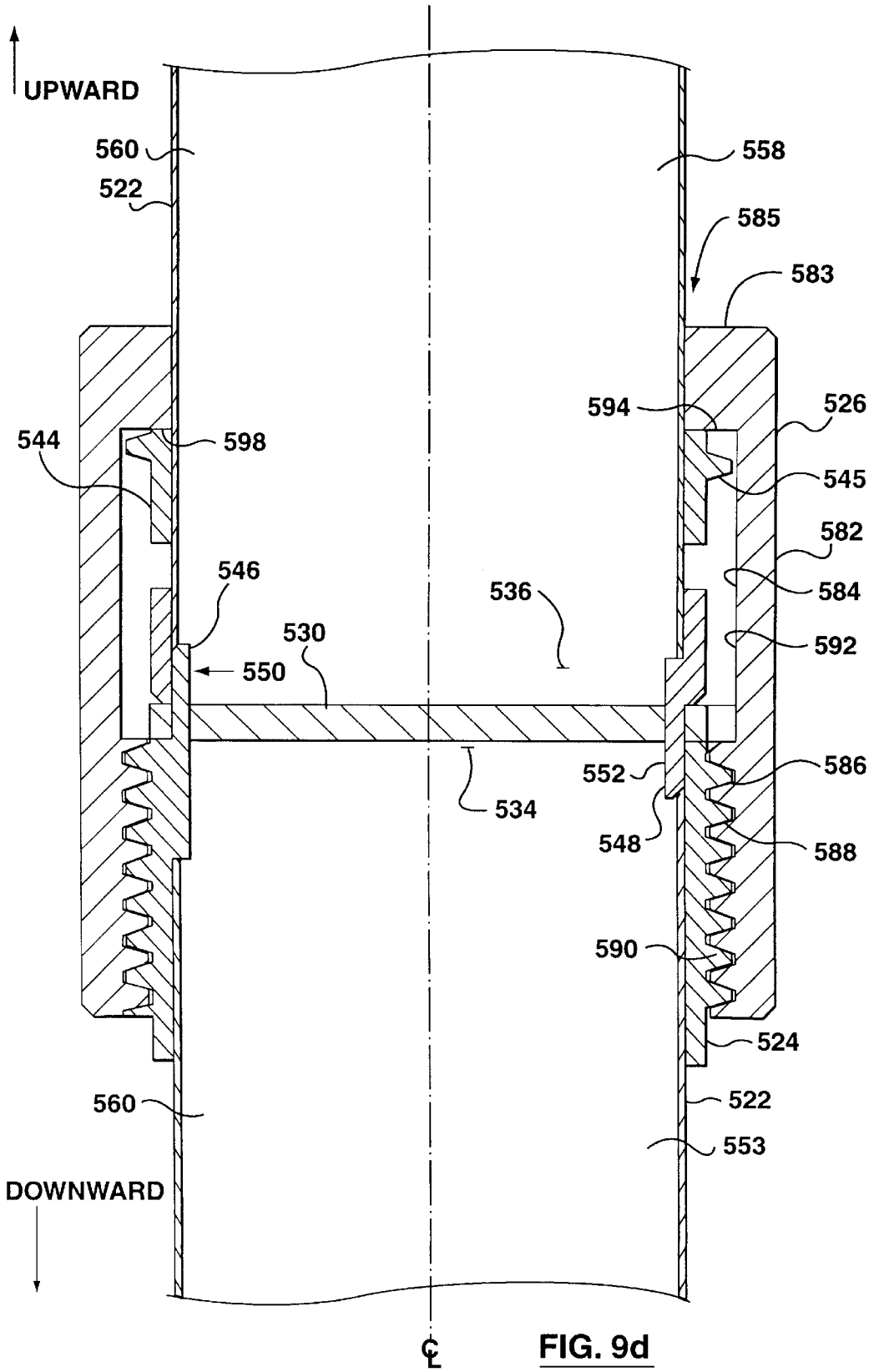
FIG. 9*d* is a cross-sectional view of the pipe assemblies of FIG. 9*a* showing the join.

In the cross-section of FIG. 9*d*, a pair of assemblies 520 are shown as connected in an engaged or coupled position. Female coupling 526 has a circular cylindrical body 582 having an internal bore 584 defined therewithin. At one end body, 582 has an end wall 583 having an opening 585 defined centrally therein, opening 585 being sized to fit closely about casing 522. At the other end body 582 has a cylindrical land 586 that has an internal thread 588 for mating engagement with the external male thread 590 of male fitting 524 of an adjacent assembly 520.

Body 582 also has an internal relief 592 defined therein. Relief 592 is bounded by a first shoulder 594, on its nominally upward end. As assembled, first shoulder 594 bears against the upward facing annular end face 598 of start flange 544, and, as female internal thread 588 engages male external thread 590, the upper and lower assemblies 520 are drawn together, compressing seal 530 in the process.

When the upper and lower assemblies 520 are not joined together, female coupling 526 is backed off such that the first turn of internal thread 588 downstream of relief 592 engages the single external thread 545 of start flange 544. This results in female coupling 526 being held up at a height to permit a well worker to make sure that seal 530 is in place on the downward assembly 520, and indexed correctly relative to dogs 546 and 548, before the two units are joined together.

Figure 11C:
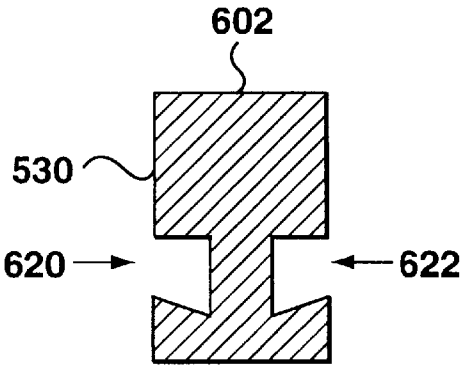
FIG. 11*c* is a detail of a portion of the cross-section of the seal of FIG. 11*b;*
Figure 11B:
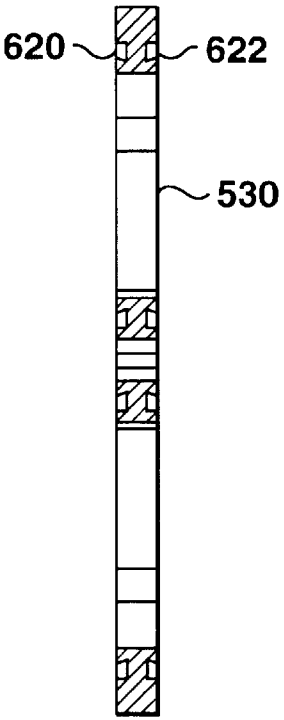
FIG. 11*b* is a diametral cross-section of the seal of FIG. 11*a;*
Figure 11A:
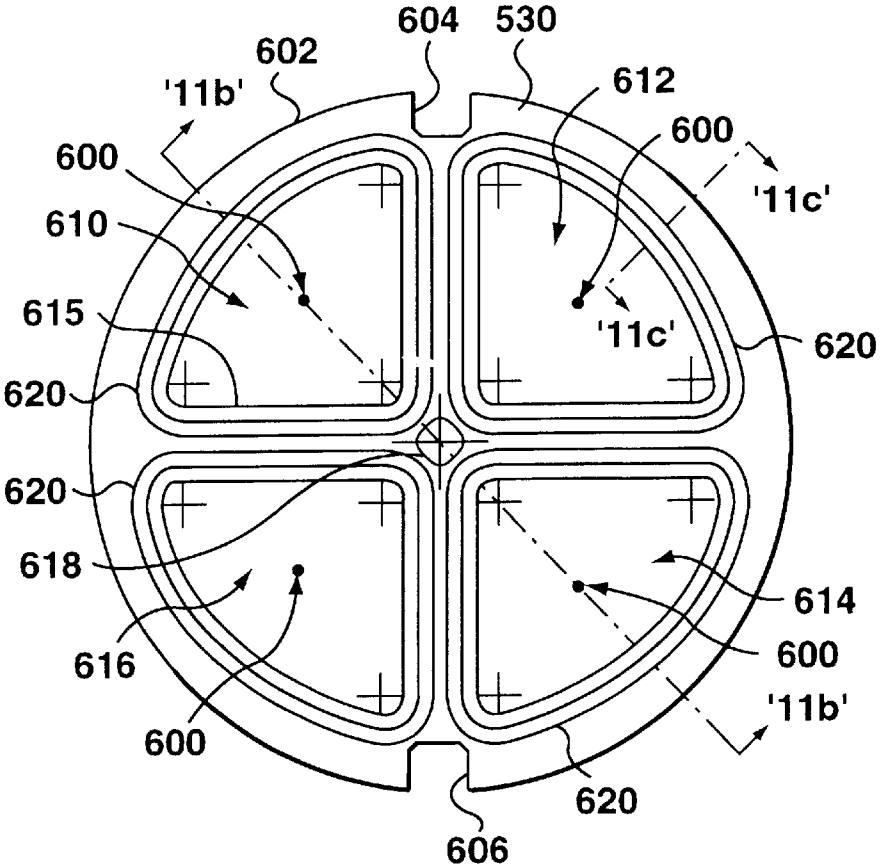
FIG. 11*a* is a plan view of a seal for the pipe assemblies of FIG. 9*a;*

Seal 530 is shown in plan view in FIG. 11*a*. It has a circular external circumference 602, with first and second dog locating notches 604 and 606 shown diametrally opposed from each other, notches 604 and 606 acting as alignment governors, or indexing means. When located on the end of a pipe assembly 520, notch 604, for example, locates on dog 546, and when two such pipe assemblies are joined, the other dog, namely dog 548 of the second pipe assembly, will locate in the opposite notch, namely notch 606. Although the preferred embodiment is shown in FIG. 11*a*, the notches need not be on 180 degree centers, but could be on an asymmetric, or offset 90 degrees, such as may be suitable for ensuring that the dogs line up as indexing devices to ensure that adjoining sections of pipe, when assembled have the correct passages in alignment. Seal 530 has four quarter pie shaped openings 610, 612, 614, and 616 defined on 90 degree centers, such as correspond to the general shape of the cross-section of passageway 580 of each of tubes 554, 556, 558 and 560. With these openings so defined, seal 530 is left with a four-armed spider 615 in the form of a cross. A fifth, rather smaller, generally square aperture 618, is formed centrally in spider 615, such as may be suitable for permitting the passage of electrical wires for a sensing or monitoring device. As can be seen in the sectional view of FIGS. 11*b* and 11*c*, seal 530 has grooves 620 and 622 formed on opposite sides (that is, front and back, or upper and lower as installed), each of grooves 620 and 622 having the shape, in plan view, to correspond to the shape of a protruding lip of the end of each of tubes 554, 556, 558 and 560. The mating shapes locate positively, again ensuring alignment, and, when squeezed under the closing force or female coupling 526, a seal is formed, tending to maintain the integrity, that is, the segregation, of the various passageways from pipe to pipe as the string is put together.

The approximate centroids of the passages of tubes 554, 556, 558, and 560 are indicated as 600. It will be noted that unlike nested pipes, whether concentric or eccentric, none of the passages defined within any or the respective pipes is occluded by any other pipe, and none of the centroids of any of the pipes fall within the profiles of any of the other pipes. Put another way, the hydraulic diameter of each of the pipes is significantly greater than the hydraulic diameter that would result if four round cylindrical tubes were nested concentrically, one inside the other, with equivalent wall thicknesses. The useful area within casing 522 may also tend to be greater since the sum of the peripheries of the tubes, multiplied by their thickness may tend to yield a lesser area than the wall cross-sectional area of four concentric pipes.

Figure 15A:
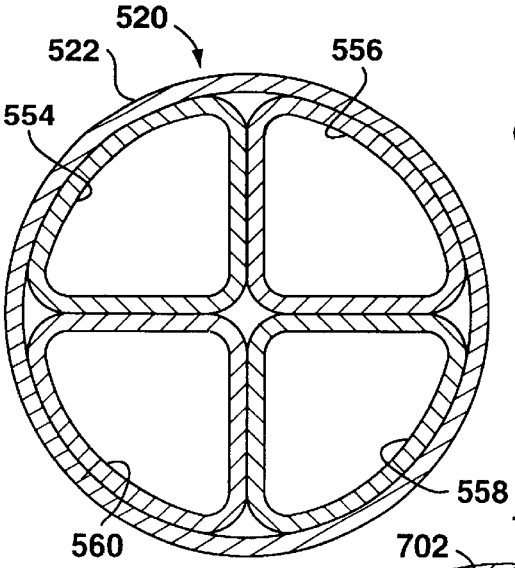
FIG. 15*a* shows a cross-sectional view of the tube assembly of FIG. 9*a* taken on section '15*a*—15*a'*.

The embodiment of FIG. 15*a* is currently preferred. Such an embodiment has a number of advantages. First, all of the pipe segments are of the same cross-section, which simplifies manufacture, assembly and replacement. Second, in an application where the multi-passage conduit assembly so obtained is used to drive a down-hole hydraulic pump, one passage can be used to carry hydraulic fluid under pressure, another passage can be used to carry the hydraulic fluid return flow, a third passage can carry the production fluid that is to be pumped out of the well, and the fourth passage or the central gap can be used for electrical cabling, such as may be required for monitoring equipment.

Figure 12A:
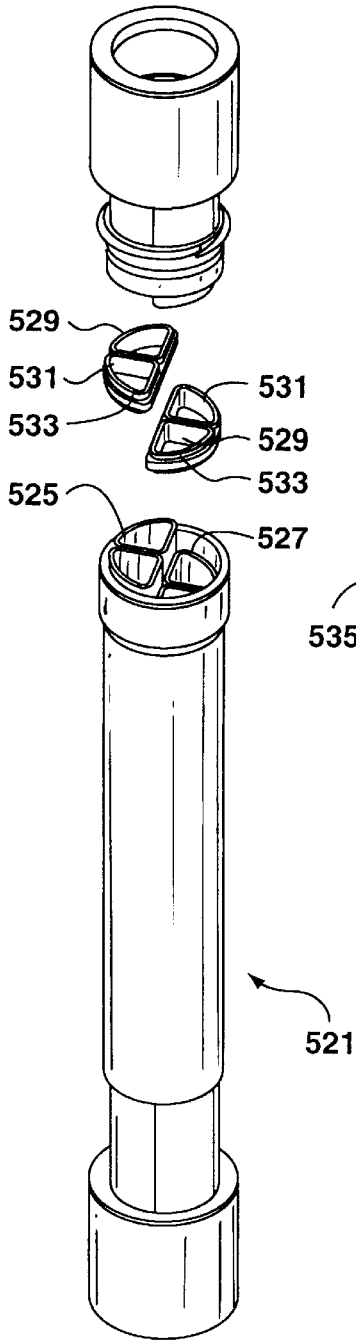
FIG. 12*a* shows an isometric view of an alternate assembly to that of FIG. 9*a;*
Figure 12B:
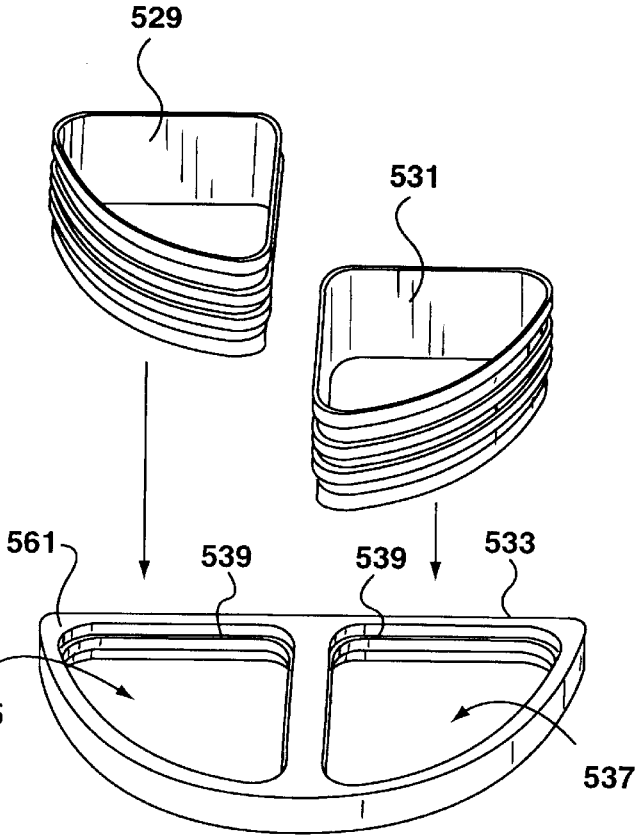
FIG. 12*b* is a detail view of a seal for the assembly of FIG. 12*a;*
Figure 12C:
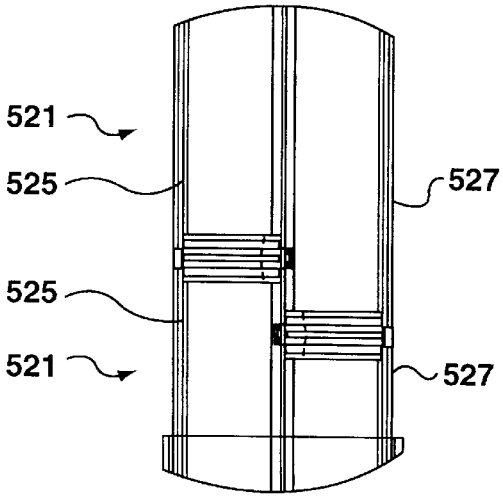
FIG. 12*c* is a detail of a portion of the assembly of FIG. 12*a* as assembled.
Figure 13C:
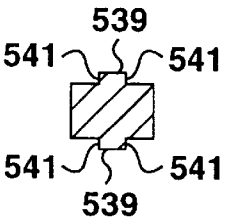
FIG. 13*c* is a detail of a cross-section of the seal retainer of FIG. 13*a;*
Figure 13B:
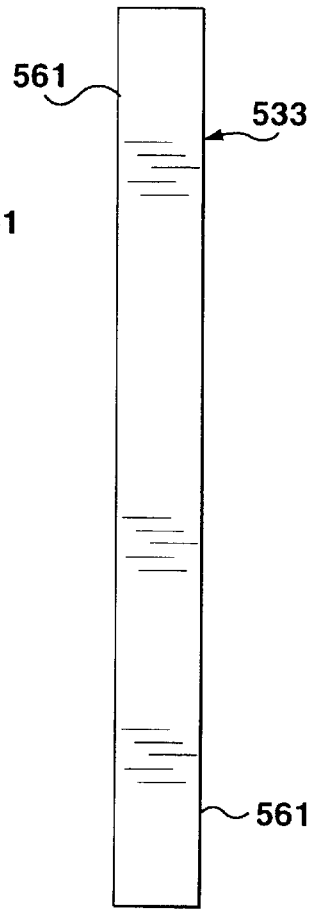
FIG. 13*b* is a side view of the seal retainer of FIG. 13*a;*
Figure 13A:
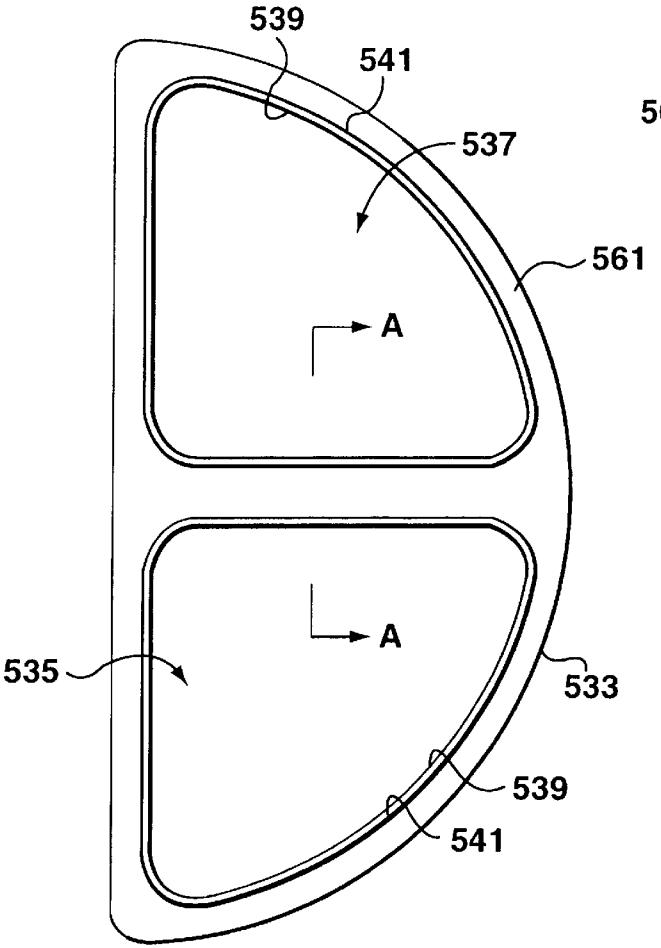
FIG. 13*a* is a plan view of a seal retainer for the pipe assemblies of FIG. 12*a;*

FIGS. 12*a* to 12*c* show an alternative embodiment to pipe assembly 520, namely pipe assembly 521. As above, the general arrangement of quarter-pie-shaped tubes, the use of retaining. collars, and the use of male and female fitting to draw adjacent pipe joints together is generally as described above. Assembly 521 differs from assembly 520 in that one pair of the pie-shaped pipes 525 is longitudinally stepped relative to another pair 527, permitting the elimination of dogs 546 and 548. To accommodate this step, each of pairs 525 and 527 is provided, at its joining interface with a corresponding adjacent pair of an adjacent pipe joint, with a pair of seals 529, 531, and a seal retainer 533. In the example shown in FIGS. 12*a*, 12*b*, 13*a*, 13*b* and 13*c*, seal retainer 533 is a frame having a semicircular shape, in plan view, with a pair of quarter-pie shaped openings 535, 537 defined therein. The peripheral wall of each of openings 535 and 537 has an inwardly protruding medial rib, or ridge, 539 having upward and downward facing shoulders 541.

Figure 14C:
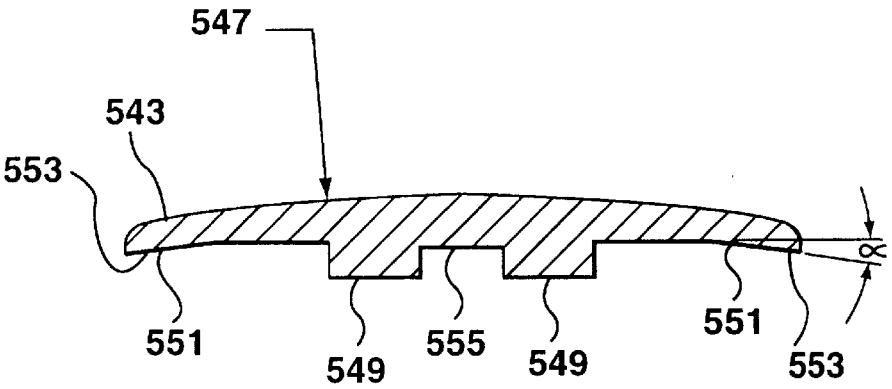
FIG. 14*c* is a detail of a portion of the cross-section of the seal of FIG. 14*b;*
Figure 14A:
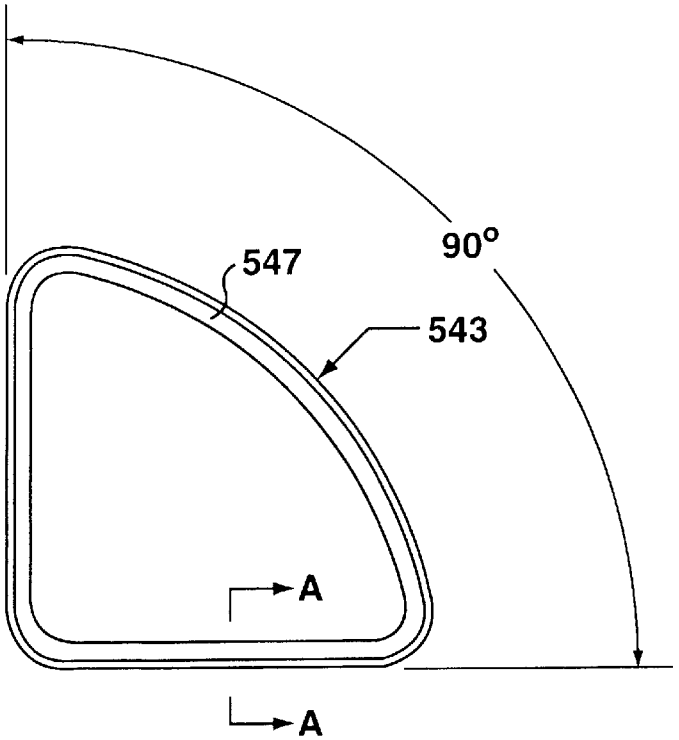
FIG. 14*a* is a plan view of a seal for the pipe assemblies of FIG. 12*a;*
Figure 14B:
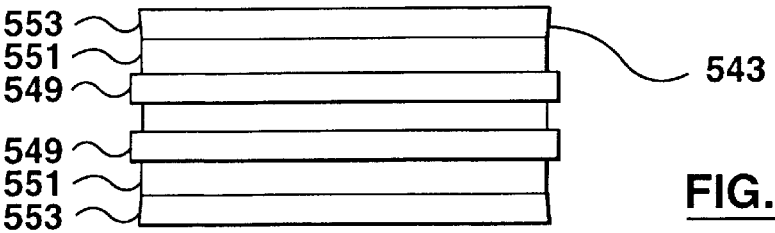
FIG. 14*b* is a diametral cross-section of the seal of FIG. 14*a;*
Figure 14F:
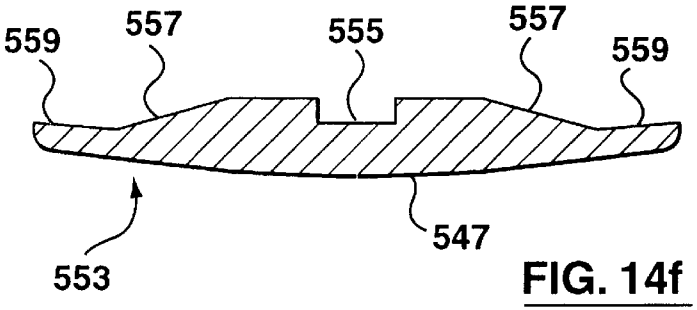
FIG. 14*f* is a detail of a portion of the cross-section of the seal of FIG. 14*e;*
Figure 14D:
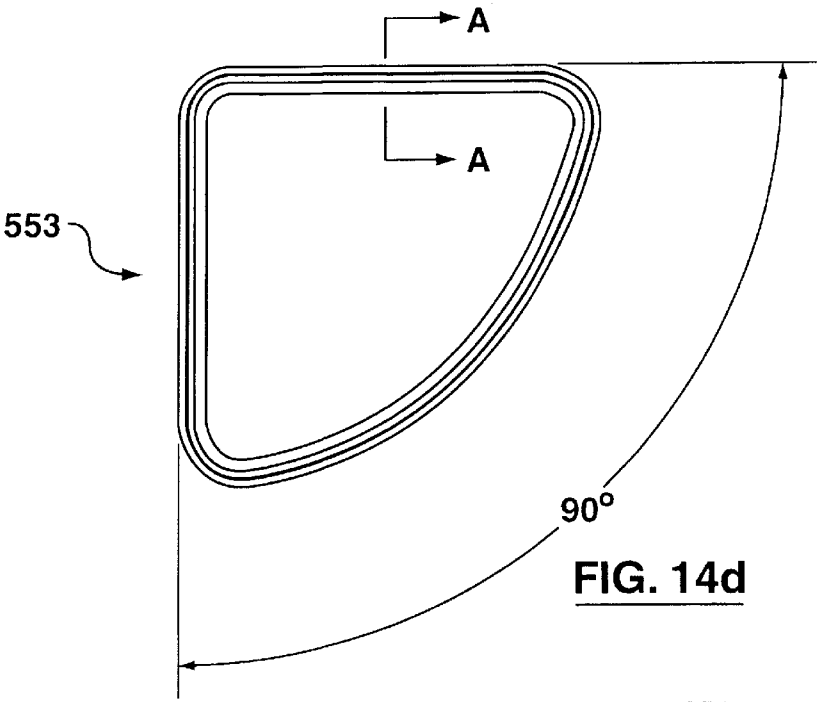
FIG. 14*d* is a plan view of an alternative seal for the assembly of FIG. 12*a;*
Figure 14E:
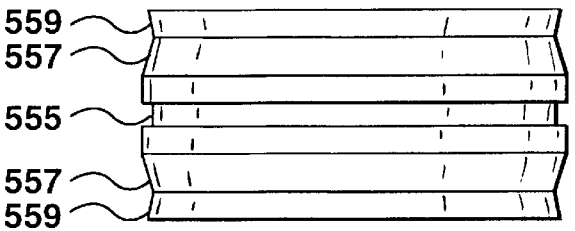
FIG. 14*e* is a diametral cross-section of the seal of FIG. 14*d;*

Two alternative examples of seal are shown for engaging, that is, seating within, retainer 533. In FIGS. 14*a*, 14*b* and 14*c*, a quarter-pie shaped seal 543 has an internal peripheral arcuate face 547 that, when installed, faces, and defines a portion of the flow passageway for, the fluid to be transported. On the opposite, or back face, seal 543 has a pair of outwardly protruding external ribs 549, defining a square shouldered rebate 555 between them sized to engage ridge 539 of retainer 533. To either longitudinal side of ribs 549, seal 543 has a pair of pipe-wall engaging lands, 551. The skirts formed by the distal edges 553 of lands 551 are flared outward a small amount (for example, about 4 degrees). In use, engagement with the mouth of a similarly shaped tube will necessitate inward deflection of the flared ends, forming a snug interference fit. Alternatively, as shown in FIGS. 14*d*, 14*e* and 14*f*, a quarter-pie shaped seal 553 is generally similar to seal 543, having a relief 565 for engaging ridge 539, but rather than having square shoulders, have tapered shoulders 557 leading to lands 559. In use seal 543, or 553, is mated with each aperture in retainer 533, and seated on the end of one of the tube pairs. The flat faces 561 of retainer 533 bear against the end faces of the respective tube pairs.

It is not necessary that equal pairs of tubes be stepped to give an indexing feature to the assembly. For example, rather than a pair, a single pipe could be advanced to give a unique assembly orientation. A number of possible alternative configurations are possible. An advantage of the example shown in FIGS. 14*a*, 14*b* and 14*c* is that it permits use of a single type of symmetrical end seal, in a single type of retainer. That is, fewer parts need to be stocked, and the parts that are stocked can be inserted with either face up or down to achieve the same fit.

Alternative Embodiments of Conduit Members

In the alternative side-by-side embodiments of FIGS. 15*a* to 23*e*, none of the cross-sectional areas of any of the individual tube sections overlaps the area of any other, as would be otherwise be the case in a nested pipe arrangement. Further, it is a matter of mathematical calculation that the centroid of the cross-sectional area of any of the tube sections of the preferred embodiment of FIG. 15*a*, or the alternative embodiments of FIGS. 15*b* to 23*e*, lies outside the cross-sectional area of any of the other tubes that are in side-by-side relationship. The hydraulic diameter, $D_h$ of a passageway is given by the formula:

$$Dh=4A/P$$

Where:

A=Cross sectional area of the passage; and

P=Perimeter of the passage.

In each side-by-side example, whether in FIG. 15*a* or any of FIGS. 15*b* to 23*e*, the hydraulic diameter of at least two of the tubes are less than the quotient obtained by dividing the perimeter of the particular tube by $\pi$. Similarly, in each of the side-by-side examples provided in FIG. 15*a* and FIGS. 15*b* to 23*e*, the cross-sectional area of at least two of the tubes is less than the square of the perimeter divided by $4\pi$.

Figure 15B:
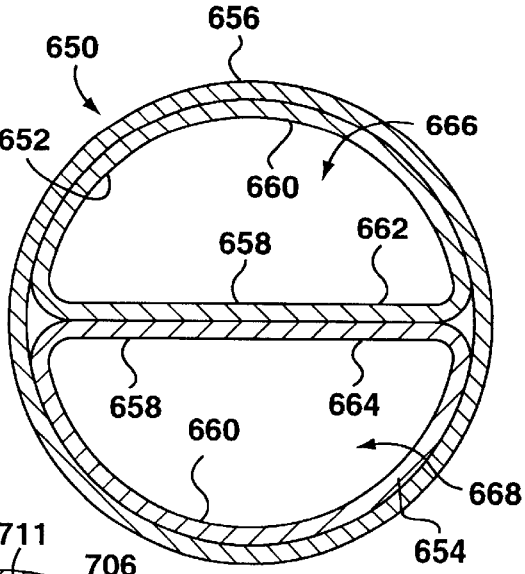
FIG. 15*b* shows a cross-sectional view of an alternate tube assembly to that of FIG. 15*a*, having a pair of semi-circular tubes mounted side-by-side.

In the alternative embodiment of FIG. 15*b*, a pipe assembly 650 has a pair of semi-cylindrical tubes 652 and 654 nested in a side-by-side manner within an outer casing 656. Each of semi-cylindrical tubes 652 and 654 has a tube wall that has a flat portion 658, and an arcuate portion 660, joined at smoothly radiused corners to form a semi-circular D-shape as shown. As above, tubes 652 and 654 are seamless steel tubes of a known pressure rating that have been roll formed through progressive dies to achieve the smoothly radiused D-shape shown.

The tube walls of tubes 652 and 654 each have an internal surface 662 or 664 defining an internal passageway 666, 668 along which fluids can be conducted. Each passageway has a cross-sectional area, neither cross-sectional area overlapping the other, and neither having a centroid lying within the cross-sectional area of the other. The external surfaces of flat portions 658 of tubes 652 and 654 engage along a planar interface lying on a diametral plane of casing 656. As above, casing 656 is shrink fit about tubes 652 and 654, creating a tensile pre-load in casing 656, and a compressive pre-load in arcuate portions 660 of tubes 652 and 654. A seal of suitable shape is used in place of seal 530 described above at the connections between successive tube assemblies.

In this kind of two tube embodiment, water (or another suitable working fluid) can be used as the working fluid to drive the downhole pump, such that one passage such as passage 668 carries water under pressure down to the pump, and the other passage 666 carries both the production fluid and the return flow of the water used to drive the pump. Such a system may tend to require a relatively large supply of clean working fluid. The working fluid and the production fluid will tend to need to be separated at the surface, so a significant settling or other separation system may tend to be required.

In a two tube arrangement, it is not necessary that the two tubes have cross-sections of equal area. For example, as shown in pipe assembly 670 of FIG. 15*d*, depending on the pressures in the tubes, it may be desired that the pressure supply flow (in the downward passage) be rather smaller than the return flow (in the upward passage), which carries both the working fluid and the production fluid. Since line losses vary with the square of mean flow velocity, it may be desired for the smaller volumetric flow to be carried in a smaller tube. Hence down flow tube 672 is smaller in cross-sectional area than return flow tube 674. That is, the corresponding flat portions 676 and 678 of tubes 672 and 674 do not have a diametral surface, but rather run along, and have an abutting interface at, a chord 675 offset from the diametral centerline 679.

Figure 15C:
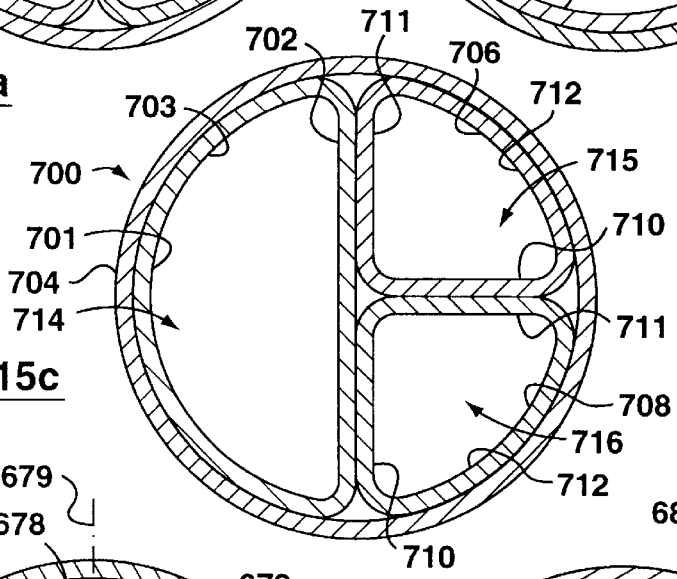
FIG. 15*c* shows a cross-sectional view of an alternate tube assembly to that of FIG. 15*a*, having three passages, one being larger than the other two.
Figure 15D:
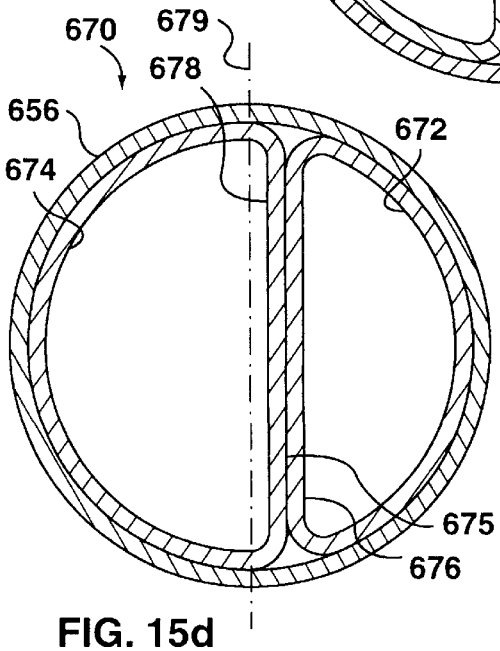
FIG. 15*d* shows a cross-sectional view of an alternate tube assembly to that of FIG. 15*b*, having two tubes, one being larger than the other, the tubes meeting on a chord of a circle offset from the diametral plane.
Figure 15E:
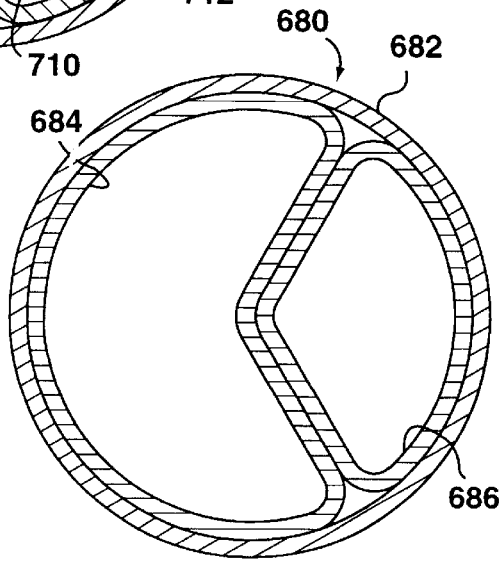
FIG. 15*e* shows a cross-sectional view of an alternate tube assembly to that of FIG. 15*d*, having two tubes, one being larger than the other two, the tubes meeting on radial planes.

Although the offset in FIG. 15*d* is achieved along an offset chord, this need not be the case. As shown in FIG. 15*e*, a pipe assembly 680 has an outer casing 682 shrink fit about two internal tubes 684 and 686. The smaller of these, tube 686, has the shape of a pie shaped piece, with radiused corners, subtending a minor arc of the circular inner face of casing 682. The large piece 684, has the shape of the remainder of the pie, with smoothly radiused corners. The side portions of tubes 684 and 686 meet along planar interfaces that extend radially relative to the axial centerline of casing 682.

Figure 16A:
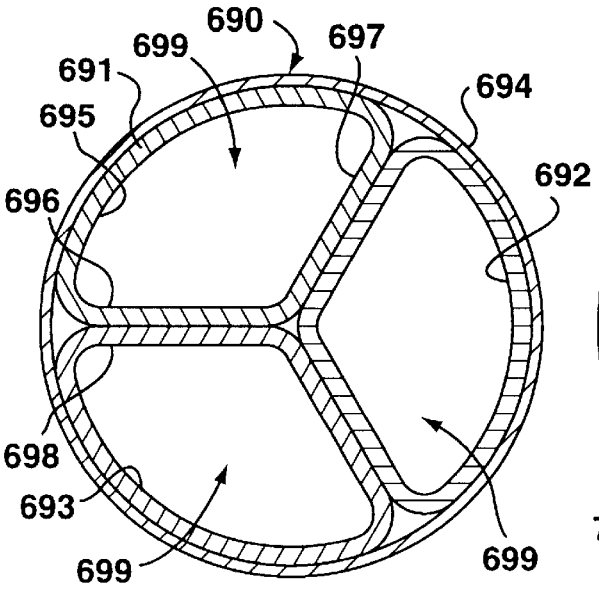
FIG. 16*a* shows a cross-sectional view of an alternate tube assembly to that of FIG. 15*a*, having three equal sized passages with radially extending webs.
Figure 16B:
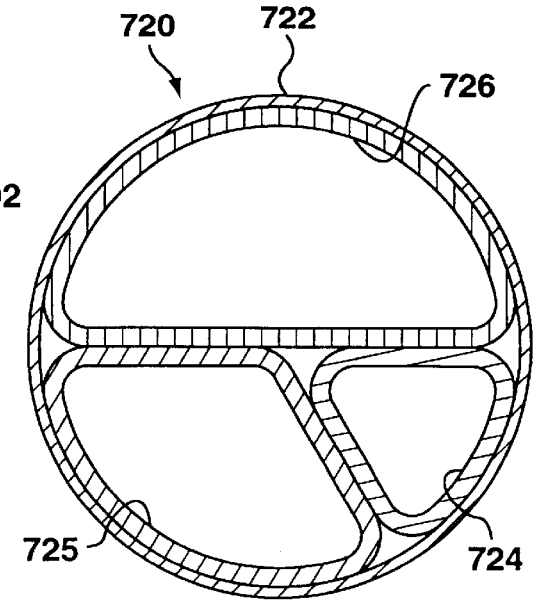
FIG. 16*b* shows a cross-sectional view of an alternate tube assembly to that of FIG. 15*a*, having three unequal tubes with radially extending webs.

In the alternative embodiment of FIG. 16*a*, a pipe assembly 690 has a set of three tubes 691, 692 and 693 of equal passage size. Each of tubes 691, 692 and 693 occupies one third of the area within shrink fit casing 694, and has side wall portions 696 and 697 that extend radially outward from the center of casing 694 and an arcuate circumferential portion 695 that is placed in mating engagement with casing 694. The inner face 698 of each of tubes 691, 692 or 693 defines an internal passageway, 699, having a cross sectional area that is roughly 120 degrees of arc, or ⅓ of the area: of casing 694, less the thickness of the walls forming the periphery of passageway 699.

A three pipe embodiment of pipe assembly is shown in FIG. 15*c* as 700. In a three pipe embodiment, one pipe can be used, for example, to carry hydraulic fluid under pressure, such as to drive a downhole hydraulic pump; a second pipe can provide the return line; and the third pipe provides the conduit by which production fluid is conveyed to the surface. This may tend to avoid mixing of the return and production fluid flows in the return of a two pipe system, and may also tend to avoid the need for a large settling or separation system at the discharge end of the production flow pipe. Alternatively, the working fluid can be fed down one pipe, production fluid and the return of the working fluid can be provided by a second of the three pipes, and the third pipe can carry electronic cables.

In pipe assembly 700 a first roll-formed tube of known pressure rating is shown as 701. It is roughly semi-circular in shape, with radiused corners. It has a flat portion 702 and an arcuate portion 703 for mating engagement within the round cylindrical inner surface of a shrink fit casing 704. Second and third tubes 706 and 708 have the shape of quarter-pie pieces, each with radiused corners. Each has first and second flat 710, 711 portions meeting at a right angled radiused corner, the flat portions extending more or less radially outward to meet an arcuate portion 712 suited for engaging an arc of the circumferential inner face of casing 704. The various flat portions of tubes 701, 706 and 708 meet on radial planes of casing 704. Each of tubes 701, 706 and 708 has an internal face defining the periphery of a passageway, 714, 715, 716 respectively, each passageway having a cross-sectional area defined within that periphery.

The various pipes need not necessarily be of the same size, particularly if the flow of working fluid for driving the pump is under high pressure, but relatively low flow. It may be preferable for the cross-section of the passage for conveying the production fluid, namely 714 to be larger than the others, as shown in the embodiment of FIG. 15*c*, particularly since line losses tend to vary in turbulent flow as the square of the mean velocity of the fluid, and the mean velocity of the fluid is determined by dividing the volumetric flow by the passage area. Given that the pressure and return lines are carrying very nearly the same volumetric flow rate of a largely incompressible fluid (differing only to the extent of the pressure difference multiplied by the bulk modulus of compression of the fluid at the given operating temperature), pressure and return passages 715 and 716 can most conveniently be made the same size, as shown in this embodiment.

As with the example of FIG. 15*c*, the pie-shaped tubes need not be of equal size. Thus, in FIG. 16*b*, a pipe assembly 720 has an external casing 722 and three internal tubes 724, 725 and 726, which are in other ways similar to tubes 691, 692 and 693, except that tube 724 subtends a pie shape of about ⅙ of casing 722, tube 725 subtends a pie shape of about ⅓ of casing 722, and tube 726 subtends about ½ of casing 722. In this case, if for example, a gas under pressure such as air or steam, or an inert gas, is used as the driving fluid to operate a pneumatic pump, the return line, at lower pressure, may need to have a larger cross-sectional area to keep gas velocity somewhat lower.

Figure 17A:
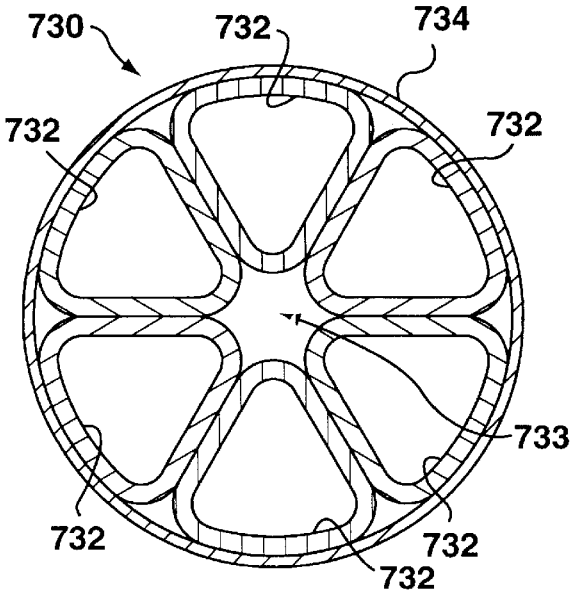
FIG. 17*a* shows a cross-sectional view of an alternate tube assembly to that of FIG. 15*a*, having six equal pie-shaped passages.
Figure 17B:
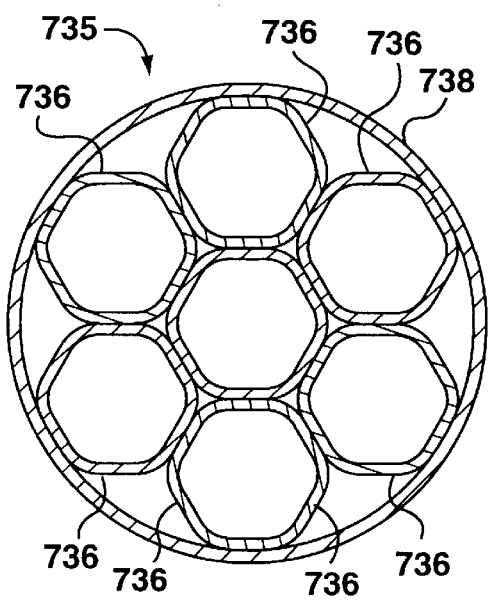
FIG. 17*b* shows a cross-sectional view of an alternate tube assembly to that of FIG. 15*a*, having seven hexagonal tubes.

FIG. 17*a* shows a pipe assembly 730 having a set of six equal side-by-side pie-shaped tubes 732 contained within an external cylindrical casing 734. Each of tubes 732 is a roll-formed tube similar to tube 726, above. As the number of tubes in the bundle increases, and given the need for a reasonable radius on the roll-formed tubes, the size of the gap 733 at the center of the bundle increases, and becomes a significant passageway for cables or other wiring as may be desired. A central tube can also be obtained as shown in FIG. 17*b* in which a tube assembly 735 has a cluster of smoothly radiused, side-by-side hexagonal tubes 736 retained within an external casing 738. In such an assembly each of the available tubes can be used for a different function, or, alternatively, the operator can select two or more hexagonal tubes for one purpose, another pair for another purpose, and the remaining two for yet some other purpose or purposes. The selection of tubes is associated with the provision of an appropriate downhole manifold and well-head manifold, and suitable seals between successive the pipe assembly sections to maintain segregation between the various passageways.

Figure 18A:
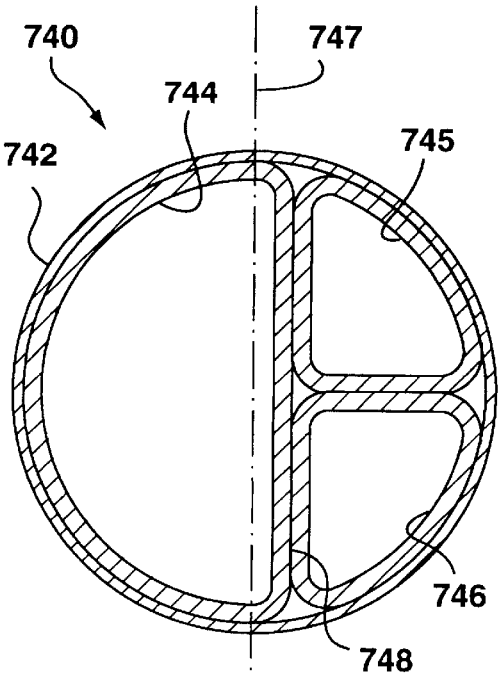
FIG. 18*a* shows a cross-sectional view of an alternate tube assembly to the tube assembly of FIG. 15*c*, in which the largest passage occupies more than half the tube area.
Figure 18B:
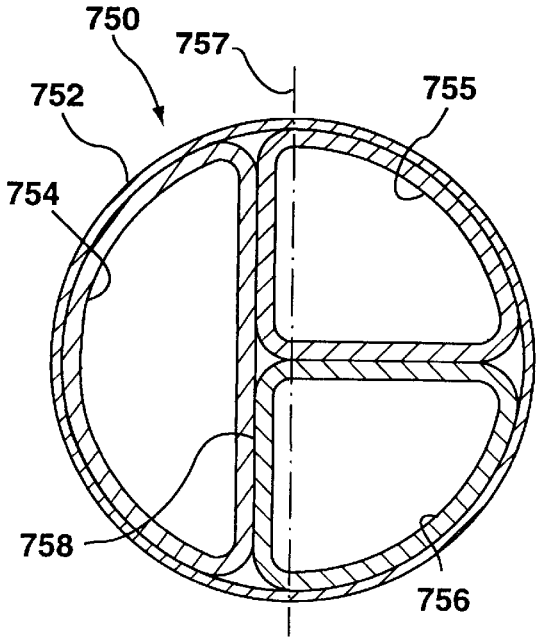
FIG. 18*b* is similar to FIG. 18*a*, but shows a tube assembly having three tubes, and in which one tube occupies a minor sector of the tube area.

FIGS. 18*a* and 18*b* show alternative configurations to that of FIG. 15*c*. In FIG. 18*a* a pipe assembly 740 has an external casing 742 and three internal tubes 744, 745 and 746, each having an internal wall defining the periphery of an internal passage. Tubes 745 and 746 are mirror images of each other, and tube 744 is rather larger such that the flat interface of tube 744 with tubes 745 and 746 lies along a chord 748 offset from the diametral plane 747 of casing 742. Tube 744 occupies more than half of the inner cross-sectional area of casing 742. FIG. 18*b* shows a pipe assembly 750 having a casing 752 and three internal tubes 754, 755 and 756, each having an internal wall defining the periphery of an internal passage. Tubes 755 and 756 are mirror images of each other, and tube 754 occupies the remainder of the cross-sectional area not occupied by tubes 755 and 756. The flat interface of the external surface of the flat portion of tube 754 with the external surface of flat portions of tubes 755 and 756 lies along a chord 758 offset from the diametral plane 757 of casing 752 such that tube 754 occupies less than half of the cross-sectional area of casing 752.

Figure 18C:
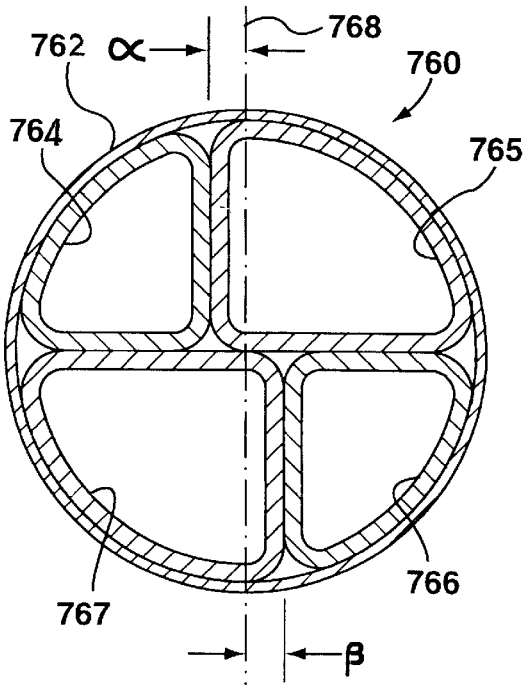
FIG. 18*c* shows a cross-sectional view of an alternate tube assembly to that of FIG. 15*a*, having two unequal pairs of tubes with non-radial webs.

FIG. 18*c* shows an embodiment of a four tube variation of the embodiments of FIGS. 18*a* and 18*b*. In this instance a tube assembly 760 has a retainer in the nature of an external casing 762 and four internal roll-formed tubes 764, 765, 766, and 767. Tubes 764, 765, 766 and 767 are of unequal sizes. The planar interface between the external surfaces of tubes 764 and 765 lies on a chord that is offset from a diametral plane 768 by a step distance $\alpha$, and the interface between the external surfaces of tubes 766 and 767 is offset from diametral plane 768 by a step distance P. In the most general case, P is not equal in magnitude to $\alpha$.

Figure 18D:
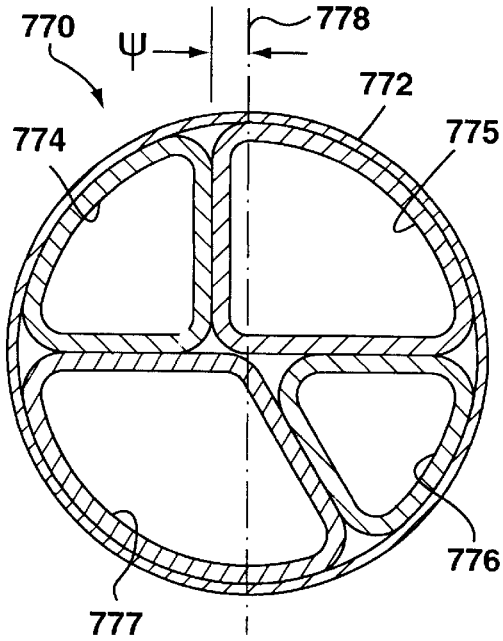
FIG. 18*d* shows a cross-sectional view of an alternate tube assembly to that of FIG. 15*a*, having four unequal tubes.

FIG. 18*d* shows a further variation of an embodiment of a four tube pipe assembly 770, having a casing 772 and four tubes 774, 775, 776, and 777. Tubes 774, 775, 776 and 777 are of unequal sizes. The planar interface between the external surfaces of tubes 774 and 775 lies on a chord that is offset from a diametral plane 778 by a step distance $\psi$. Tubes 776 and 777 are pie-shaped, and are unequal in size.

In each case, by providing tubes in a side-by side configuration, overall resistance to fluid flow in the assembly may tend to be reduced over that achievable with concentric nested pipes. It may tend also to reduce the need for spiders or other means for maintaining specific spacing of the pipes that might otherwise be required for concentric pipes. That is, the pipes are formed such that they can lie side-by-side within the outer retainer. The shape of the tube walls can be adjusted by roll forming to achieve planar interfaces between the internal pipes to give hydraulic diameters that are less than the result obtained by dividing $4A/\pi$, while continuing to use pipes that have either flat portions or concave arcuate portions. The examples described thus far do not have convex peripheral portions, such as would occur with a re-entrant curve. In a re-entrant curve, (a) the local radius of curvature extends away from the wall portion toward a local focus point and (b) the local focus point of the radius of curvature lies outside the cross-sectional area of the particular pipe.

Figure 19A:
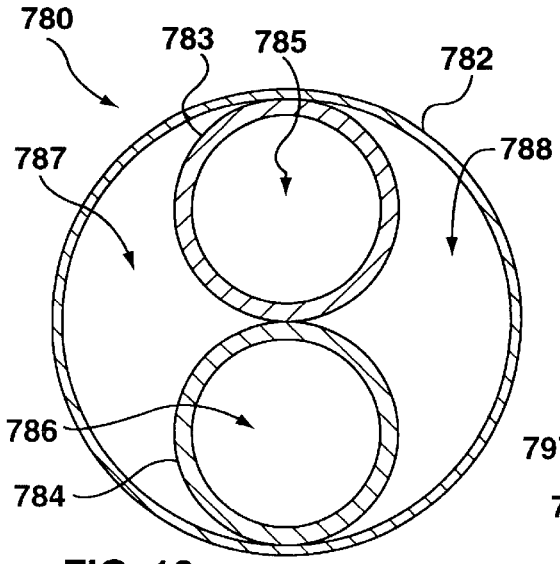
FIG. 19*a* shows a cross-sectional view of an alternate tube assembly to that of FIG. 15*a*, having two round tubes within a round casing.

In some instances it may be acceptable merely to place round pipes side-by-side within a casing. In FIG. 19*a* a two-tube pipe assembly is shown as 780. It has a round cylindrical outer casing 782 and a pair of round, internal tubes 783 and 784 mounted within casing 782 and tangent to the inside surface of casing 782. Each of tubes 783 and 784 has a known pressure rating, and each has an internal passageway 785, 786 having a periphery and a known cross-sectional area. The remaining spaces 787, 788 between the internal wall of casing 782 and the outer wall surfaces of tubes 783 and 784 can be used to carry services such as electrical cabling. In the alternative, if casing 782 has a known pressure rating, fluids under pressure can be carried in the passageways formed by spaces 787 and 788, although they have less favourable hydraulic diameters and cross-sectional shapes than might otherwise be desired.

Figure 19B:
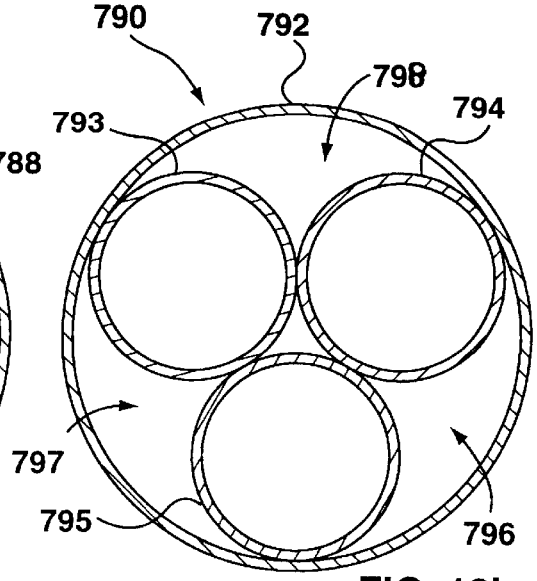
FIG. 19*b* shows a cross-sectional view of an alternate tube assembly to that of FIG. 15*a*, having three round tubes within a round casing.
Figure 19C:
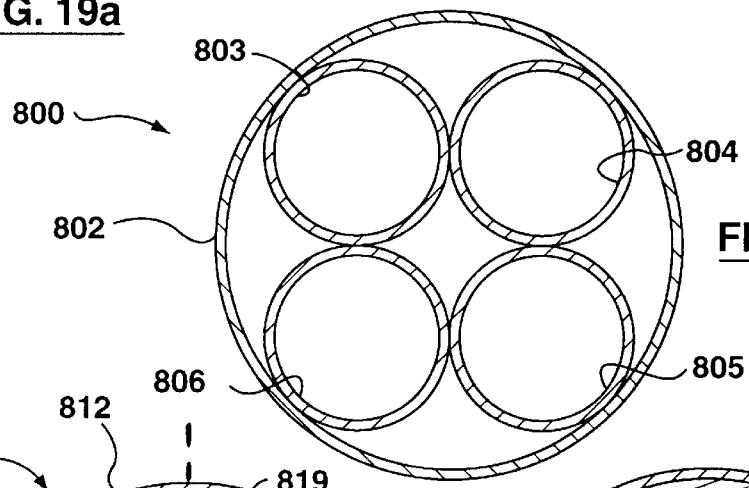
FIG. 19*c* shows a cross-sectional view of an alternate tube assembly to that of FIG. 15*a*, having four round tubes bundled within a circular outer wall.

FIG. 19*b* shows a pipe assembly 790 that differs from pipe assembly 780 in that it has an outer casing 792 housing a set of three internal tubes 793, 794 and 795 of round cylindrical section, and of somewhat smaller diameter than tubes 783 and 784. Once again, casing 792 can be a pipe of known pressure rating, and the interstitial spaces 796, 797, and 798 can be used to carry electrical or other services. FIG. 19*c* shows a further variation of pipe assembly 800, that differs from assemblies 780 and 790 by having a casing 802 and four circular internal tubes 803, 804, 805 and 806.

Figure 20A:
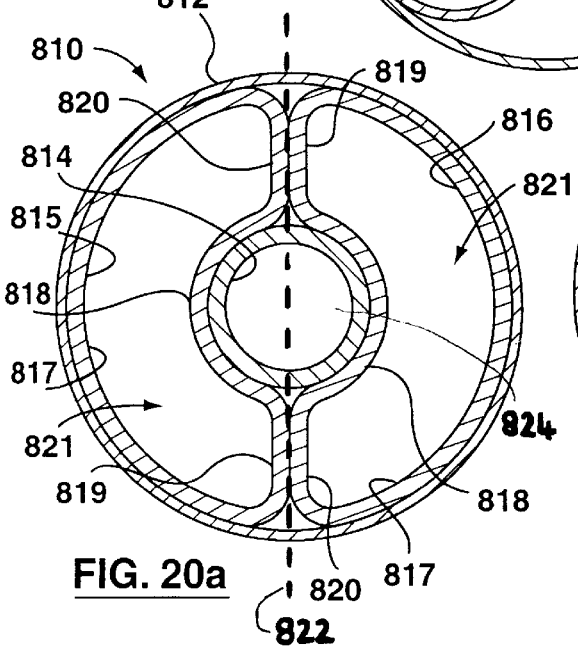
FIG. 20*a* shows a cross-sectional view of an alternate tube assembly to that of FIG. 15*a*, having two equal outer tubes arranged about a central tube.

In some cases it is also possible to improve hydraulic properties of a pipe assembly even when one or more tubes in a pipe bundle pipe have local portions that have re-entrant, or convex walls. FIG. 20*a* shows a three-tube pipe assembly 810 that has a shrink fit round cylindrical outer casing 812. A central round cylindrical pressure rated seamless steel tube 814 is located concentrically to casing 812. A pair of half-doughnut, or kidney shaped, tubes 815 and 816 are contained within casing 812 and form a sandwich about central tube 814. Each of tubes 815 and 816 has a tube wall that has an outer arcuate portion 817 of a circular arc suitable for engaging the inner surface of casing 812, and an inner arcuate portion 818, opposed to outer arcuate portion 817, that has an external surface formed on an arc suitable for engaging the outer surface of circular cylindrical tube 814. Tubes 815 and 816 also have first and second radial portions 819 and 820 that are joined to portions 817 and 818 to form a hollow, closed, kidney shape as noted, the vertices being smoothly radiused. The inner surface of this kidney-shaped wall defines the periphery of internal passage 821. Tube 816 is of the same construction as tube 815, the two tubes meeting at the planar external faces of portions 819 and 820 that lie on a diametral plane 822 of casing 812. In this instance, portion 818 is convexly curved relative to passage 821. That is, the local radius of curvature extends away from passage 821 to a local focus of the local radius of curvature that lies outside passage 821. However, the centroid of the cross-sectional area of passage 821 lies within passage 821, rather than falling within the cross-sectional area of the internal passage 824 of central tube 814.

The configuration of FIG. 20*a*, in effect, splits the annular space between central tube 814 and casing 812 in half across the diameter of casing 812, rather than by trying to nest a third pipe concentrically between central tube 814 and casing 812. The resulting passages will tend to have a combined area that is greater than can be achieved with concentric tubes of the same wall thickness, and will have larger hydraulic diameters, with a consequent reduction in resistance to fluid flow.

Figure 20B:
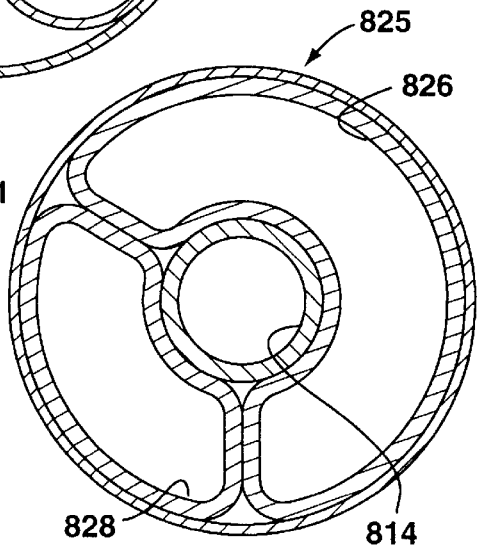
FIG. 20*b* shows a cross-sectional view of an alternate tube assembly to that of FIG. 15*a*, having two unequal outer tubes arranged about a central tube.

It is not necessary that tubes 815 and 816 be of equal size. Pipe assembly 825 of FIG. 20*b* is similar to pipe assembly 810, but rather than have kidney-shaped pipes of equal size, assembly 825 has first and second pipes 826 and 828 of unequal size, meeting on radial interfaces.

Figure 21A:
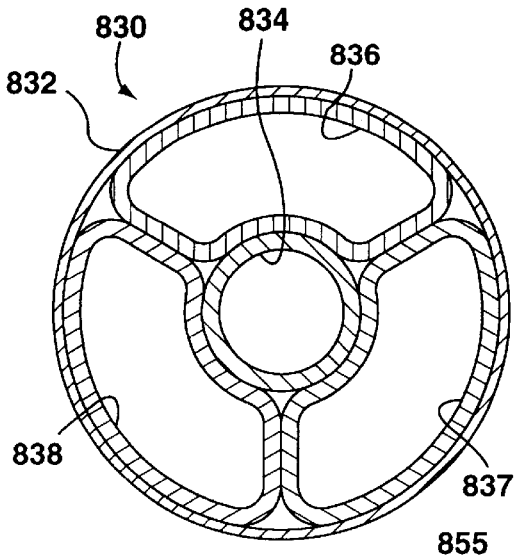
FIG. 21*a* shows a cross-sectional view of an alternate tube assembly to that of FIG. 15*a*, having three equal outer tubes arranged about a central tube.
Figure 21B:
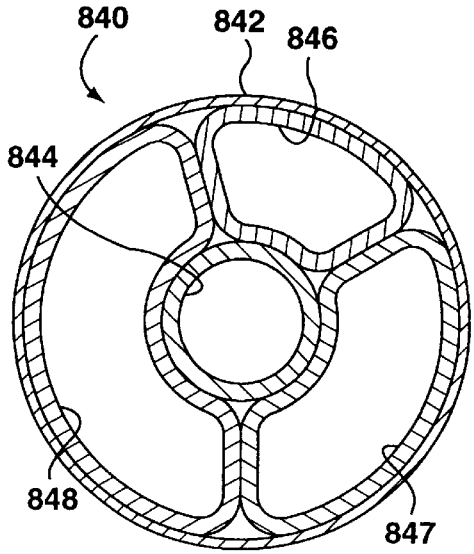
FIG. 21*b* shows a cross-sectional view of an alternate tube assembly to that of FIG. 21*a*, having three unequal outer tubes arranged about a central tube.

FIG. 21*a* shows a cross-section of another, four-tube, modular pipe assembly 830, having a casing 832, a central tube 834 mounted concentrically within casing 832, and three equal tubes 836, 837 and 838 clustered about central tube 834 and meeting at radial planar interfaces on 120 degree centers. Each of tubes 836, 837 and 838 occupies a sector that is a third of the annular space between casing 832 and central tube 834. As noted above, it is not necessary that the tubes be of equal sizes. FIG. 21*b* shows a cross-section of a modular pipe assembly 840 having a casing 842, a round cylindrical central tube 844, and three tubes of different sizes 846, 847, and 848, describing, respectively, 75, 120 and 165 degrees of arc. In general, the arcuate extent of the tubes may be chosen, with all sizes different, two the same, or three the same as may be desired or convenient.

Figure 22A:
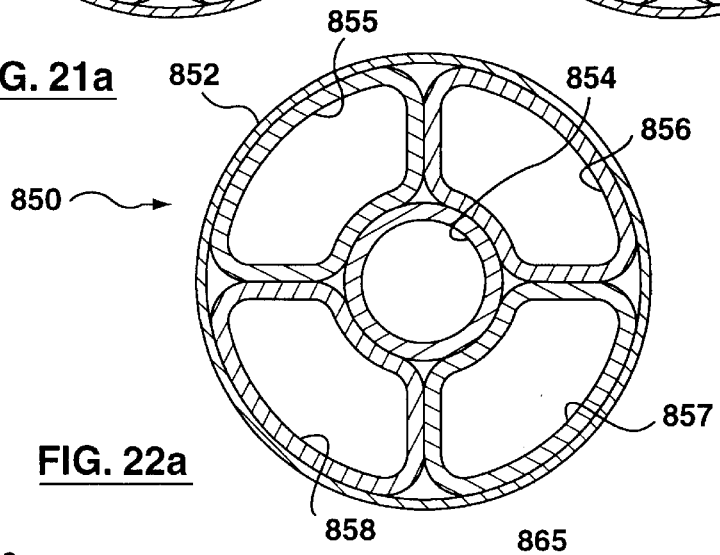
FIG. 22*a* shows a cross-sectional view of an alternate tube assembly to that of FIG. 15*a*, having four equal outer tubes arranged about a central tube.
Figure 22B:
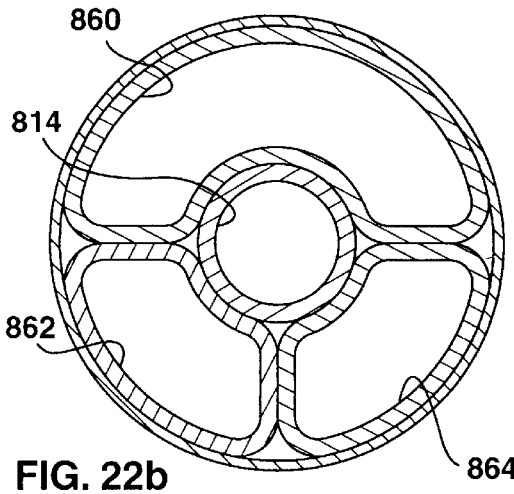
FIG. 22*b* shows a cross-sectional view of an alternate tube assembly to that of FIG. 15*a*, having four outer tubes, one larger than the others, arranged about a central tube.
Figure 22C:
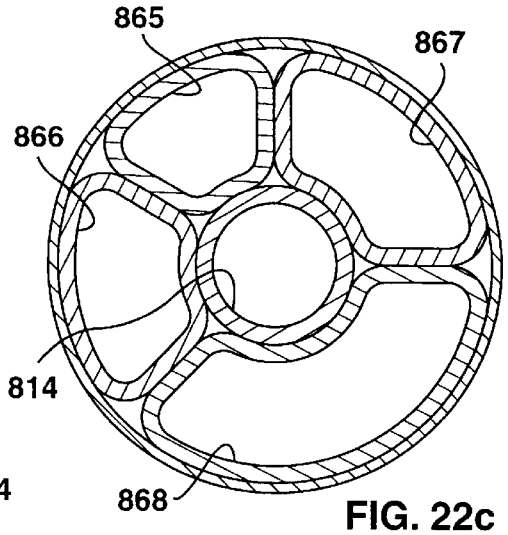
FIG. 22*c* shows a cross-sectional view of an alternate tube assembly to that of FIG. 15*a*, having four unequal outer tubes arranged about a central tube.

FIG. 22*a* shows a cross-section of a five-tube modular pipe assembly 850 having a casing 852, a central tube 854, and four equal sectoral tubes 855, 856, 857 and 858, each occupying a quarter-sector space. FIG. 22*b* shows a similar four-tube arrangement but with a single semi-sectoral tube 860, and a pair of quarter-sectoral tubes 862 and 864. FIG. 22*c* shows yet another alternative five-tube arrangement, in which each of sectoral tubes 865, 866, 867 and 868 occupies a different sized sector, being respectively 60, 75, 90 and 135 degrees of arc being radial interfaces. In general, all sizes may be different, or two, three or four sectors can be the same size as may be desired.

In each of the examples of FIGS. 20*a*, 20*b*, 21*a*, 21*b*, and 22*a*, 22*b* and 22*c*, the concentric central tube, such as tube 814, is maintained in position relative to the casing by the radial wall of the surrounding tubes. That is, the shape of the tubes occupying the annular space between the casing and the central tube is such as to act in the manner of a spider to maintain the relative position of the central tube to the casing, although the central tube and the casing do not contact each other directly. The same is true of the central hexagonal tube in the bundle of hexagonal tubes shown in FIG. 17*b*.

Figure 23A:
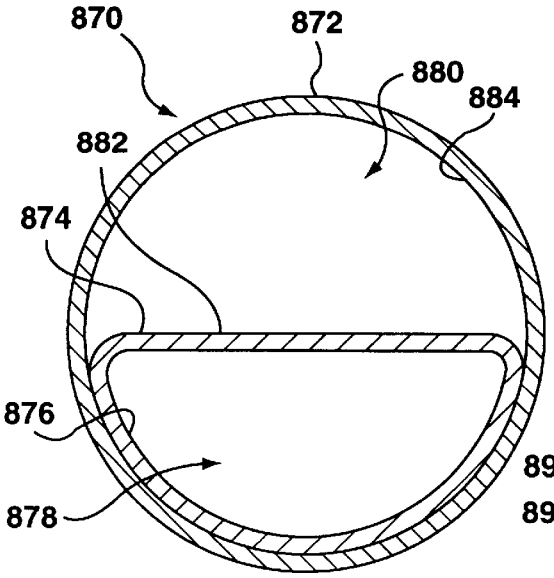
FIG. 23*a* shows a cross-sectional view of an alternative pipe assembly to that of FIG. 15*a* having a semi-circular tube nested within a circular tube.

FIG. 23*a* shows a modular pipe assembly 870 having an external casing 872 that is a seamless steel tube of known pressure rating. A roll-formed seamless steel tube 874, also of known pressure rating, is formed into a D-shape, or hollow semi-circular form. The outer wall surface of arcuate portion 876 of tube 874 is of a radius to mate with the inner surface of casing 872. When located as shown in FIG. 23*a*, a first passageway 878 is defined within the inner wall surface of tube 874, and a second passageway 880 is defined between the outer surface of straight portion 882 of tube 874 and the remaining half 884 of the inner surface of casing 872 that is not engaged by portion 876 of tube 874. The result is a two-tube configuration generally similar to that shown in FIG. 15*b* and described above. Tube 874 can be held in its nested position within casing 872 by a bonding agent, or by welding, or by other mechanical means that does not impair the integrity of the passageways.

Figure 23B:
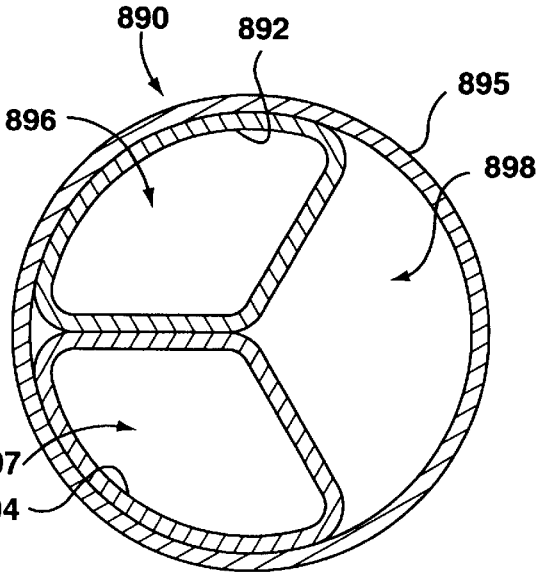
FIG. 23*b* shows a cross-sectional view of an alternate pipe assembly to that of FIG. 23*a*, having two pie-shaped side-by-side tubes nested within a circular tube.
Figure 23C:
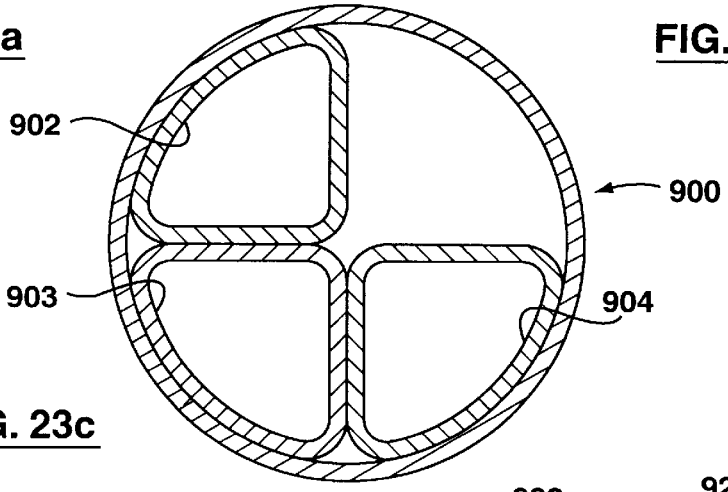
FIG. 23*c* shows a cross-sectional view of an alternate pipe assembly to that of FIG. 23*a*, having three pie-shaped side-by-side tubes nested within a circular tube.

FIG. 23*b* shows a modular pipe assembly 890 that is similar to assembly 870, but has two nested roll formed tubes 892 and 894, each occupying a sector roughly equal to ⅓ of the space within pressure rated casing tube 895, such that three side-by-side passages 896, 897 and 898 are formed. This yields a three passageway result similar to the tube bundle configuration of FIG. 16*a*. FIG. 23*c* shows a modular pipe assembly 900 that is again similar to assemblies 870 and 890, but in this case has three internal roll-formed tubes 902, 903 and 904 each occupying about a quarter sector of the space defined within outer pressure rated tube 905. This yields a side-by-side four passageway result similar to that of FIG. 15*a*. Sectoral tubes such as 892 and 894, or 902, 903 and 904 can be used singly or in equal or unequal combinations as may be suitable for a given application.

Figure 23D:
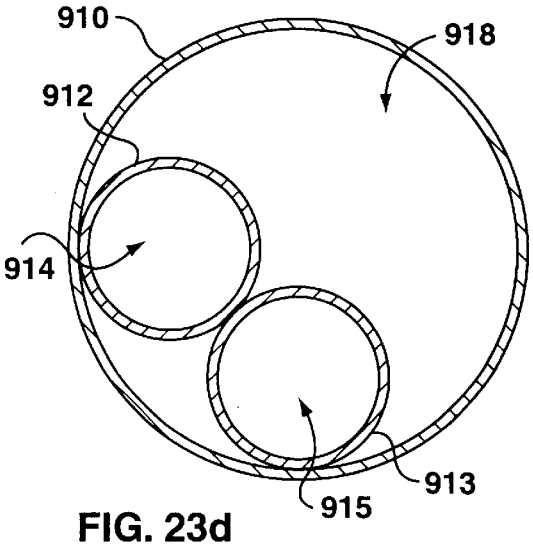
FIG. 23*d* shows a cross-sectional view of an alternate pipe assembly to that of FIG. 23*a*, having two circular side-by-side tubes nested within a circular tube.
Figure 23E:
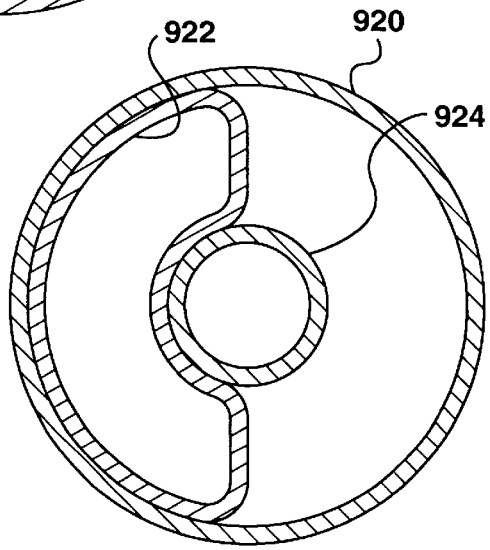
FIG. 23*e* shows a cross-sectional view of an alternate pipe assembly to that of FIG. 23*a*, similar to that of FIG. 20*a*, but having one of the non-circular tubes removed.

FIGS. 23*d* and 23*e* represent further alternatives to the assemblies of FIGS. 23*a*, 23*b* and 23*c*. In FIG. 23*d*, an outer pressure rated tube 910 has a pair of round circular tubes 912 and 913 nested side-by-side eccentrically within tube 910. This yields a pair of relatively small, round cylindrical passages 914 and 915 within tubes 912 and 913, and a larger, irregularly shaped passage 918, in the remaining space within the inner wall of tube 910. Tubes 912 and 913 can be bonded or welded in place, or can be held in place by other mechanical means, such as a bracket or spider, that does not impair the integrity of the passageways. FIG. 23*e* uses an outer pressure rated tube 920, a kidney shaped tube 922 nested within outer tube 920, and a central tube 924 nested against tube 922, concentric with outer tube 920, yielding a result generally similar to that of FIG. 20*a*.

An advantage of the alternative embodiments of FIGS. 23*a*–23*e*, is that by omitting one of the internal tubes of the analogous cross-sections of FIGS. 15*a*, 16*a*, 15*b*, 19*c*, or 20*a* (or of others of the above described cross-sections as may be suitable) the cross-sectional area otherwise occupied by the wall thickness of the omitted tube is made available for carrying fluids or other services. For a given volumetric flowrate, mean velocity is determined by the available cross-sectional area. Losses vary as the square of the mean velocity of the fluid, and hydraulic diameter also improves. For example, a 6 inch outer pipe with a 0.25 inch wall thickness, and an inner tube of 0.217 inch wall thickness, the potential increase in area for a semi-circular tube is significant. In each case, notwithstanding that one or several pipes are nested within another, the relationships of the passageways remains a side-by-side relationship, rather than a concentric relationship.

Figure 24A:
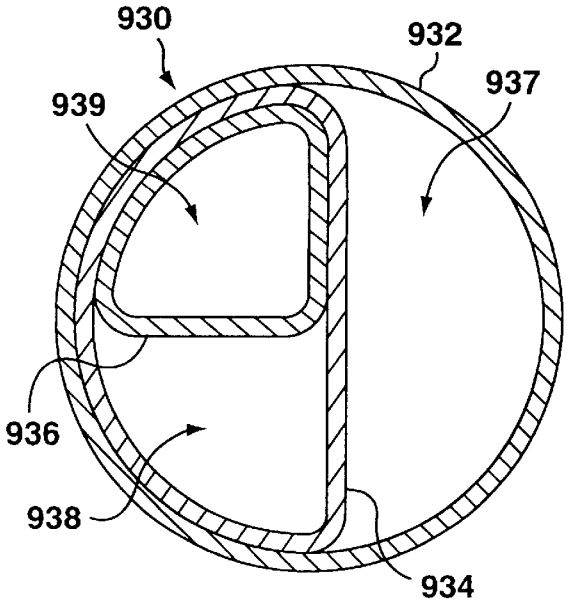
FIG. 24*a* shows a cross-sectional view of an alternate pipe assembly to that of FIG. 23*a*, having a pie-shaped tube nested within a semi-circular tube, nested within a circular tube.

FIG. 24*a* shows a modular pipe assembly 930 having an outer conduit in the nature of a seamless steel tube 932 of known pressure rating. As in the alternative embodiment of FIG. 23*a*, a second conduit member in the nature of a roll formed seamless steel tube 934 formed in the shape of a semi-circle is located within the hollow interior region defined by the inside surface of tube 932, the outer surface of the arcuate portion of tube 934 being formed to engage a portion of the inner surface of the continuous peripheral wall of tube 932. In addition, a third conduit member, in the nature of a seamless steel tube 936, roll formed into a shape of a quarter-pie piece, more or less, is located within tube 934. Tube 936 has an arcuate outer surface shaped to engage a portion, roughly half, of the inside face of the arcuate portion of the peripheral wall of tube 934 and a flat portion whose outside surface lies against a portion of the inside face of the flat portion of tube 934. As shown, this configuration of tubes defines three parallel side-by-side passages, 937, 938 and 939. Passage 937 is defined, or bounded, by half of the inside arcuate face of outer tube 932 and the outer face of the back, or straight portion of tube 934. Passage 938 is defined, or bounded, by half of the inner surface of the straight portion of tube 934, half of the arcuate inner surface of tube 934, and the outer surface of the radial leg portion of the wall of tube 936 that extends at right angles to the diametral flat portion of tube 934. Passage 939 is defined, or bounded, by the interior face of the peripheral wall of tube 936.

Figure 24B:
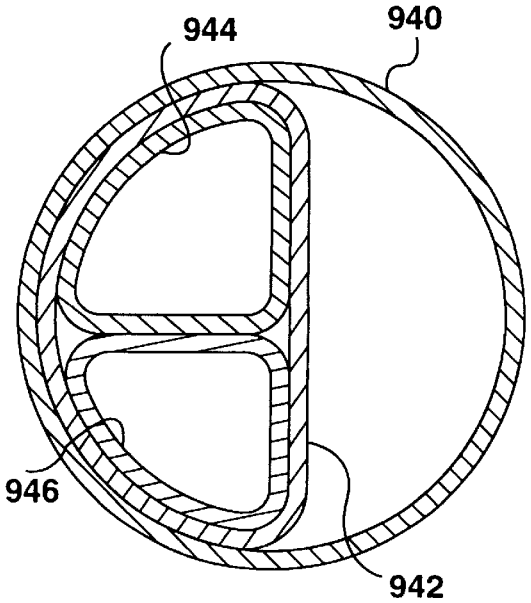
FIG. 24*b* shows a cross-sectional view of an alternate pipe assembly to that of FIG. 24*a*, having a pair of pie-shaped tubes nested side-by-side within a semi-circular tube, nested within a circular tube.

The alternative embodiment of FIG. 24*b* is similar to that of FIG. 24*a* in having a D-shaped tube 942 located within a circular tube 940, but differs to the extent that rather than having a third tube nested within tube 940, third and fourth tubes 944 and 946 are located in side-by-side arrangement within the D-shaped cavity of tube 942. As shown, tubes 944 and 946 are unequal. In the general case of either the embodiment of FIG. 24*a* or FIG. 24*b*, the pipes need not be equal in size, need not have right angled corners, and need not have straight sides lying on diametral chords of outer tube 942, but may have proportions suited for the flows to be carried, may lie on sectors of non-square angles, and may have side portions that lie on chords offset from the diameter of the respective tubes.

Figure 25:
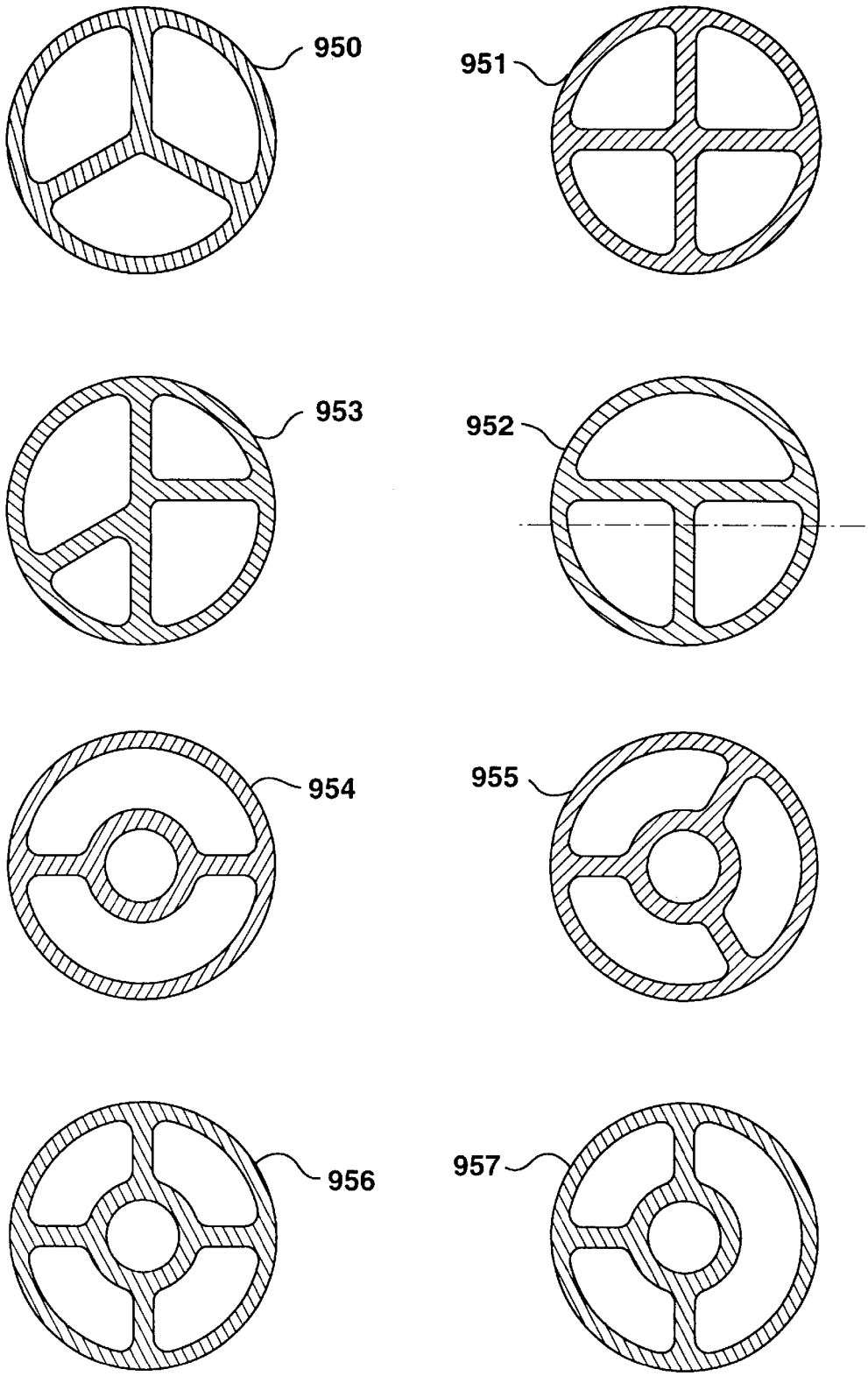
FIG. 25 shows cross-sectional views of extruded pipe assembly cross-sections providing alternatives to the pipe assembly of FIG. 15*a*.
Figure 4C:
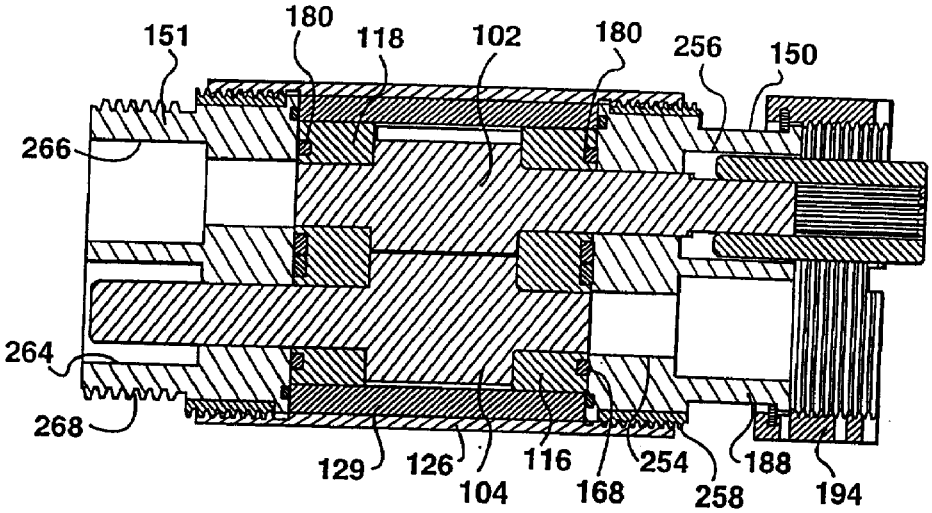
Figure 4A:
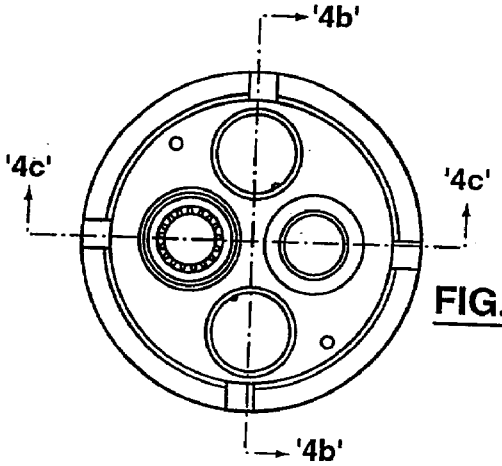
Figure 4B:
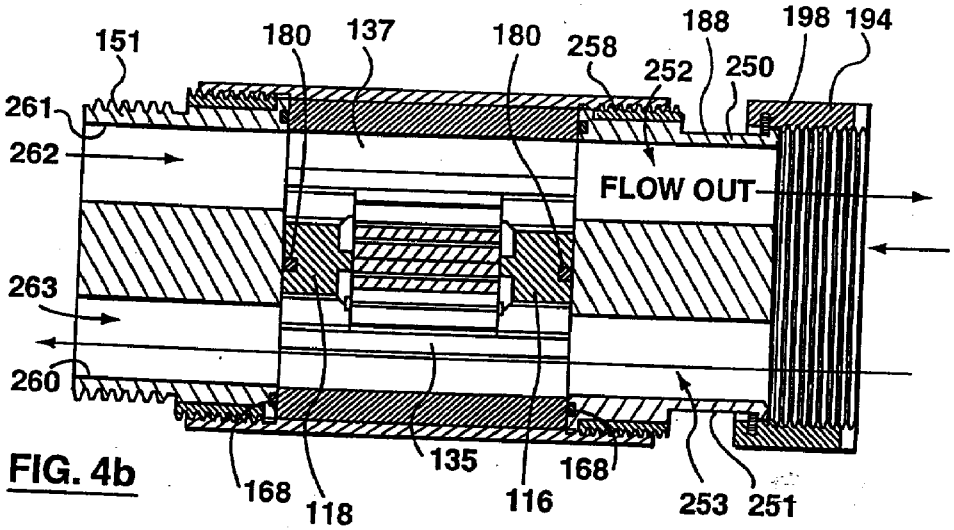
Figures 8A, 8B:
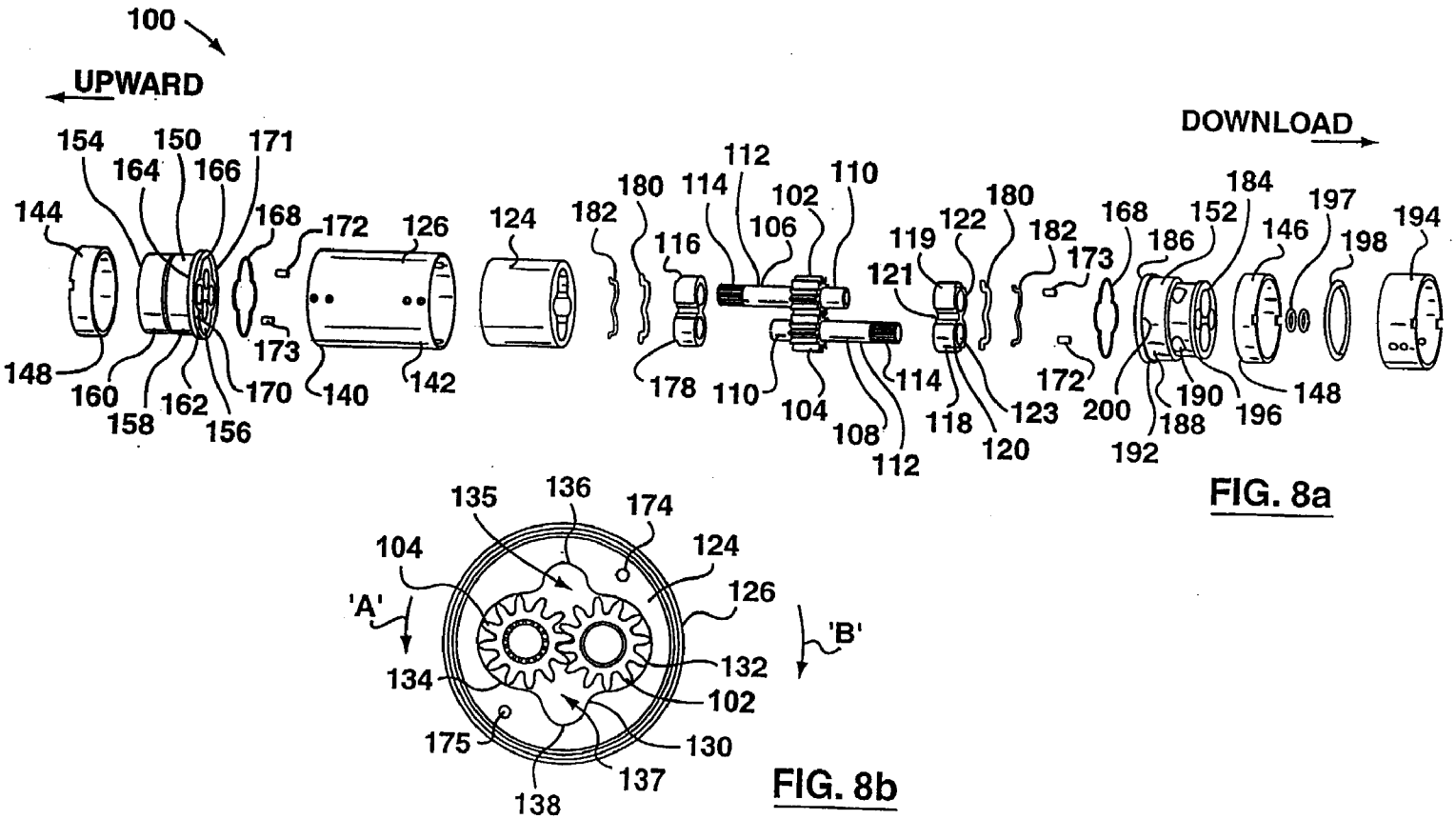
Figures 8D, 8E, 8F, 8G:
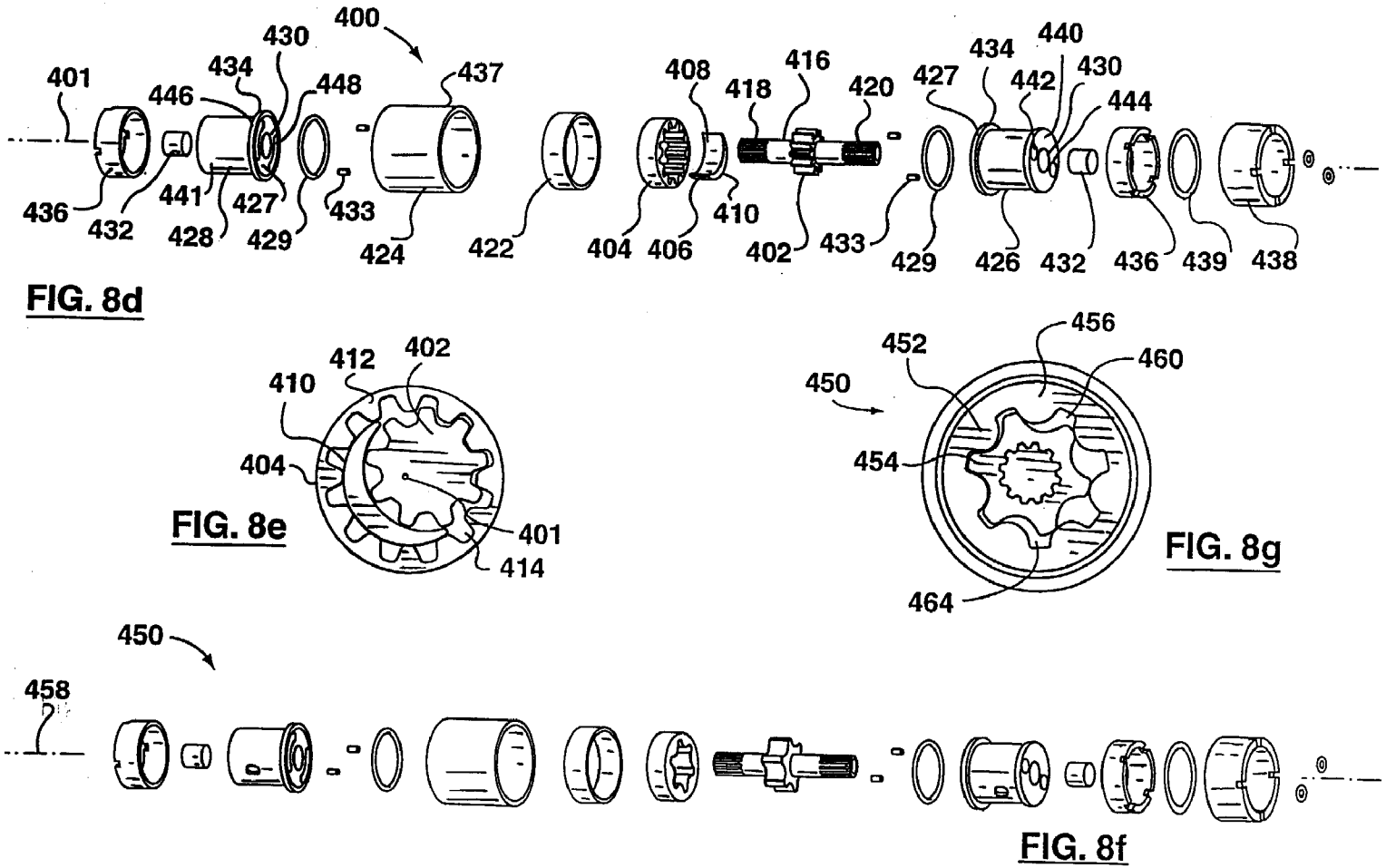
Figure 10B:
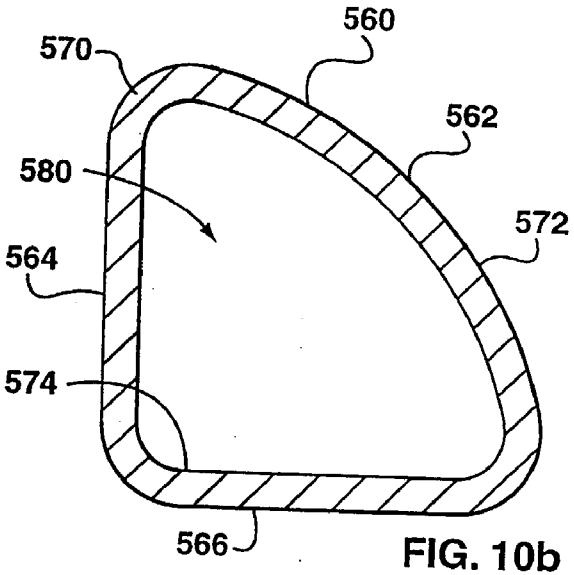
Figure 10A:
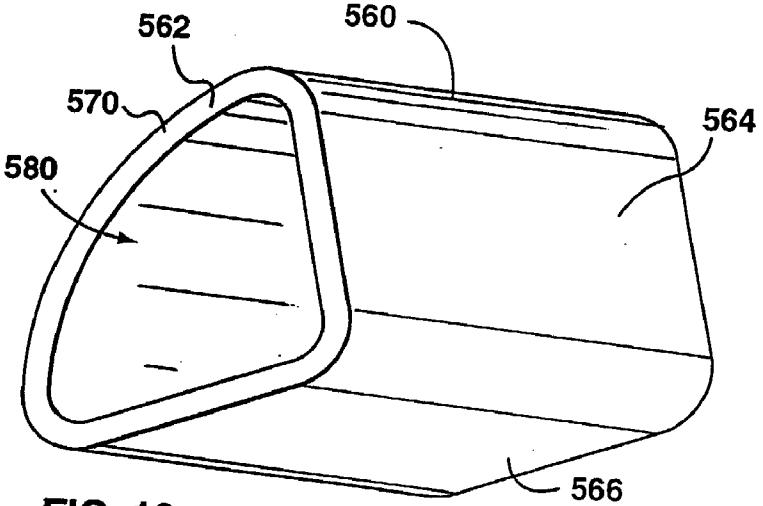
Figure 9A:
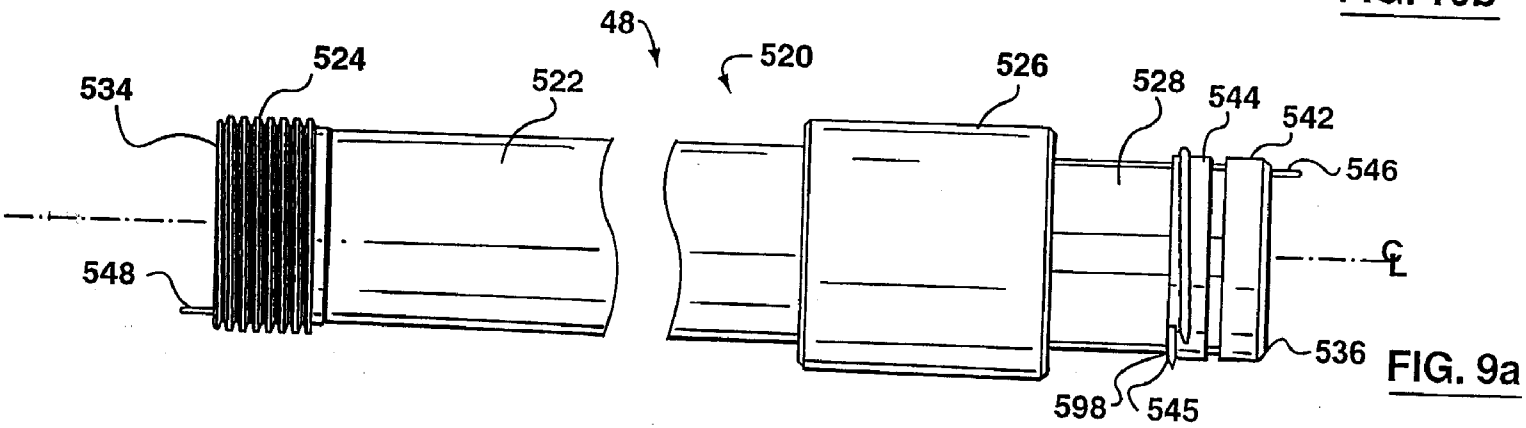
Figure 9D:
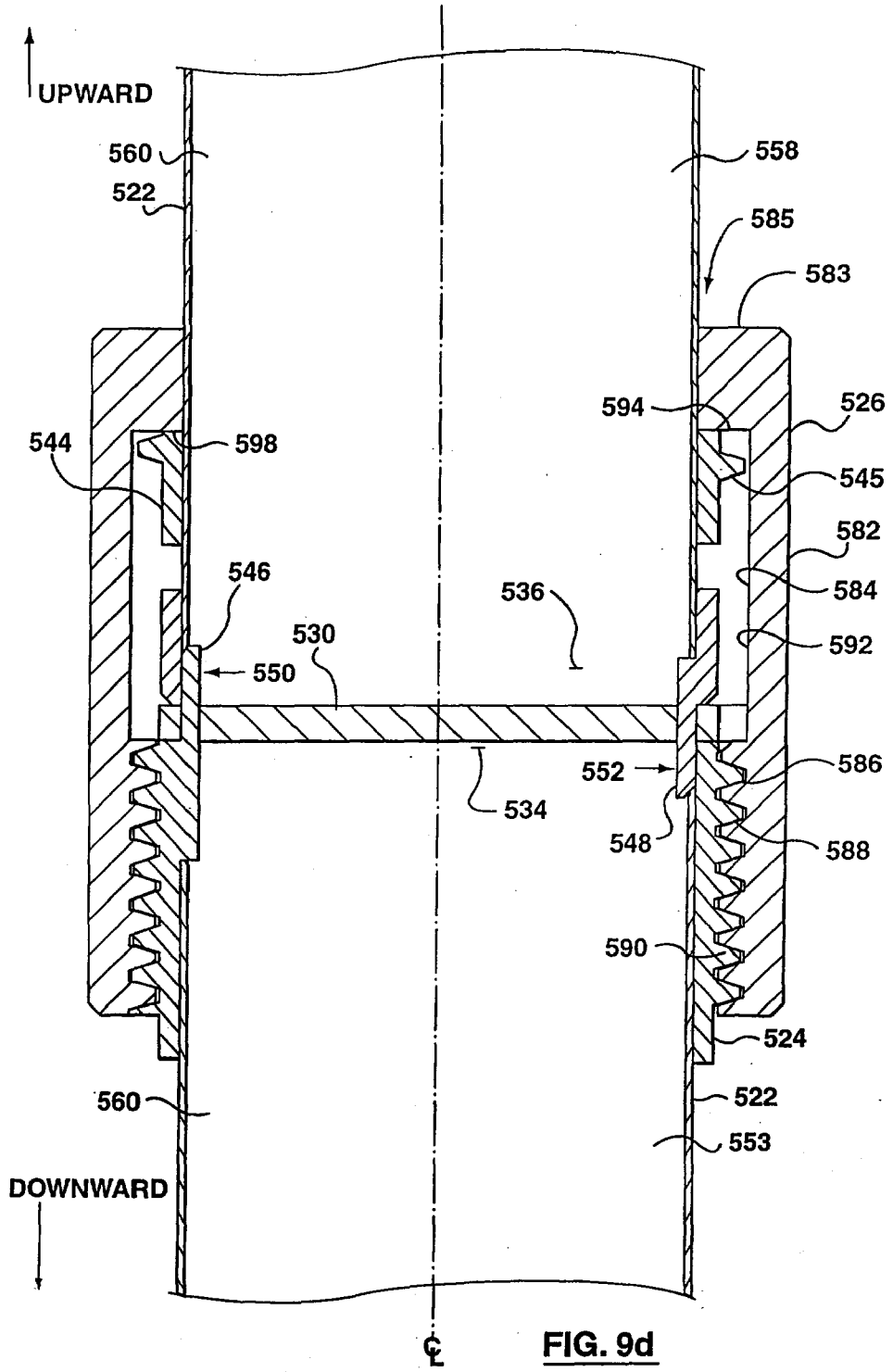
Figure 14F:
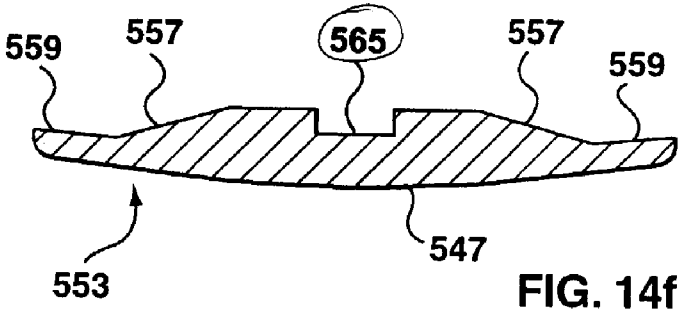
Figure 14D:
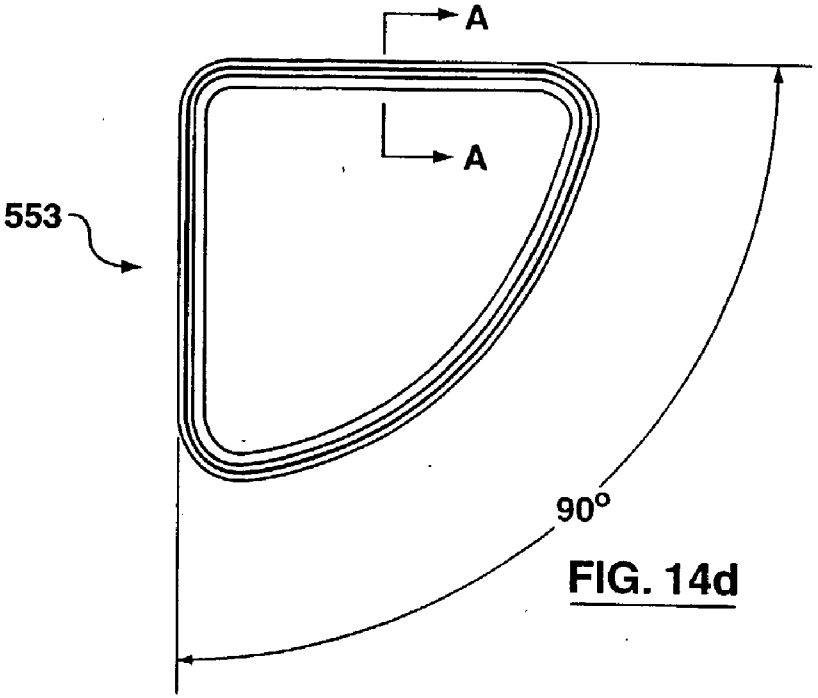
Figure 14E:
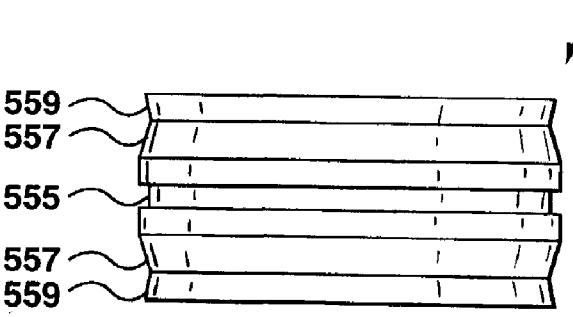
Figure 15A:
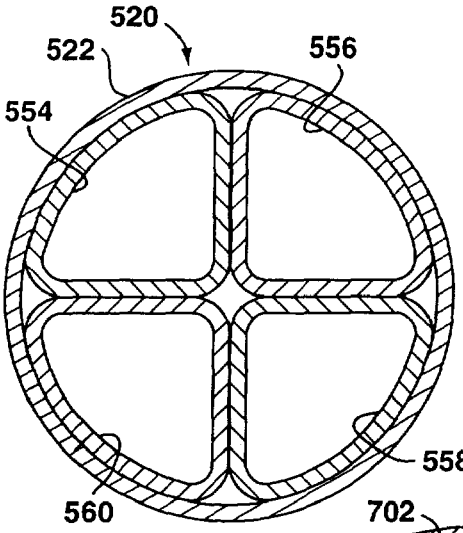
Figure 15B:
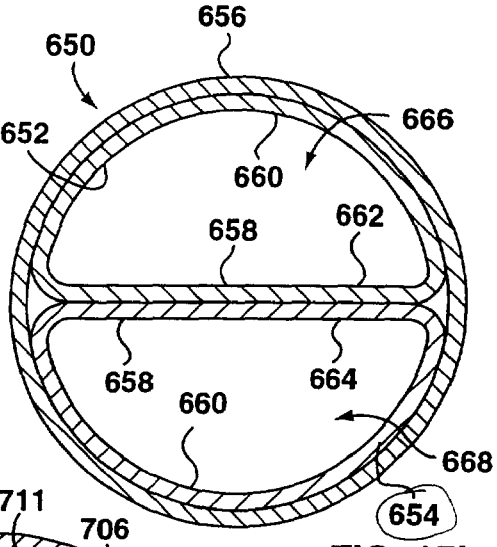
Figure 15C:
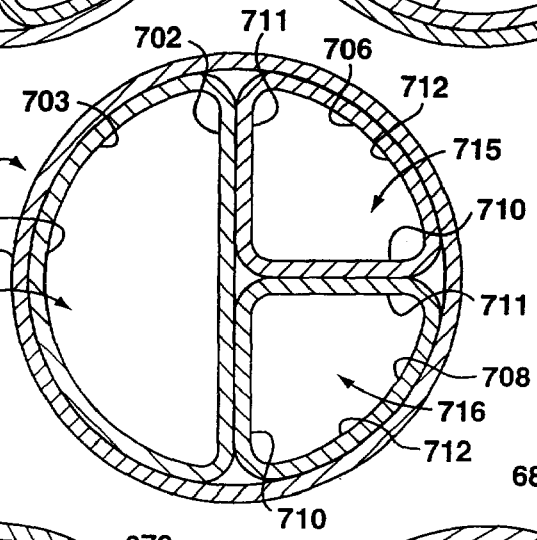
Figure 15D:
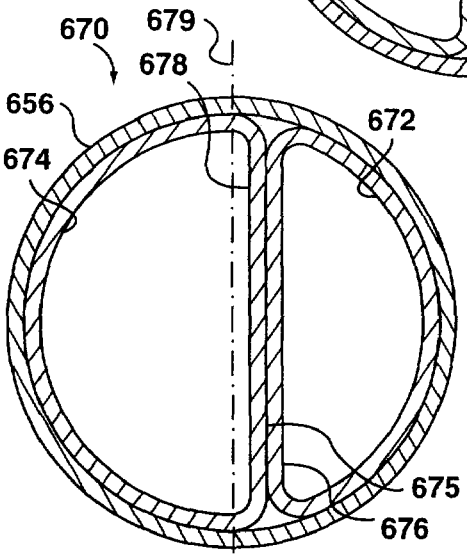
Figure 15E:
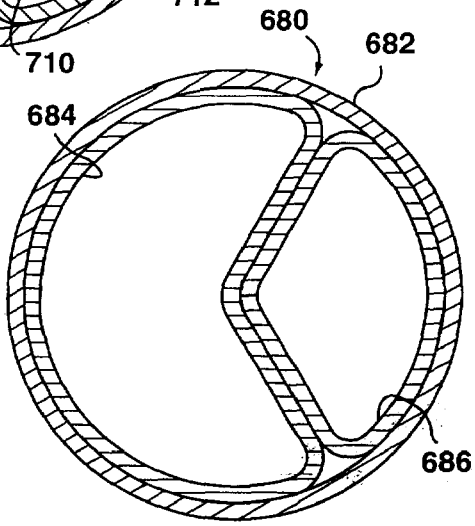
Figure 18A:
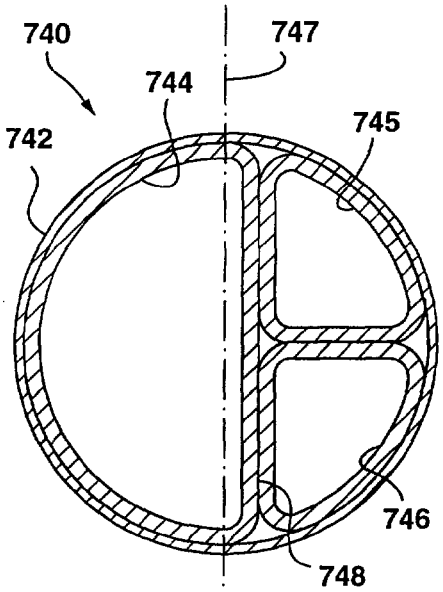
Figure 18B:
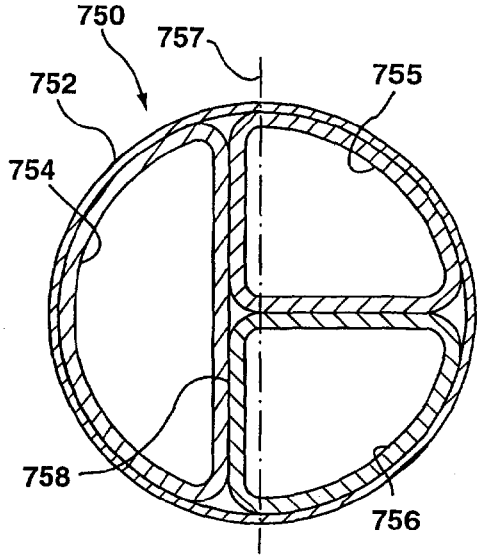
Figure 18C:
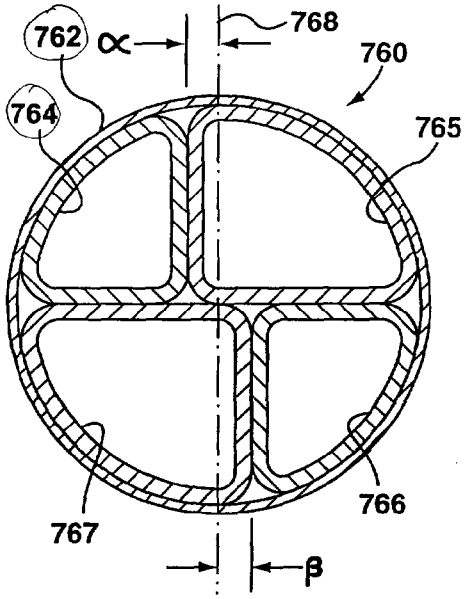
Figure 18D:
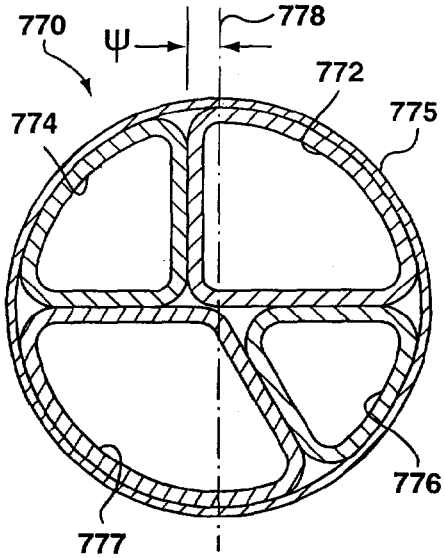
Figure 19A:
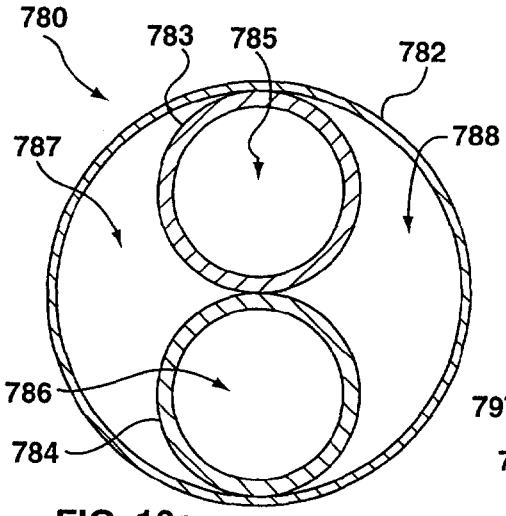
Figure 19B:
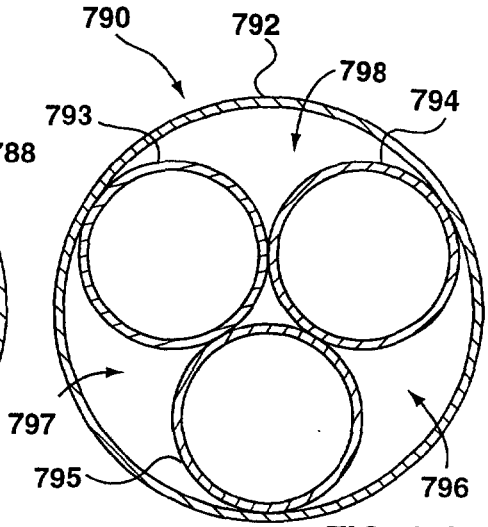
Figure 19C:
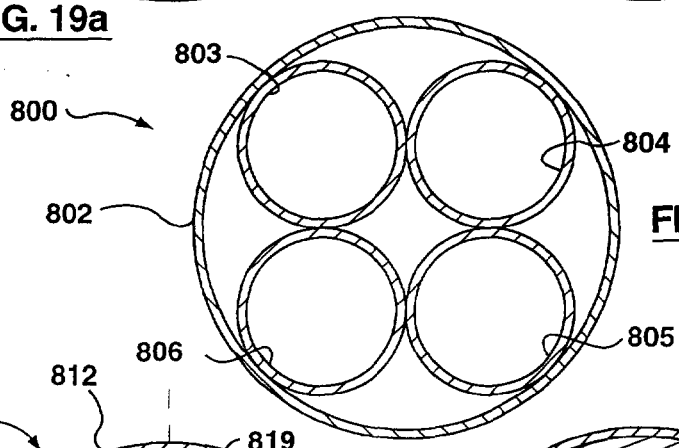
Figure 20A:
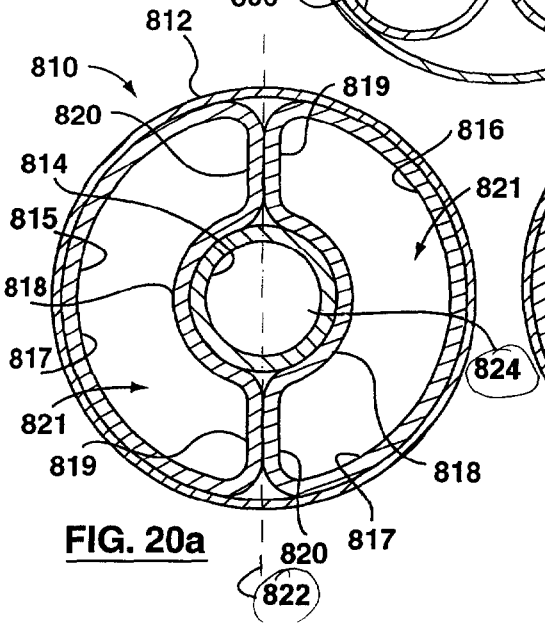
Figure 20B:
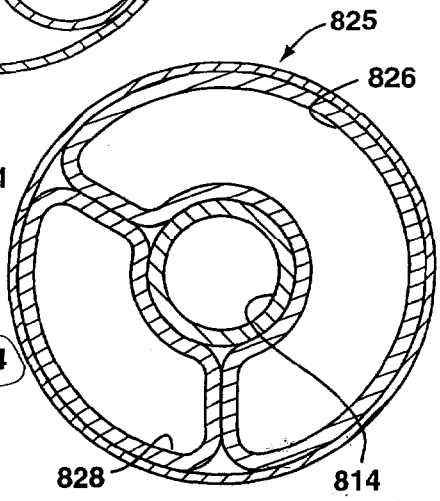

FIG. 25 shows eight variations of cross-sections of extruded tube that could be used as an alternative to the multi-tube assemblies described above, the sections having a suitable pressure rating. The proportions of the pipe walls and webs are not drawn to scale. In principle it is possible to extrude tubes corresponding to any of the sections described above. Member 950 corresponds to assembly 690. Member 951 corresponds to assembly 520. Member 952 corresponds to assembly 750. Member 953 corresponds to assembly 770, and is intended to represent the general case of any four passage duct. Member 954 corresponds to assembly 810. Member 955 corresponds to assembly 830. Member 956 corresponds to assembly 850, and member 957 corresponds to assembly 860 of FIG. 22*b*, or more generally, a four passage duct that includes a central tube.

Various embodiments of the invention have now been described in detail. Since changes in and or additions to the above-described best mode may be made without departing from the nature, spirit or scope of the invention, the invention is not to be limited to those details, but only by the appended claims.

We claim:

1. A fluid displacement apparatus comprising:

a motor unit having a first gearset having an output shaft, said output shaft having an axis of rotation defining an axial direction;

an inlet by which fluid can flow to said first gearset; and an outlet by which fluid can flow away from said first gearset;

a gear pump unit mounted axially with respect to said motor unit, said pump unit having a second gearset connected to be driven by said output shaft of said first gearset;

an inlet by which production fluid can flow to said second gearset; and an outlet by which the production fluid can flow away from said second gearset; and a transport apparatus having a first end and a second end, said second end being connected axially relative to said motor unit and said pump unit; and said transport apparatus having a first passageway defined therein in fluid communication with said inlet of said motor unit by which fluid under pressure can be directed to said first gearset to turn said output shaft; and at least a second passageway defined therein in fluid communication with said outlet of said gear pump unit by which the production fluid from said second gearset can be conveyed to said first end of said transport apparatus.

2. The fluid displacement apparatus of claim 1 wherein said apparatus includes a plurality of said motor units connected axially together to drive said output shaft.

3. The fluid displacement apparatus of claim 1 wherein said apparatus includes a plurality of said gear pump units connected axially together.

4. The fluid displacement apparatus of claim 1 wherein said apparatus includes a plurality of said motor units and a plurality of said gear pump units mounted axially together.

5. The fluid displacement apparatus of claim 4 wherein said first and second passageways extend in side-by-side relationship.

6. The fluid displacement apparatus of claim 1 wherein said transport apparatus has at least a third passageway defined therein, said third passageway being in fluid communication with said outlet of said first gearset to permit return fluid from said first gearset to be carried to said first end of said transport apparatus.

7. The fluid displacement apparatus of claim 1 wherein said transport apparatus has another passageway defined therein by which electrical cabling can extend between said first and second ends.

8. The fluid displacement apparatus of claim 1 wherein said transport apparatus includes a bundle of conduits defining said passageways, said bundle being mounted within a retainer.

9. The fluid displacement apparatus of claim 1 wherein said transport apparatus includes a plurality of modular pipe joints connected together in a pipe string.

10. The fluid displacement apparatus of claim 1 wherein said transport apparatus includes a plurality of modular pipe joints connected together in a string, each of said pipe joints having said passageways defined therein in side-by-side relationship.

11. The fluid displacement apparatus of claim 1 wherein said output shaft is mounted in bushings, and said bushings present a ceramic surface to said output shaft.

12. The fluid displacement apparatus of claim 1 wherein said second gearset includes an input shaft connected to said output shaft of said first gearset, said input shaft being carried in at least one bushing, said bushing presenting a ceramic surface to said input shaft.

13. The fluid displacement apparatus of claim 1 wherein said gear pump unit is free of ball and roller bearings.

14. The fluid displacement apparatus of claim 1 wherein said motor unit is mounted in a cylindrical housing, said housing having a production fluid passageway defined therein, said production fluid passageway being in fluid communication with said outlet of said second gearset and with said second passageway of said transport apparatus to permit production fluid from said gear pump unit to flow in the axial direction past said motor unit.

15. The fluid displacement apparatus of claim 1 wherein said gear pump unit is mounted in a cylindrical housing, said cylindrical housing having porting defined therein to permit production fluid to flow to said inlet of said gear pump unit.

16. The fluid displacement apparatus of claim 1 wherein said motor unit and said gear pump unit are both mounted within respective first and second axially extending round cylindrical housings, said first housing being ported to permit production fluid to flow to said inlet of said gear pump unit, said second housing having at least one production unit passageway defined therewithin by which production fluid flowing from the outlet of said gear pump unit can be transported to said second passageway of said transport apparatus.

17. The fluid displacement apparatus of claim 1 wherein said second gearset includes a pair of meshing gears, said gear pump unit includes a surround member having a cavity defined therein to accommodate said second gearset, and said surround presents a ceramic surface to said gears.

18. The fluid displacement apparatus of claim 17 wherein said surround and said second gearset have corresponding coefficients of thermal expansion.

19. The fluid displacement apparatus of claim 17 wherein said surround has a compressive pre-load.

20. The fluid displacement apparatus of claim 17 wherein said surround is mounted within a shrink fit casing.

21. The fluid displacement apparatus of claim 1 wherein:

said fluid displacement apparatus includes a plurality of said motor units mounted axially together and a plurality of said gear pump units mounted axially together;

each of said motor units has an axially extending pressure passage defined therein communicating with said inlet thereof, and an axially extending return passage defined therein communicating with said outlet thereof;

said pressure passages of said motor units being in fluid communication to form a common high pressure passageway;

said return passages of said motor units being in fluid communication to form a common low pressure passageway; and a plate is mounted between said motor units and said gear pump units to close off said high pressure and low pressure passages from said pump units.

22. The fluid displacement apparatus of claim 21 wherein each of said motor units has an output shaft, and said output shafts are connected through each of the gearsets of said motor units to transmit torque to said input shaft of said pump unit.

23. The fluid displacement apparatus of claim 21 wherein:

one of said motor units is a first end unit closest to said transport apparatus, and another of said motor units is a second end unit farthest from said transport apparatus;

a first end plate connects said first motor end unit to said transport unit;

an intermediate plate connects said first end motor unit to another motor unit axially adjacent thereto; and a second end plate connects said second end motor unit to said gear pump units;

said intermediate plate has axial high and low pressure passageways defined therein to permit fluid communication between said high and low pressure passageways of said motor units, and at least one axial bore accommodating a shaft carrying torque from said first end motor unit to the next motor unit adjacent thereto;

said second end plate is mounted to close off said high and low pressure passageways from said gear pump units; and said first end plate has a first passage defined therein to permit supply of high pressure fluid from said first passageway of said transport apparatus to said high pressure passageway of said motor units, a second passage defined therein to permit discharge from said low pressure passageway to flow to said transport apparatus and at least a third passage defined therein to permit production fluid to flow from said gear pump units to said second passageway of said transport apparatus.

24. A method of moving production fluid from a well to a wellhead said method comprising the steps of:

providing a transport apparatus having a first end for introduction into the well, and a second end for location outside the well;

providing a hydraulic motor having a gearset in a housing, the motor having an inlet, and an outlet, and an output shaft;

providing a gear pump having a gearset in a housing, the gear pump having an input shaft, an inlet, and an outlet;

mounting the hydraulic motor to the first end of the transport apparatus;

mounting the gear pump to the hydraulic motor and connecting the output shaft of the hydraulic motor to the input shaft of the gear pump;

providing a first passageway in the transport apparatus for carrying production fluid from the production region to the wellhead;

establishing the output of the gear pump in fluid communication with the first passageway in the transport apparatus;

providing a second passageway in the transport apparatus for carrying hydraulic fluid from outside the well to the inlet of the hydraulic motor;

introducing the first end of the transport apparatus into the well and locating the gear pump in a production region of the well;

supplying hydraulic fluid under pressure through the second passageway to operate the hydraulic motor; and thereby driving the gear pump to urge production fluid from the production region to the wellhead.

25. The method of claim 24 further including the step of providing a third passageway in the transport apparatus and directing a return flow of hydraulic fluid from said hydraulic motor through said third passageway to the well head.

26. The method of claim 24 wherein said method includes the steps of preparing a well bore having a horizontal production region, and introducing the gear pump into the horizontal production region.

27. The method of claim 24 wherein said method includes the steps of:

preparing a horizontal production region of the well;

preparing a well bore above the horizontal production region;

introducing steam into the well bore, and said step of driving the gear pump follows the step of introducing the steam into the well bore.

28. The method of claim 24 wherein the transport apparatus is a modular pipe joint apparatus and said method includes the step of incrementally introducing one pipe joint after another into the well.

29. The method of claim 28 wherein the step of introducing includes passing the motor, gear pump and the pipe joints through a well head blow out preventer.

* * * * *

UNITED STATES PATENT AND TRADEMARK OFFICE

CERTIFICATE OF CORRECTION

PATENT NO. : 6,454,010 B1
DATED : September 24, 2002
INVENTOR(S) : Wayne Thomas and Gary Morcom It is certified that error appears in the above-identified patent and that said Letters Patent is hereby corrected as shown below:

Drawings,
Please replace drawing sheets 4, 6, 11, 13, 15, 17, 22, 23, 25 and 26 with the attached drawing sheets 4, 6, 11, 13, 15, 17, 22, 23, 25 and 26.

Signed and Sealed this

Thirteenth Day of May, 2003

JAMES E. ROGAN
*Director of the United States Patent and Trademark Office*

Figure 3E:
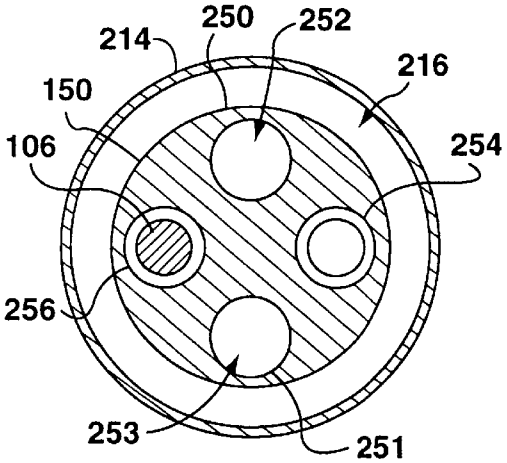
FIG. 3*e* shows a cross-section taken on section '3*e*—3*e*' of FIG. 2*c;*
Figure 3D:
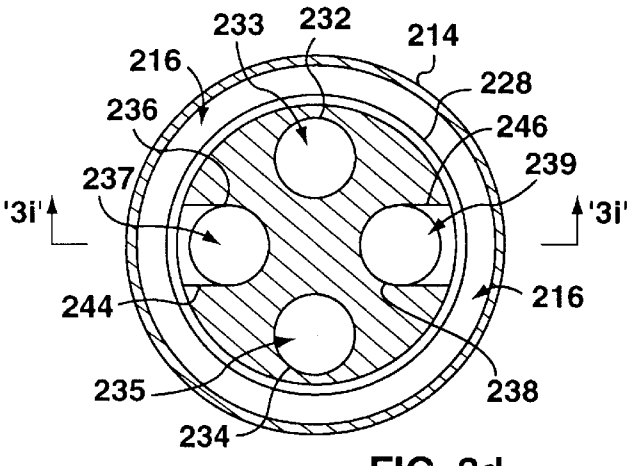
FIG. 3*d* shows a cross-section taken on section '3*d*—3*d*' of FIG. 2*c;*
Figure 3C:
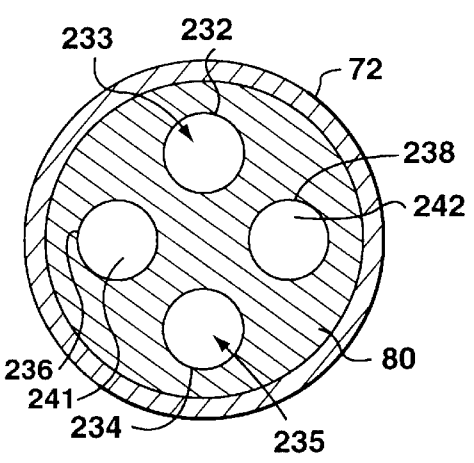
FIG. 3*c* shows a cross-section taken on section '3*c*—3*c*' of FIG. 2*c;*
Figure 3H:
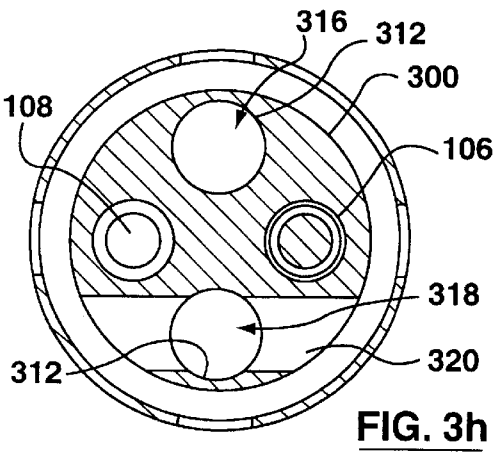
FIG. 3*h* shows a cross-section taken on section '3*h*—3*h*' of FIG. 2*c;*
Figure 3G:
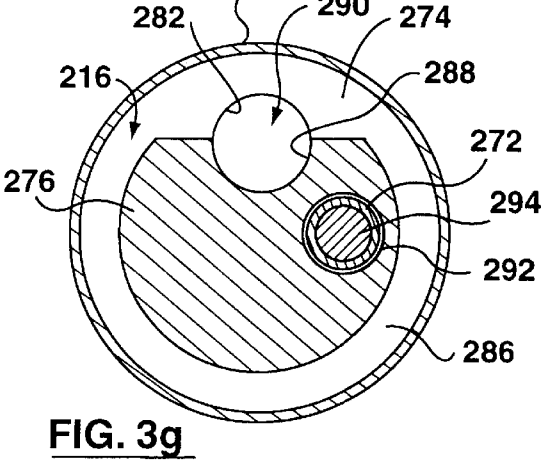
FIG. 3*g* shows a cross-section taken on section '3*g*—3*g*' of FIG. 2*c;*
Figure 3F:
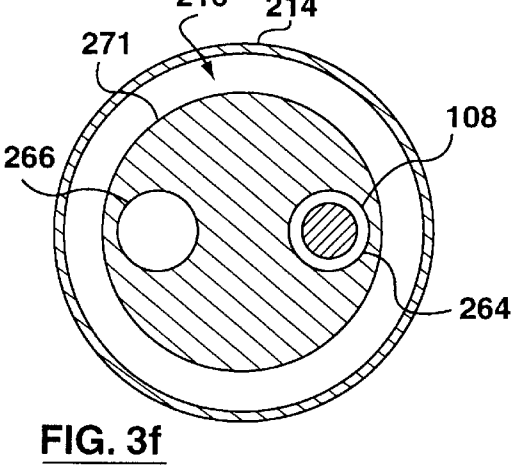
FIG. 3*f* shows a cross-section taken on section '3*f*—3*f*' of FIG. 2*c;*
Figure 3I:
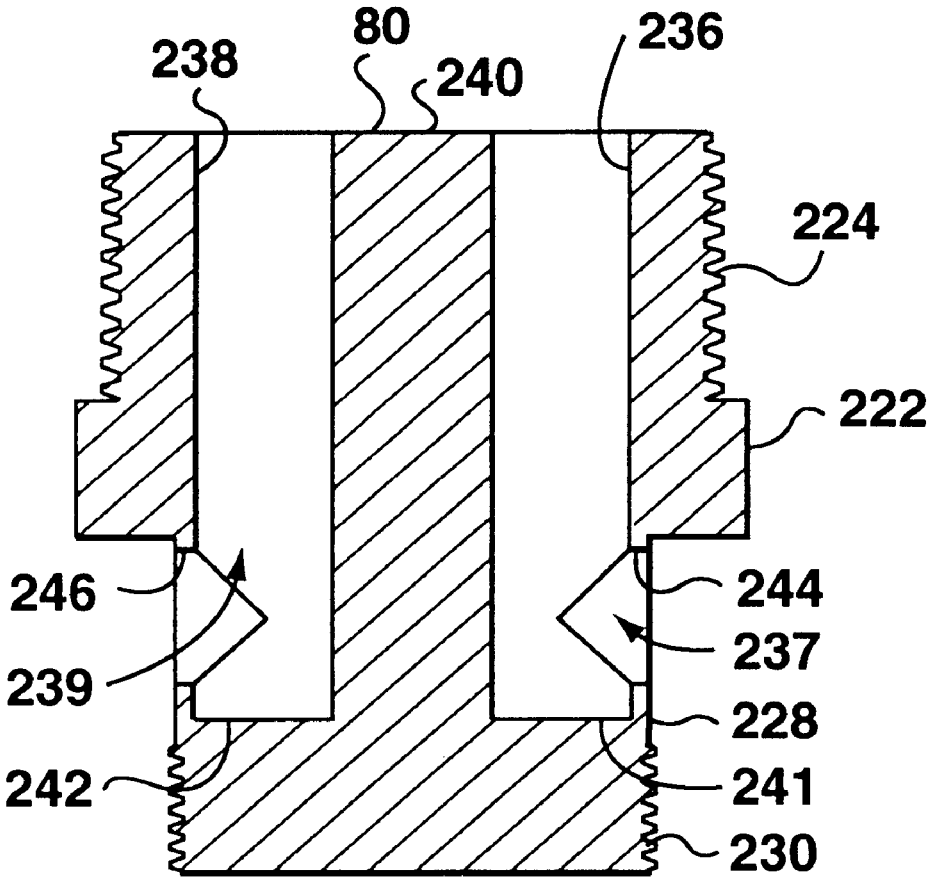
FIG. 3*i* shows a cross-section taken on section '3*i*—3*i*' of FIG. 3*d;*

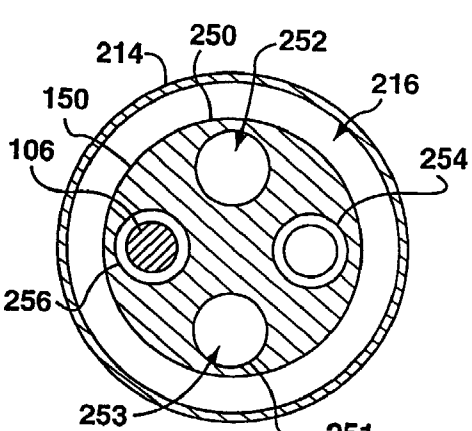
FIG. 3e
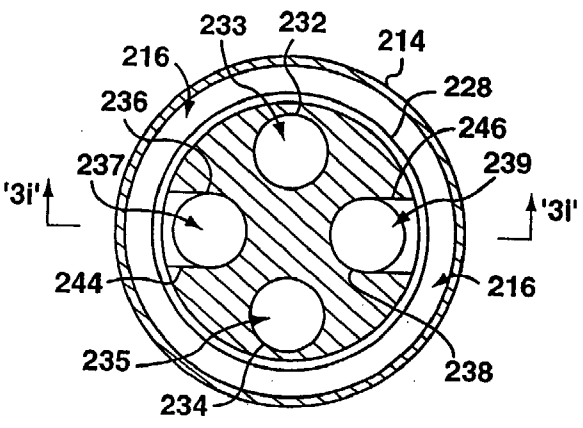
FIG. 3d
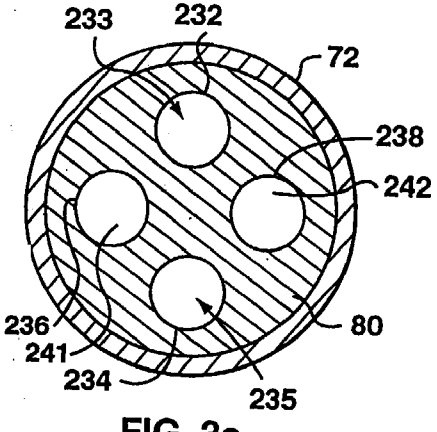
FIG. 3c
FIG. 3h
FIG. 3g
FIG. 3f DOWNLOAD
UPWARD
100
194
198
197
146
148
184
196
152
190
186
188
168
192
200
173
172
182
123
180
120
122
118
119
114
121
112
110
108
102
104
106
110
112
114
116
178
180
182
124
126
142
172
140
168
173
171
170
166
156
150
162
164
158
154
160
144
148

'B'
'A'
124
126
132
102
130
174
137
136
138
135
175
104
134